US008383924B2

(12) United States Patent
Tsuchiya et al.

(10) Patent No.: US 8,383,924 B2
(45) Date of Patent: Feb. 26, 2013

(54) MUSICAL TONE SIGNAL GENERATING APPARATUS

(75) Inventors: Hiroyuki Tsuchiya, Hamamatsu (JP); Kouichi Kashiwazaki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 160 days.

(21) Appl. No.: 13/044,470

(22) Filed: Mar. 9, 2011

(65) Prior Publication Data

US 2011/0219941 A1 Sep. 15, 2011

(30) Foreign Application Priority Data

Mar. 10, 2010 (JP) ..... 2010-52608
Mar. 10, 2010 (JP) ..... 2010-52610
Mar. 10, 2010 (JP) ..... 2010-52611
Sep. 27, 2010 (JP) ..... 2010-215204

(51) Int. Cl.
*G10H 1/00* (2006.01)

(52) U.S. Cl. ..... 84/647; 84/653; 84/659; 84/663

(58) Field of Classification Search ..... 84/647, 84/653, 659, 663
See application file for complete search history.

(56) References Cited

U.S. PATENT DOCUMENTS 4,384,506 A * 5/1983 Amano et al. ..... 84/702
5,270,478 A * 12/1993 Tetsuji et al. ..... 84/627
5,280,129 A * 1/1994 Yamamori et al. ..... 84/656
5,652,402 A * 7/1997 Kondo et al. ..... 84/653
5,804,751 A * 9/1998 Koseki et al. ..... 84/604
6,023,016 A * 2/2000 Tamura ..... 84/604
6,284,963 B1 * 9/2001 Tamura ..... 84/603
6,353,171 B2 * 3/2002 Tamura ..... 84/603
2001/0023634 A1 * 9/2001 Tamura ..... 84/603
2011/0219941 A1 * 9/2011 Tsuchiya et al. ..... 84/622
2012/0186417 A1 * 7/2012 Shirakawa ..... 84/603

FOREIGN PATENT DOCUMENTS

JP 2005-107029 A 4/2005

* cited by examiner

*Primary Examiner* — David S. Warren
(74) *Attorney, Agent, or Firm* — Morrison & Foerster LLP

(57) ABSTRACT

A CPU 19*a* supplies parameters on musical tone signals to a tone generator 17 having a plurality of tone generation channels CH0, CH1, . . . , CH127 each generating a musical tone signal. The parameters include channel information which designates one or more of the tone generation channels, and musical tone information which defines respective musical tone signals which are to be generated in the respective tone generation channels designated by the channel information. The tone generator 17 has a tone generation reservation circuit 17*b* which makes the designated tone generation channels start generation of the musical tone signals defined by the musical tone information when the respective tone volume levels of musical tone signals currently generated in the tone generation channels designated by the channel information are equal to or below a certain tone volume level.

23 Claims, 22 Drawing Sheets

FIG.9 note information

| |
|---|
| note number |
| velocity |
| reference information 1 to tone generation channel information |
| reference information 2 to tone generation channel information |
| forward link |
| rear link |

FIG.10 tone generation channel information

| |
|---|
| vacant channel flag |
| envelope information on various envelopes |
| tone volume level of element signal |
| reference information to note information |

MUSICAL TONE SIGNAL GENERATING APPARATUS

BACKGROUND OF THE INVENTION

1. Field of the Invention

The present invention relates to a musical tone signal generating apparatus having a tone generator including tone generation channels for generating musical tone signals, the musical tone signal generating apparatus assigning generation of new one or more musical tone signals to one or more of the tone generation channels to generate a musical tone in accordance with the one or more musical tone signals.

2. Description of the Related Art

There have been conventional musical tone signal generating apparatuses having a CPU which instructs the start of generation of a musical tone signal and a tone generator which starts the generation of the musical tone signal in response to the instruction, as disclosed in Japanese Unexamined Patent Publication No. 2005-107029, for example. The tone generator of this conventional musical tone signal generating apparatus has a plurality of tone generation channels for generating musical tone signals. In the conventional musical tone signal generating apparatus, in a case where the CPU instructs the tone generator to newly start generation of a different musical tone signal in spite of all the tone generation channels being currently generating musical tone signals, respectively, the CPU selects one of the tone generation channels to instruct decay of the tone volume level of the musical tone signal currently generated in the selected tone generation channel. The CPU then keeps monitoring the tone volume level of the musical tone signal output from the tone generation channel to which the CPU has instructed to decay the tone volume level. When the monitored tone volume level of the musical tone signal attains a certain small level (hereafter referred to as a damp level), the CPU instructs to start generating the different musical tone signal.

Furthermore, in accordance with an instruction to generate a musical tone signal made by manual musical performance played by a player on a keyboard or an instruction to generate a musical tone signal made by automatic musical performance played by reading out performance information previously stored in a memory, the conventional musical tone signal generating apparatus assigns the generation of the musical tone signal to one or more tone generation channels. As soon as the tone volume level of a musical tone signal currently generated in the tone generation channel decays to be a certain threshold level (a damp level) or less, the tone generation channel becomes vacant to be available for a new depression of a key to be ready to newly generate a musical tone signal.

SUMMARY OF THE INVENTION

However, the above-described conventional musical tone signal generating apparatus is disadvantageous in that the CPU cannot carry out another processing during monitoring of the tone volume level of the musical tone signal, resulting in decreased processing speed of the musical tone signal generating apparatus.

In the conventional musical tone signal generating apparatus, furthermore, the damp level is used commonly for both the musical tone signals generated on the basis of manual musical performance and those generated on the basis of automatic musical performance. In order to secure vacant channels efficiently, in this case, the damp level has to be great. By such a great damp level, in automatic musical performance in which a plurality of musical tones of various tone colors are generated at the same time in many cases, even if one of the musical tones is discontinued in spite of a relatively great tone volume level to allow generation of a new musical tone, the discontinued musical tone is not likely to sound as if the musical tone is discontinued unnaturally. In manual musical performance, however, in which the number of concurrently generated musical tones is small with limited variety of tone colors, the discontinued musical tone is likely to sound as if the musical tone is discontinued unnaturally. Particularly, in a case where the musical tones generated by manual musical performance have a tone color which takes long to decay such as musical tones of piano, the discontinued musical tone sounds as if the musical tone is discontinued unnaturally, which is undesirable in view of musical performance. In a case where the damp level is set at a small level, on the other hand, the damp level set at a small level is also disadvantageous in that it takes time to release tone generation channels, which causes shortages of tone generation channels.

The present invention was accomplished to solve the above-described problem, and an object thereof is to provide a musical tone signal generating apparatus having enhanced processing speed.

In addition, the object is to provide the musical tone signal generating apparatus which prevents musical tones from sounding as if they are discontinued unnaturally.

In order to achieve the above-described object, it is a feature of the present invention to provide a musical tone signal generating apparatus including a tone generator (17) having a plurality of tone generation channels (CH0 to CH127) each of which generates a musical tone signal; and a controller (19*a*) which assigns, in response to an instruction to generate a musical tone signal, generation of the musical tone signal to one or more of the tone generation channels, the controller including a reserving portion (S20, S24, S28) for supplying, to the tone generator, musical tone information which defines the musical tone signal which is to be generated and channel designation information which designates the one or more tone generation channels to which the generation of the musical tone signal is to be assigned, to reserve the one or more tone generation channels which are to be used for the generation of the musical tone signal; and the tone generator including a reservation information memory (KM0 to KM127, KML0 to KML127) for storing reservation information indicative of the reservation of the one or more tone generation channels designated by the channel designation information, and a musical tone signal generation starting portion (17*b*3, 17*b*4, 17*b*6, AL0 to AL127, DL1 to DL30) for making, when a tone volume level of a musical tone signal currently generated in each tone generation channel whose reservation information stored in the reservation information memory indicates that the tone generation channel is reserved is equal to or below a certain tone volume level, the each tone generation channel indicating that the tone generation channel is reserved start generating the musical tone signal defined by the musical tone information.

In this case, the musical tone signal generation starting portion may include a tone volume level detector (17*b*3, AL0 to AL127) for detecting the tone volume level of the musical tone signal currently generated in the each tone generation channel whose reservation information indicates that the tone generation channel is reserved, a damp level attainment detector (17*b*4, DL1 to DL30) for detecting, by use of a result detected by the tone volume level detector and the reservation information stored in the reservation information memory, whether the tone volume level of the musical tone signal currently generated in the each tone generation channel whose reservation information indicates that the tone generation channel is reserved is equal to or below the certain tone volume level, and a musical tone signal generation start instructing portion (17*b*6) for instructing, when a result detected by the damp level attainment detector indicates that the tone volume level of the musical tone signal currently generated in the each tone generation channel whose reservation information indicates that the tone generation channel is reserved is equal to or below the certain tone volume level, the each tone generation channel whose reservation information indicates that the tone generation channel is reserved to start generating the musical tone signal defined by the musical tone information.

In this case, furthermore, the tone volume level detector may detect a tone volume level of a musical tone signal currently generated in each tone generation channel of the tone generator, and the controller may further include a level determining portion (S84, CL) for determining, by use of a result detected by the tone volume level detector, whether the tone volume level of the musical tone signal currently generated in the each tone generation channel is equal to or below the certain tone volume level, and an assigned channel determining portion (S16*b*, S16*k*) for determining, by use of a result determined by the level determining portion, the one or more tone generation channels to which the generation of the musical tone signal is to be assigned.

In this case, furthermore, the controller may include a generation instruction information memory (NL) for storing generation instruction information indicative of the instruction to generate the musical tone signal in an order in which the instruction was made, and an assigned channel determining portion (S16*c*, S16*k*) for determining, by use of the generation instruction information stored in the generation instruction information memory, the one or more tone generation channels to which the generation of the musical tone signal is to be assigned.

According to the musical tone signal generating apparatus configured as described above, in order to make the tone generator generate musical tone signals corresponding to an instruction to generate the musical tone signals, the controller is required simply to supply musical tone information which defines the musical tone signals which are to be generated next and channel designation information which designates assigned tone generation channels to the tone generator, to reserve the tone generation channels, and is not required to control the timing at which the tone generation channels start generating the musical tone signals. More specifically, the timing at which the generation of the musical tone signals starts is controlled by the tone generator. After reserving the tone generation channels which are to generate the musical tone signals, therefore, the controller is able to immediately start another processing. Therefore, the musical tone signal generating apparatus according to the present invention offers enhanced processing speed.

It is another feature of the present invention that the reservation information memory includes a first memory (KM0 to KM127) for storing the reservation information such that the reservation information is updated at each instruction to generate a musical tone signal, and a second memory (KML0 to KML127) for storing, before the tone volume level detector starts detecting the tone volume level of the musical tone signal currently generated in the each tone generation channel whose reservation information indicates that the tone generation channel is reserved, the reservation information stored in the first memory to keep the reservation information until completion of the detection of tone volume level by the tone volume level detector, and the musical tone signal generation starting portion detects, by use of the result detected by the tone volume level detector and the reservation information stored in the second memory, whether the tone volume level of the musical tone signal currently generated in the each tone generation channel whose reservation information indicates that the tone generation channel is reserved is equal to or below the certain tone volume level.

According to the musical tone signal generating apparatus configured as described above, the reservation information stored in the second memory will not be updated during the detection of the tone volume level of the musical tone signals by the tone volume level detector. As described concretely below, therefore, the musical tone signal generating apparatus of the present invention prevents musical tone signals from sounding unnaturally.

If the detection of whether respective tone volume levels of musical tone signals are equal to or below the certain tone volume level were done in order to reserve tone generation channels by use of the reservation information stored in the first memory which can be updated anytime, for example, musical tone signals might sound unnaturally as described below. More specifically, if the controller reserves a tone generation channel CHa whose tone volume level has been already detected by the tone volume level detector and a tone generation channel CHb whose tone volume level has not been detected yet, the reservation information stored in the first memory will be updated before the detection of the tone volume level of the tone generation channel CHb. After the update of the reservation information stored in the first memory, the tone volume level detector detects the tone volume level of the tone generation channel CHb. Even if the detected tone volume level of the tone generation channel CHa is greater than the certain tone volume level, the musical tone signal generation starting portion starts generating the musical tone signals in the tone generation channels CHa, CHb as long as the detected tone volume level of the tone generation channel CHb is equal to or below the certain tone volume level. In such a case, therefore, the musical tone signal which is currently being generated in the tone generation channel CHa sounds unnaturally as if the musical tone signal were suddenly discontinued. According to the musical tone signal generating apparatus configured as described above, therefore, the musical tone signal generation starting portion detects whether the respective tone volume levels of the musical tone signals are equal to or below the certain tone volume level by use of the reservation information kept in the second memory, preventing the musical tone signals from sounding unnaturally.

It is still another feature of the present invention that the tone generator further includes an identification information assigner (17*b*1) for assigning common identification information to the one or more tone generation channels designated by the channel designation information at each instruction to generate a musical tone signal, and an identification information memory (GU1 to GU30) for storing an identification information flag which is set in response to the assignment of the common identification information to the designated one or more tone generation channels by the identification information assigner, and is cleared in response to the start of the generation of the musical tone signal in the each tone generation channel whose reservation information indicates that the tone generation channel is reserved by the musical tone signal generation starting portion such that each piece of the common identification information has the identification information flag in a one-to-one relationship, and the reservation information memory stores the assigned common identification information as the reservation information.

In this case, options of the common identification information may be previously provided, the identification information assigner may select, by use of the identification information flag, one of the options which has not been assigned to any tone generation channel, to assign the selected option of the identification information to the designated one or more tone generation channels, the tone generator may further include an assignment availability detector (17*b*2, GF) for detecting, by use of the identification information flag stored in the identification information memory, whether the designated one or more tone generation channels are able to be assigned the option of the identification information, and the reserving portion may include a waiting portion (S26) for waiting, by use of a result detected by the assignment availability detector, until the assignment of the option of the common identification information to the designated one or more tone generation channels becomes available.

The musical tone signal generating apparatus configured as described above enables management of those tone generation channels which concurrently start generating musical tone signals through the use of the common identification information. By use of pieces of identification information, more specifically, a plurality of groups each having one or more tone generation channels are formed to manage the reserved tone generation channels. Even if the controller is instructed to start generation of a multiplicity of musical tone signals in a short period of time, therefore, the controller is able to reserve tone generation channels as long as there remains a vacant piece of common identification information. After making the reservation, in addition, the controller is able to execute another processing immediately, resulting in enhanced processing speed of the musical tone signal generating apparatus.

It is a further feature of the present invention to provide a musical tone signal generating apparatus including a tone generator (17) having a tone generation channel (CH0 to CH127) for generating a musical tone signal; and a controller (19*a*) which instructs, in response to an instruction to generate a musical tone signal, the tone generation channel to generate the musical tone signal, the controller including a reserving portion (S22, S28) for supplying to the tone generator in response to the instruction to generate the musical tone signal, musical tone information which defines the musical tone signal which is to be generated, to reserve the tone generation channel which is to generate the musical tone signal and a cancelling portion (S16*i*) for cancelling, in a case where the tone generation channel which the reserving portion desires to reserve has been already reserved in order to generate a different musical tone signal, the different reservation, and the tone generator including a reservation information memory (KM0 to KM127, KML0 to KML127, AF0 to AF127) for storing, in response to a reservation made by the reserving portion or a cancellation of a reservation made by the cancelling portion, reservation information indicative of whether the tone generation channel is reserved or not, and a musical tone signal generation starting portion (17*b*3, 17*b*4, 17*b*6, AL0 to AL127, DL1 to DL30) for making, when a tone volume level of a musical tone signal currently generated in the reserved tone generation channel is equal to or below a certain tone volume level, the tone generation channel whose reservation information indicates that the tone generation channel is reserved start generating the musical tone signal defined by the musical tone information. In this case, the tone generator may have a plurality of tone generation channels each of which generates a musical tone signal, and the controller may assign, in response to the instruction to generate the musical tone signal, the generation of the musical tone signal to one or more of the tone generation channels.

Even in a case where a tone generation channel which the controller desires to reserve has been already reserved for a different musical tone signal, the musical tone signal generating apparatus configured as described above is able to forcefully cancel the different reservation to reserve the tone generation channel for the generation of a musical tone signal corresponding to an instruction to generate the musical tone signal which occurred after the different reservation. Even though the tone generation channel which the controller desires to reserve has been already reserved, therefore, the controller is not required to wait until the different reservation of the tone generation channel is executed so that the tone generation channel will become vacant. Furthermore, the controller is not required to control the timing at which the reserved tone generation channel starts generation of a musical tone signal. Because the timing at which musical tone signals are generated is controlled by the tone generator, more specifically, the controller is able to start another processing immediately after the reservation. Therefore, the musical tone signal generating apparatus offers enhanced processing speed.

It is a still further feature of the present invention that the tone generator further includes an updating portion (17*b*1, 17*b*7) for updating, in response to the reservation made by the reserving portion or the cancellation of a reservation made by the cancelling portion, the reservation information, a cancel flag memory (CF0 to CF127) for storing a cancel flag which is set in response to the update of the reservation information by the updating portion in response to the cancellation of the different reservation, and is cleared in response to start of generation of the different musical tone signal by the musical tone signal generation starting portion in response to an instruction to generate the different musical tone signal, and a tone volume level controlling portion (AMP) for controlling the tone volume level of the musical tone signal in accordance with the musical tone information supplied from the controller, and the controller further includes a decay instructing portion (S16*i*) for instructing, in a case where the cancel flag has been cleared, the tone volume level controlling portion to forcefully decay the tone volume level of the different musical tone signal currently generated in the tone generation channel reserved for the generation of the different musical tone signal.

The musical tone signal generating apparatus configured as described above enables the controller to determine whether the different reservation which the controller has instructed to cancel has been cancelled by the tone generator. There can be a case where even though the controller has instructed to cancel the different reservation, the instruction was not made in time, so that the tone generator starts generating a musical tone signal of the different reservation. In such a case, if the controller newly reserves the tone generation channel to which the different reservation was made under the assumption that the different reservation has been already cancelled, the generation of a musical tone signal of the new reservation may be delayed as explained below. In a case where a musical tone of the different reservation which has started being generated without being cancelled is a sustaining tone color such as organ, the tone generator will not be able to start generation of a musical tone of the new reservation until a key-off event is generated for the sustaining musical tone. Even in a case where the musical tone of the different reservation which has started being generated without being cancelled is a decaying tone color such as piano, if the musical tone takes long to decay, the tone generator will not be able to start generation of a musical tone of the new reservation until the musical tone of the different reservation attains the damp level. In such cases, the generation of the musical tone signal of the new reservation will be delayed. Therefore, the musical tone signal generating apparatus configured as described above determines whether the different reservation has been already cancelled. In a case where it is determined that the different reservation has been already cancelled, the tone generation channel of the cancelled reservation may be reserved to generate the musical tone of the new reservation. In a case where it is determined that the different reservation has started generation of a musical tone signal without being cancelled, the controller decays the musical tone of the different reservation, and newly reserves the tone generation channel. As described above, the controller determines whether the different reservation has been cancelled, and forcefully decays, in a case where it is determined that the musical tone signal of the different reservation has been generated without being cancelled, the musical tone of the different reservation to prevent delay of the generation of the musical tone of the new reservation.

It is another feature of the present invention to provide a musical tone signal generating apparatus including a tone generator (17) having a tone generation channel (CH0 to CH127) for generating a musical tone signal; and a controller (19*a*) which instructs, in response to an instruction to generate a musical tone signal, the tone generation channel to generate the musical tone signal, the controller including a reserving portion (S22, S28) for supplying to the tone generator, in response to the instruction to generate the musical tone signal, musical tone information which defines the musical tone signal which is to be generated, to reserve the tone generation channel which is to generate the musical tone signal, and the tone generator including a reservation information memory (KM0 to KM127, KML0 to KML127, AF0 to AFL127) for storing, in response to a reservation made by the reserving portion, reservation information indicative of whether the tone generation channel is reserved or not, a musical tone information memory (17*c*5, 17*c*6) for storing the musical tone information supplied from the controller, and a musical tone signal generation starting portion (17*b*3, 17*b*4, 17*b*6, 17*c*2, 17*c*3, 17*c*4, AL0 to AL127, DL1 to DL30) for supplying, when a tone volume level of a musical tone signal currently generated in the tone generation channel whose reservation information stored in the reservation information memory indicates that the tone generation channel is reserved is equal to or below a certain tone volume level after the reservation of the tone generation channel made by the controller, the stored musical tone information to the tone generation channel whose reservation information indicates that the tone generation channel is reserved, to make the tone generation channel start generating the musical tone signal defined by the musical tone information. In this case, the tone generator may have a plurality of tone generation channels each of which generates a musical tone signal, and the controller may assign, in response to an instruction to generate a musical tone signal, generation of the musical tone signal to one or more of the tone generation channels.

According to the musical tone signal generating apparatus configured as described above, the controller writes musical tone information into the musical tone information memory for the reservation of a tone generation channel in response to an instruction to generate a musical tone signal, whereas the tone generator then starts generation of the musical tone signal by use of the musical tone information stored in the musical tone information memory. After the completion of the reservation of the tone generation channel, in other words, the controller is not involved in the supply of the musical tone information to the tone generation channel until the start of the generation of the musical tone signal, so that the controller is able to carry out another processing during the supply of the musical tone information. Therefore, the musical tone signal generating apparatus enhances processing speed.

It is still another feature of the present invention that the musical tone information supplied from the controller to the tone generator includes initial information used for initial setting of the tone generation channel, and normal information used for varying the musical tone signal currently being generated in the tone generation channel, the musical tone information memory includes a first memory (17*c*5) for storing the initial information and the normal information and a second memory (17*c*6) for storing the normal information, and the musical tone signal generation starting portion includes a damp level attainment detector (17*b*3, 17*b*4, AL0 to AL127, DL1 to DL30) for detecting whether the tone volume level of the musical tone signal currently generated in the tone generation channel whose reservation information indicates that the tone generation channel is reserved is equal to or below the certain tone volume level, an initial information supplying portion (17*c*2) for supplying, when a result detected by the damp level attainment detector indicates that the tone volume level of the musical tone signal currently being generated in the tone generation channel whose reservation information indicates that the tone generation channel is reserved is equal to or below the certain tone volume level, the initial information stored in the first memory to the tone generation channel whose reservation information indicates that the tone generation channel is reserved, a transferring portion (17*c*3) for transferring, when the result detected by the damp level attainment detector indicates that the tone volume level of the musical tone signal currently being generated in the tone generation channel whose reservation information indicates that the tone generation channel is reserved is equal to or below the certain tone volume level, the normal information stored in the first memory to the second memory such that the second memory stores the transferred normal information, a normal information supplying portion (17*c*4) for supplying the normal information stored in the second memory to the tone generation channel whose reservation information indicates that the tone generation channel is reserved, and a musical tone signal generation start instructing portion (17*b*6) for instructing, when the result detected by the damp level attainment detector indicates that the tone volume level of the musical tone signal currently being generated in the tone generation channel whose reservation information indicates that the tone generation channel is reserved is equal to or below the certain tone volume level, the tone generation channel whose reservation information indicates that the tone generation channel is reserved to start generating the musical tone signal defined by the musical tone information.

According to the musical tone signal generating apparatus configured as described above, because the initial information is used only for initial setting of the tone generation channel at the time of the start of the generation of the musical tone signal, there is no need for transferring the initial information to the second memory. In other words, the initial information is supplied from the first memory to the reserved tone generation channel. Therefore, the musical tone signal generating apparatus configured as described above reduces the storage capacity of the second memory.

It is a further feature of the present invention that the tone generator further includes an operating status detector (17*c*1, SF) for detecting an operating status of the tone generation channel currently generating the musical tone signal, and the controller further includes an updating portion (S54) for updating, by use of a result detected by the operating status detector, the normal information stored in the second memory. In this case, the normal information which the updating portion updates may be information on tone pitch of the musical tone signal. In this case, furthermore, the normal information which the updating portion updates may be information on tone volume level of the musical tone signal. In this case, furthermore, the normal information which the updating portion updates may be information on tone color of the musical tone signal. The musical tone signal generating apparatus configured as described above enables the controller to update the normal information stored in the second memory during the generation of a musical tone signal to vary the musical tone signal which is currently being generated. As compared with a case in which the normal information necessary for varying a musical tone signal is supplied at the time of the reservation of the tone generation channel at one time, the musical tone signal generating apparatus configured as described above can reduce the respective storage capacities of the first memory and the second memory.

It is a still further feature of the present invention to provide a musical tone signal generating apparatus including a plurality of tone generation channels (CH0, CH1, . . . , CH127) each of which generates a musical tone signal; and an assigner (S28) which assigns, in response to each of instructions to generate different types of musical tone signals, each of the musical tone signals to any of the tone generation channels so that the respective tone generation channels will generate the assigned musical tone signals wherein the assigner is provided with a first selection portion (S16*b*, S16*h*, S42 to S56) which selects, in response to an instruction to generate a new musical tone signal, from among the plurality of tone generation channels as a tone generation channel which is to generate the new musical tone signal, the tone generation channel generating the assigned musical tone signal of a tone volume level which is equal to or below a threshold value which is included in different threshold values provided to correspond to the types of the musical tone signals and corresponds to the type of the assigned musical tone signal. In this case, the first selection portion may have a vacant channel setting portion (S42 to S56) which compares, at certain time intervals, a tone volume level of each of the musical tone signals assigned to the respective tone generation channels with the threshold value which is included in the different threshold values (DS0, DS1) provided to correspond to the types of the musical tone signals and corresponds to the musical tone signal, and sets, when the tone volume level of the musical tone signal is equal to or below the threshold value corresponding to the musical tone signal, the tone generation channel to which the musical tone signal is assigned as a vacant channel; and a channel determination portion (S16*b*, S16*h*) which determines, in response to an instruction to generate a new musical tone signal, the set vacant channel as a tone generation channel which is to generate the new musical tone signal.

By such a configuration of the musical tone signal generating apparatus, in a case where respective tone volume levels of musical tone signals decay at the same velocity, the tone generation channel which is generating the musical tone signal of a larger threshold value is to be released at an earlier point in time from the start of generation of the musical tone signal than a point at which the tone generation channel which is generating the musical tone signal of a smaller threshold value is released. By providing a larger threshold value for the type of musical tone signals which are less important in musical performance, therefore, in spite of a musical tone signal of a relatively great tone volume level, the generation of the musical tone signal can be discontinued at an early point in time from the start of the generation of the musical tone signal so that the tone generation channel generating the musical tone signal will be selected as a tone generation channel which is to generate a new musical tone signal. By providing a smaller threshold value for the type of musical tone signals which are more important in musical performance, on the other hand, in spite of a long period of time elapsed from the generation of the musical tone signal, the tone generation channel generating the musical tone signal is allowed to continue the generation of the musical tone signal until the tone volume level of the musical tone signal decays sufficiently. Therefore, the musical tone signal generating apparatus of such a configuration prevents played musical tones from sounding as if they are discontinued unnaturally.

It is another feature of the present invention that the different types of musical tone signals include musical tone signals generated by player's manual musical performance and musical tone signals generated by automatic musical performance; and the threshold value (DS0) corresponding to the musical tone signals generated by the manual musical performance is smaller than the threshold value (DS1) corresponding to the musical tone signals generated by the automatic musical performance. Therefore, the musical tone signal generating apparatus of such a configuration prevents musical tone signals generated by manual musical performance which is more important for musical performance than automatic musical performance from sounding as if they are discontinued unnaturally.

It is still another feature of the present invention that the assigner is provided with a second selection portion (S16*c*) which selects, when there is no tone generation channel whose tone volume level is equal to or below the corresponding threshold value, a tone generation channel generating a musical tone signal which has been generated for the longest time from among the plurality of tone generation channels as a tone generation channel which is to generate the new musical tone signal. By such a configuration, when there is no tone generation channel whose tone volume level is equal to or below the corresponding threshold value, the tone generation channel generating a musical tone signal which has been generated for the longest time to be less important for musical performance is to be selected as a tone generation channel to generate the new musical tone signal. Therefore, the musical tone signal generating apparatus of such a configuration prevents musical tones from sounding as if they are discontinued unnaturally.

It is a further feature of the present invention that the assigner is provided with a second selection portion which selects, when there is no tone generation channel whose tone volume level is equal to or below the corresponding threshold value, a tone generation channel generating a musical tone signal having the smallest tone volume level from among the plurality of tone generation channels as a tone generation channel which is to generate the new musical tone signal. By such a configuration, when there is no tone generation channel whose tone volume level is equal to or below the corresponding threshold value, the tone generation channel generating a musical tone signal having the smallest tone volume level to be less important for musical performance is to be selected as a tone generation channel to generate the new musical tone signal. Therefore, the musical tone signal generating apparatus of such a configuration prevents musical tones from sounding as if they are discontinued unnaturally.

It is a still further feature of the present invention that the musical tone signal generating apparatus further includes a truncation portion (S16*g*) which quickly decays the tone volume level of the musical tone signal currently generated by the tone generation channel selected by the second selection portion. By such a configuration, because the tone volume level of the musical tone signal currently generated in the tone generation channel selected by the second selection portion quickly decays, the musical tone signal generating apparatus shortens the time taken from the assignment of generation of the new musical tone signal to the selected tone generation channel to the start of generation of the new musical tone signal.

The above-described numbers and characters within parentheses are provided to correspond to an embodiment described later in order to facilitate the understanding of the present invention. However, the present invention is not limited to the embodiment.

BRIEF DESCRIPTION OF THE DRAWINGS

FIG. 9 is a memory map indicative of a configuration of note information;

FIG. 10 is a memory map indicative of a configuration of tone generation channel information;

DESCRIPTION OF THE PREFERRED EMBODIMENT a. General Configuration

Figure 1:
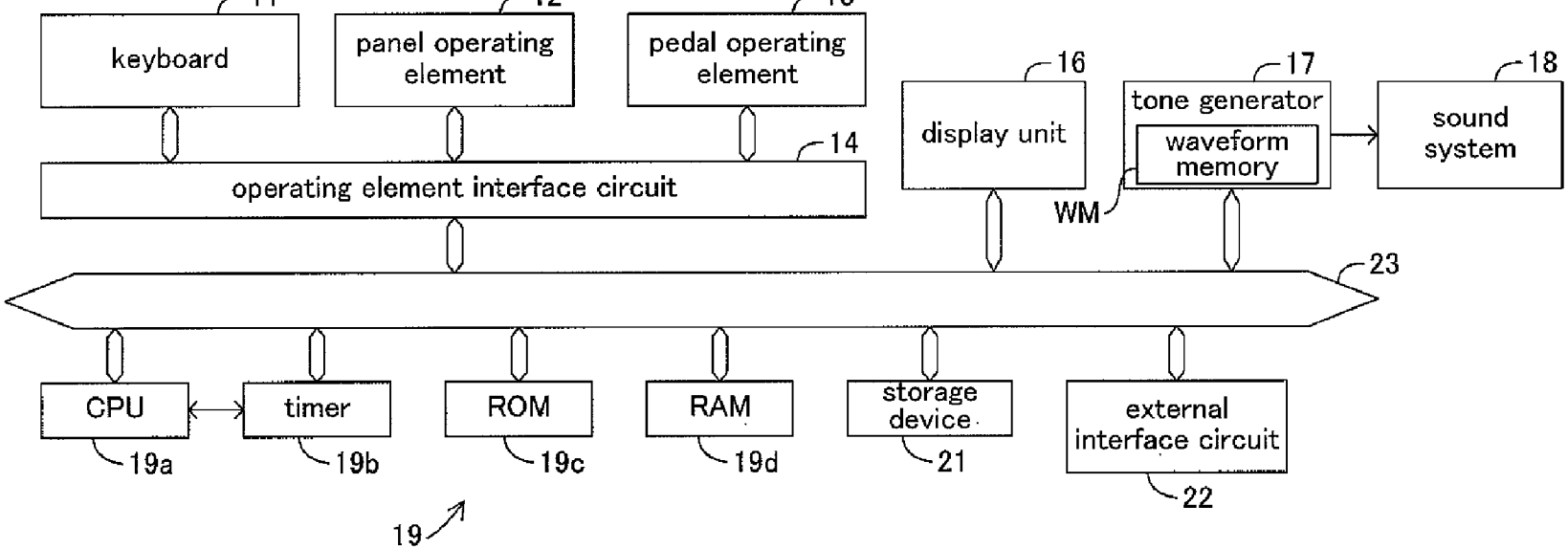
FIG. 1 is a general block diagram indicative of an electronic musical instrument to which a musical tone signal generating apparatus according to an embodiment of the present invention is applied.

An embodiment of the present invention will now be described with reference to the drawings. FIG. 1 is a general block diagram indicative of an electronic musical instrument to which a musical tone signal generating apparatus according to the embodiment of the present invention is applied. The electronic musical instrument has a keyboard 11, a panel operating element 12, a pedal operating element 13, an operating element interface circuit 14, a display unit 16, a tone generator 17, a sound system 18, a computer portion 19, a storage device 21 and an external interface circuit 22.

The keyboard 11, which is manipulated by a player with the player's hands, is formed of a plurality of white keys and a plurality of black keys each specifying a tone pitch of a musical tone signal to generate, and instructing generation of the musical tone signal and termination of the musical tone signal. The panel operating element 12 is formed of a plurality of operating elements provided on an operating panel of the electronic musical instrument. These operating elements, which are also manipulated by the player with the player's hands, and include operating elements for setting various musical tone properties such as tone color, tone volume and effect of musical tone signals to be generated, allow the player to specify how the entire electronic musical instrument works. These operating elements include on/off operating elements as well as various kinds of operating elements such as rotary operating elements and sliding operating elements. In addition, the panel operating element 12 includes various devices corresponding to the above-described operating elements such as switches corresponding to the on/off operating elements, volumes or rotary encoders corresponding to the rotary operating elements, and volumes or linear encoders corresponding to the sliding operating elements.

The pedal operating element 13, which is manipulated by the player with the player's foot, specifies various musical tone properties such as tone color, tone volume and effect of musical tone signals to be generated. The pedal operating element 13 includes on/off operating elements as well as sliding operating elements. In addition, the pedal operating element 13 includes movable elements corresponding to the above-described operating elements such as switches corresponding to the on/off operating elements, and volumes or linear encoders corresponding to the sliding operating elements.

The keyboard 11, the panel operating element 12 and the pedal operating element 13 are connected to the operating element interface circuit 14 connected to a bus 23. Thus, musical performance information indicative of a manipulation of the keyboard 11, the panel operating element 12 and the pedal operating element 13 is supplied to the later-described computer portion 19 through the operating element interface circuit 14 and the bus 23. The display unit 16 provided with a liquid crystal display (LCD) displays letters, graphics and the like on a display screen. What is displayed on the display unit 16 is controlled by the computer portion 19 via the bus 23.

The tone generator 17, which includes a waveform memory WM in which a plurality of waveform data sets are stored, reads out a waveform data set specified by a CPU 19*a* from the waveform memory WM, generates a digital musical tone signal, and then supplies the generated digital musical tone signal to the sound system 18. As described later, the tone generator 17 also includes an effector circuit for adding various kinds of effects to a digital musical tone signal such as a chorus effect and reverb effect. The sound system 18 has a D/A converter which converts digital musical tone signals supplied from the tone generator 17 into analog musical tone signals, amplifiers which amplify the converted analog musical tone signals, and speakers which convert the amplified analog musical tone signals into acoustical signals and output the acoustical signals.

The computer portion 19 is formed of the CPU 19*a*, a timer 19*b*, a ROM 19*c* and a RAM 19*d* which are connected to the bus 23, respectively. The CPU 19*a* supplies information necessary for generation of a musical tone to the tone generator 17 in accordance with musical performance information supplied from the operating element interface circuit 14 and the external interface circuit 22. Particularly, the CPU 19*a* carries out a tone generation reservation program in accordance with a note-on event generated by a player's key-depression on the keyboard 11 and a note-on event which configures musical performance information supplied from an external apparatus via the external interface circuit 22 or musical performance information stored in the storage device 21 to be reproduced. By the execution of the tone generation reservation program, the CPU 19*a* makes a reservation to the tone generator 17 for new generation of a musical tone. Without instructing to start generating the musical tone, more specifically, the CPU 19*a* only supplies parameters regarding the musical tone itself (hereafter, referred to as musical tone parameters) necessary for the new generation of the musical tone to the tone generator 17. The timing at which the tone-generation starts is controlled by the tone generator 17.

The storage device 21, which includes large-capacity non-volatile storage media such as HDD, FDD, CD-ROM, MO and DVD, and drive units for the respective storage media, is able to store and read out various kinds of data and programs. These data and programs may be previously stored in the storage device 21, or may be externally retrieved via the external interface circuit 22. The various kinds of data and programs stored in the storage device 21 are read by the CPU 19*a* to be used for control of the electronic musical instrument. The external interface circuit 22, which includes a MIDI interface circuit and a communications interface circuit, is allowed to connect to a different electronic musical apparatus and a MIDI-capable external apparatus such as a personal computer, also being able to connect to a communications network such as the Internet.

b. Configuration of Tone Generator

Figure 2:
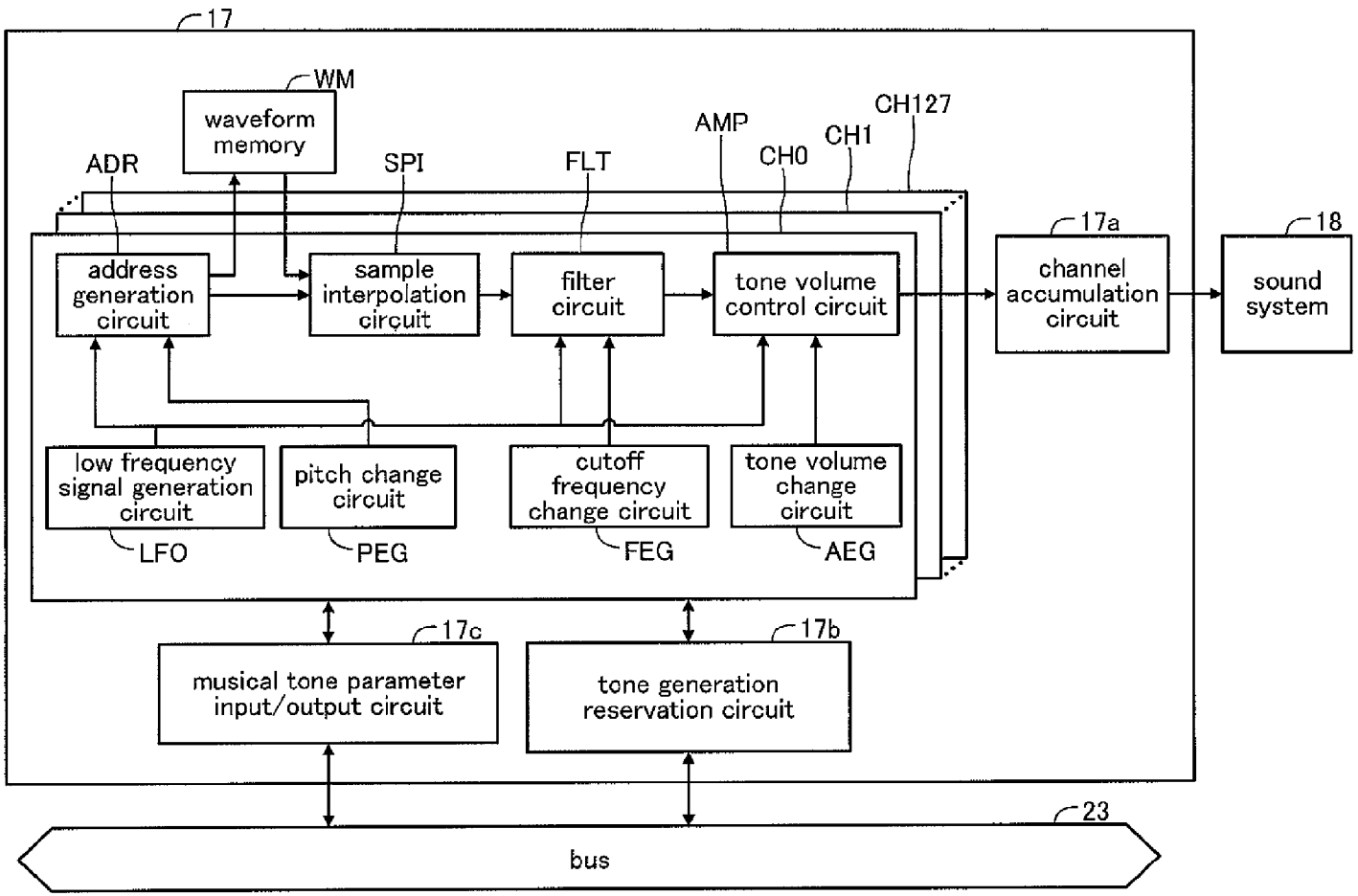
FIG. 2 is a block diagram indicative of a concrete configuration of a tone generator indicated in FIG. 1.

Next, the configuration of the tone generator 17 will be described in detail. First, the general configuration of the tone generator 17 will be explained. As indicated in FIG. 2, the tone generator 17 has the waveform memory WM in which waveform data sets are stored. The tone generator 17 also has a plurality (e.g., 128 channels) of tone generation channels CH0, CH1, . . . , CH127 for reading out waveform data from the waveform memory WM to generate digital musical tone signals. The tone generator 17 also has a channel accumulation circuit 17*a* which accumulates digital musical tone signals generated in the tone generation channels CH0, CH1, . . . , CH127 to output the accumulated digital musical tone signals to the sound system 18. In addition, the tone generator 17 also has a tone generation reservation circuit 17*b* which receives a reservation of a tone generation channel made by the CPU 19*a*, and instructs the reserved tone generation channel to start the generation of a musical tone. The tone generator 17 also has a musical tone parameter input/output circuit 17*c* which inputs musical tone parameters for the respective tone generation channels output from the CPU 19*a*, and outputs the input musical tone parameters to the tone generation channels CH0, CH1, . . . , CH127 at certain timings. Next, the waveform memory WM, the tone generation channels CH0, CH1, . . . , CH127, the channel accumulation circuit 17*a*, the tone generation reservation circuit 17*b*, and the musical tone parameter input/output circuit 17*c* will be described in detail.

b1. Waveform Memory

Figure 3:
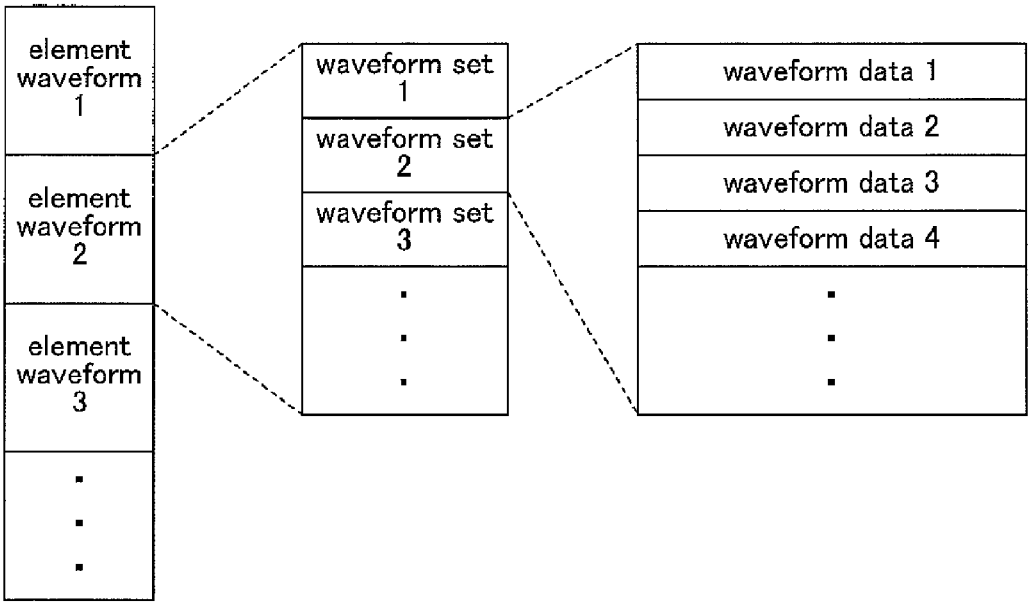
FIG. 3 is a memory map indicative of a configuration of waveform data.

As indicated in FIG. 3, the waveform memory WM stores a plurality of waveform data sets indicative of musical tone waveforms of various kinds of musical instruments. In some cases, musical tones of a musical instrument are separated into a plurality of components to be stored as separate musical tone waveforms. In a case of musical tones of a piano, for example, musical tones are separated into a component whose tone color sharply varies at the start of tone-generation and a component whose tone color hardly varies from the start to the end of tone-generation to be stored as separate musical tone waveforms. Musical tone waveforms obtained by separating a musical tone waveform into components are referred to as element waveforms. Digital musical tone signals generated on the basis of element waveforms read out by the tone generation channels, respectively, are referred to as element signals. The generated element signals are combined by the channel accumulation circuit 17*a* as a musical tone signal of a musical instrument. Depending on the type of musical instrument, a musical tone waveform may be stored as a single waveform, without separating the musical tone waveform into components. Strictly speaking, in this case, such a musical tone waveform is not an element waveform, for the musical tone waveform is not separated into components. However, the musical tone waveform of this case is also referred to as an element waveform, for it can be considered that a musical tone signal of a musical instrument is generated on the basis only of the element waveform.

An element waveform is formed of a plurality of waveform sets provided for respective ranges each having certain tone pitches (e.g., each octave). By performing interpolation in the respective tone generation channels CH0, CH1, . . . , CH127, a digital musical tone signal corresponding to the tone pitch of a depressed key is generated. A waveform set is formed of a plurality of waveform data sets provided for respective ranges each having certain strengths of key-depression (e.g., four levels of the strength of key-depression). By performing interpolation in the respective tone generation channels CH0, CH1, . . . , CH127, an element signal having a tone color and a tone volume corresponding to the strength of a key-depression is generated. The waveform sets may be provided for the keys, respectively. Furthermore, an element waveform may be formed only of a waveform set regardless of tone pitches. In some cases, a waveform set is formed only of a waveform data set regardless of strengths of a key-depression.

b2. Tone Generation Channels

The tone generation channels CH0, CH1, . . . , CH127, each of which has the same configuration, generate element signals, respectively, at each sampling cycle. Hereafter, the generation of an element signal at a tone generation channel will be simply referred to as tone-generation. Each of the tone generation channels CH0, CH1, . . . , CH127 has a low frequency signal generation circuit LFO, a pitch change circuit PEG, a cutoff frequency change circuit FEG and a tone volume change circuit AEG. Furthermore, each of the tone generation channels CH0, CH1, . . . , CH127 also has an address generation circuit ADR, a sample interpolation circuit SPI, a filter circuit FLT and a tone volume control circuit AMP.

The low frequency signal generation circuit LFO generates modulation signals which periodically vary tone pitch, tone color and tone volume after the start of tone-generation, and then supplies the generated modulation signals to the address generation circuit ADR, the filter circuit FLT and the tone volume control circuit AMP, respectively. To the low frequency signal generation circuit LFO, low frequency signal control parameters are supplied from the CPU 19*a* through the musical tone parameter input/output circuit 17*c*. The low frequency signal control parameters include data which specifies the waveform, frequency and amplitude of the modulation signals output from the low frequency signal generation circuit LFO.

The pitch change circuit PEG supplies tone pitch control signals which control the tone pitch of an element signal to the address generation circuit ADR. The pitch change circuit PEG generates tone pitch control signals which vary with the passage of time so that the tone pitch of an element signal can vary with the passage of time after the start of tone-generation, and then supplies the generated tone pitch control signals to the address generation circuit ADR. The sequence of tone pitch control signals that vary with the passage of time is referred to as a pitch envelope. The cutoff frequency change circuit FEG supplies cutoff frequency control signals which control the frequency response of an element signal to the filter circuit FLT. The cutoff frequency control circuit FEG generates cutoff frequency control signals that vary with the passage of time so that the cutoff frequency of a filter varies with the passage of time after the start of tone-generation, and then supplies the generated cutoff frequency control signals to the filter circuit FLT. The sequence of cutoff frequency control signals that vary with the passage of time is referred to as a cutoff envelope. The tone volume change circuit AEG supplies tone volume control signals which control the tone volume of an element signal to the tone volume control circuit AMP. The tone volume change circuit AEG generates tone volume control signals which vary with the passage of time so that the tone volume of an element signal varies with the passage of time after the start of tone-generation, and then supplies the generated tone volume control signals to the tone volume control circuit AMP. The sequence of tone volume control signals that vary with the passage of time is referred to as a tone volume envelope.

Figure 4:
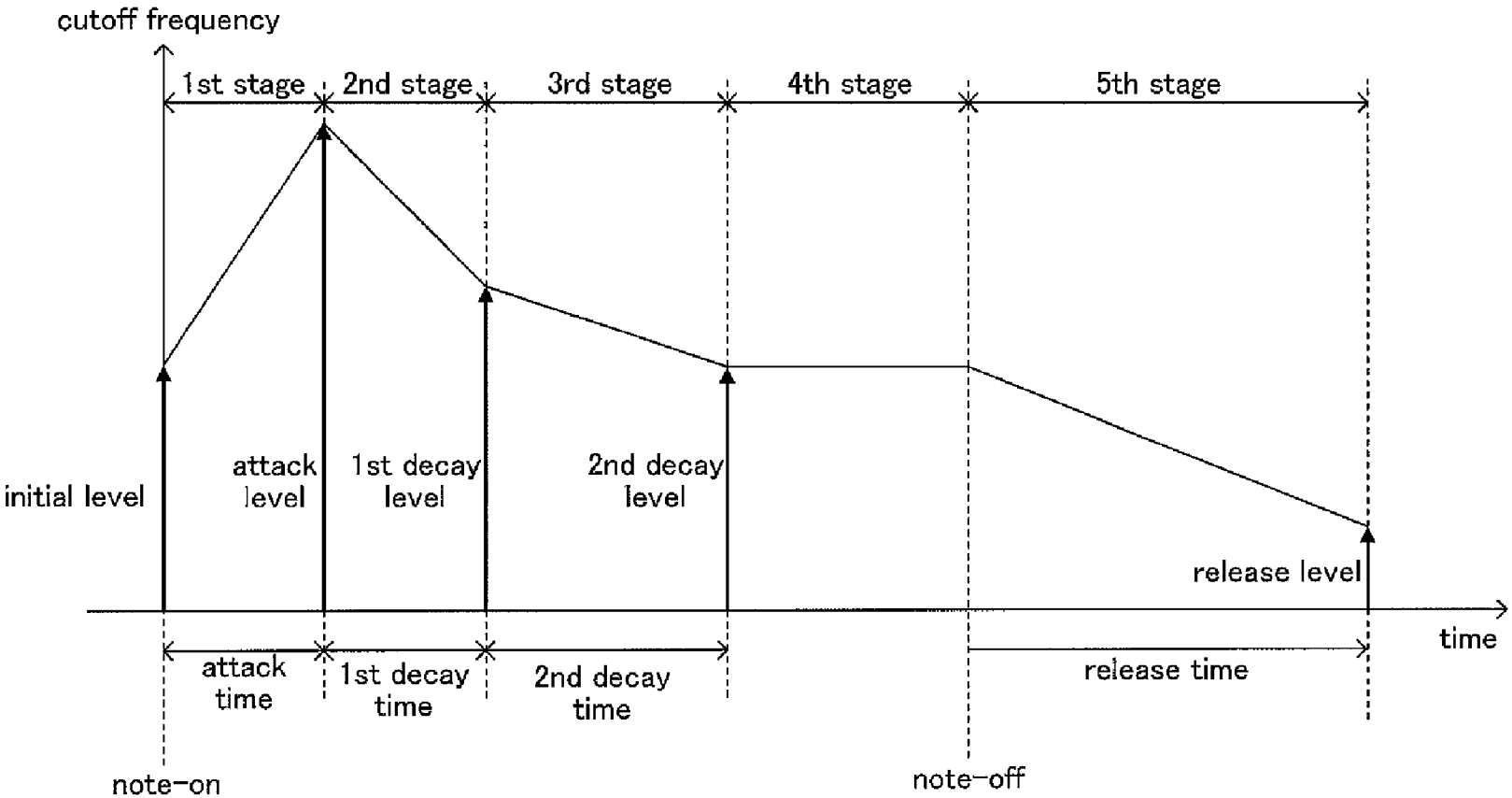
FIG. 4 is a diagram illustrating a configuration of a cutoff envelope.

For example, the cutoff envelope is formed of the first to fifth stages each having a different rate of change in the cutoff frequency control signals, as indicated in FIG. 4. To the cutoff frequency change circuit FEG, a cutoff envelope parameter is supplied from the CPU 19*a* through the musical tone parameter input/output circuit 17*c*. The cutoff envelope parameter is formed of an initial level representative of the cutoff frequency at the start of the tone-generation, target levels of the respective stages representative of the cutoff frequencies (the attack level, the first decay level, the second decay level and the release level) at the respective ends of the stages, and durations (the attack time, the first decay time, the second decay time and the release time) of the respective stages.

At the start of the tone-generation, only the initial level, the target level of the first stage and the duration of the first stage (i.e., the attack level and the attack time) are supplied to the cutoff frequency change circuit FEG, whereas the respective target levels and respective durations of the second stage and later (i.e., the first decay level, the second decay level, the release level, the first decay time, the second decay time and the release time) will be supplied after the completion of their respective preceding stages. In the fourth stage, however, the cutoff frequency is maintained at the second decay level until a note-off event is generated by a player's key-release on the keyboard 11 to make the CPU 19*a* supply the release level and the release time. By using the respective target levels and durations of the stages, the cutoff frequency change circuit FEG calculates respective rates of change in the cutoff frequency at the respective stages, varies the cutoff frequency control signals at the calculated rates of change at respective sampling cycles, and then supplies the varied cutoff frequency control signals to the filter circuit FLT.

The initial level and the target level of the last stage may be different from each other. The initial level and the target levels of the respective stages supplied from the CPU 19*a* may be represented either by absolute values or by a reference cutoff frequency which is commonly used in the respective stages and relative values with respect to the reference cutoff frequency. Although the above-described example has the cutoff frequency envelope having the five stages, the number of stages is not limited to that of the example. That is, the cutoff frequency envelope may have either a higher or lower number of stages.

To the pitch change circuit PEG and the tone volume change circuit AEG, as in the case of the cutoff frequency change circuit FEG, a pitch envelope parameter and a tone volume envelope parameter are supplied from the CPU 19*a*, respectively. Similarly to the cutoff envelope parameter, the pitch envelope parameter and the tone volume envelope parameter include the initial level, target levels and durations of the respective stages. More specifically, the pitch envelope and the tone volume envelope are formed of stages defined by the pitch envelope parameter and the tone volume envelope parameter, respectively, to generate tone pitch control signals and tone volume control signals which vary with the passage of time at respective sampling cycles to supply the generated signals to the address generation circuit ADR and the tone volume control circuit AMP, respectively.

The address generation circuit ADR combines a tone pitch value which indicates the tone pitch of a depressed key and is included in a musical tone parameter supplied from the CPU 19*a* through the musical tone parameter input/output circuit 17*c*, tone pitch control signals supplied from the pitch change circuit PEG and modulation signals supplied from the low frequency signal generation circuit LFO to calculate the amount of pitch shift. For this calculation, waveform data information is supplied to the address generation circuit ADR from the CPU 19*a* through the musical tone parameter input/output circuit 17*c*. The waveform data information is formed of a top address and an end address of waveform data which will be read out from the waveform memory WM, and an original pitch indicative of the tone pitch of the waveform data. The difference between the original pitch and the pitch of a musical tone which is to be generated is the amount of pitch shift. According to the amount of pitch shift, the address generation circuit ADR then determines the rate at which the waveform data is to be read out. The address generation circuit ADR then reads out the waveform data from the waveform memory WM at the determined reading rate. Because a reading rate determined according to the amount of pitch shift usually includes a decimal fraction, addresses by which waveform data is read out are formed of an integer and a decimal fraction. For the reading of the waveform data, therefore, integers are used to read out a pair of neighboring sample values of the waveform data. The read sample values are supplied to the sample interpolation circuit SPI. The sample interpolation circuit SPI performs interpolation by use of the supplied pair of sample values and the decimal fraction of the addresses to generate digital musical tone data. The sample interpolation circuit SPI then supplies the generated digital musical tone data to the filter circuit FLT.

The filter circuit FLT combines the cutoff frequency control signals supplied from the cutoff frequency change circuit FEG and the modulation signals supplied from the low frequency signal generation circuit LFO to calculate the cutoff frequency of a filter. To the filter circuit FLT, a filter control parameter is also supplied from the CPU 19*a* through the musical tone parameter input/output circuit 17*c*. The filter control parameter includes filter selection information for selecting the type of filter (e.g., high-pass filter, low-pass filter, etc.). The filter circuit FLT sets the cutoff frequency for the filter selected according to the filter selection information at the calculated cutoff frequency to filter the waveform data supplied from the sample interpolation circuit SPI by the selected filter. The filter circuit FLT then outputs the filtered waveform data to the tone volume control circuit AMP.

The tone volume control circuit AMP combines the tone volume control signals supplied form the tone volume change circuit AEG and the modulation signals supplied from the low frequency signal generation circuit LEO to calculate the tone volume at which a musical tone signal is to be generated. The tone volume control circuit AMP then decays or amplifies the waveform data supplied from the filter circuit FLT in accordance with the calculated tone volume to output the decayed or amplified waveform data to the channel accumulation circuit 17*a*.

In this embodiment, the tone generator 17 has 128 tone generation channels CH0, CH1, . . . , CH127. However, the tone generator 17 may have a single tone generation channel so that the tone generation channel will be time-shared. If a sampling cycle is divided into 128 intervals, for example, the processing done at the respective divided intervals corresponds to that done by the respective tone generation channels CH0, CH1, . . . , CH127 of this embodiment.

b3. Channel Accumulation Circuit 17*a*

At each sampling cycle, the channel accumulation circuit 17*a* accumulates musical tone signals output from the tone generation channels CH0, CH1, . . . , CH127 to output the accumulated musical tone signals to the sound system 18. The channel accumulation circuit 17*a* has an effect process circuit for adding common effects (e.g., chorus, reverb, etc.) to musical tone signals output from the respective tone generation channels.

b4. Tone Generation Reservation Circuit 17*b*

Next, the tone generation reservation circuit 17*b* will be explained. The tone generation reservation circuit 17*b* generates information on a musical tone which is to be generated in a tone generation channel specified by the CPU 19*a* and stores the generated information, also instructing the tone generation channel to start generating the musical tone at certain timing.

Figure 5:
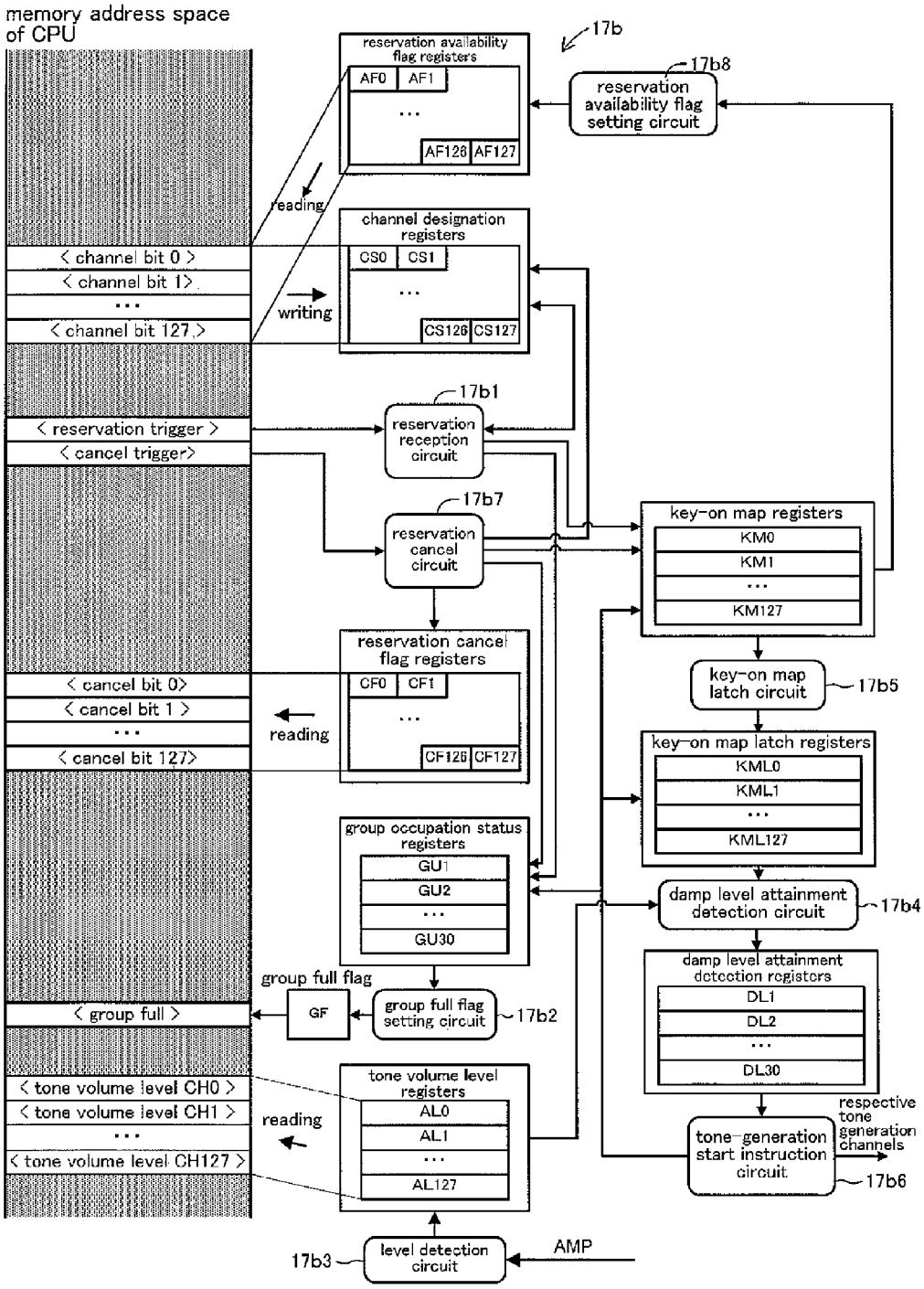
FIG. 5 is a block diagram indicative of a concrete configuration of a tone generation reservation circuit indicated in FIG. 2.

As indicated in FIG. 5, the tone generation reservation circuit 17*b* has channel designation registers CS0, CS1, . . . , CS127 and a reservation reception circuit 17*b*1. The channel designation registers CS0, CS1, CS127 are a bitmap formed of 128 bits corresponding to the tone generation channels CH0, CH1, . . . , CH127, respectively. Using the bitmap to designate a tone generation channel, the CPU 19*a* instructs the tone generator 17 to carry out various processing including a later-described cancellation of a reservation of a tone generation channel. For generation of a musical tone waveform divided into a plurality of element waveforms, for example, the CPU 19*a* indicates, to the tone generation reservation circuit 17*b*, a plurality of tone generation channels which are to be used for the generation of element signals. More specifically, the CPU 19*a* selects bits from among the channel designation registers CS0, CS1, . . . , CS127 as those tone generation channels which are to be used for the generation of the element signals. The CPU 19*a* then sets the bits, which are the same number as the number of the element signals that form the musical tone waveform, at "reserved". The CPU 19*a* then outputs a reservation trigger signal to the reservation reception circuit 17*b*1 so that the reservation reception circuit 17*b*1 can assign a common group number to the indicated tone generation channels.

The channel designation registers CS0, CS1, . . . , CS127 are assigned to addresses represented by "channel bit 0" to "channel bit 127", respectively, in a memory address space of the CPU 19*a*, whereas the CPU 19*a* uses "channel bit 0" to "channel bit 127" to manipulate the bits of the channel designation registers CS0, CS1, . . . , CS127 (to designate a tone generation channel to reserve). A reservation trigger register which is not shown but is provided in the reservation reception circuit 17*b*1 is assigned to an address represented by "reservation trigger" in the memory address space of the CPU 19*a* so that the CPU 19*a* can use "reservation trigger" to output the reservation trigger signal to the reservation reception circuit 17*b*1.

The reservation reception circuit 17*b*1 assigns a common group number to a plurality of tone generation channels specified by use of the channel designation registers CS0, CS1, . . . , CS127. In a case such as the above-described example where a musical tone waveform is divided into a plurality of element waveforms (i.e., in a case where a plurality of tone generation channels are to be used concurrently), the plurality of tone generation channels are assigned a common group number so that the tone generation channels which are to start tone-generation concurrently can be managed by use of the group number. In a case where a musical tone waveform is formed of a single element waveform, a plurality of tone generation channels will not be grouped. For a simple and common circuit configuration, however, a group consisting only of a single tone generation channel is formed to be assigned a group number, as in the case where a plurality of element signals are to be combined. However, there is an upper limit of the number of groups. In this embodiment, more specifically, 30 groups are allowed to be used. In this embodiment, therefore, there are provided group occupation status registers GU1 to GU30 each storing a group occupation flag indicative of whether a corresponding group number is available or occupied. The reservation reception circuit 17*b*1 assigns an "available" group number selected from among the group occupation status registers GU1 to GU30 to the tone generation channels, and then sets the group occupation status register corresponding to the assigned group number at "occupied". The group occupation flag which has been set at "occupied" will be set at "available" by a later-described tone-generation start instruction circuit 17*b*6 at the time of start of tone-generation. The CPU 19*a* always confirms that tone generation channels which are to be reserved are able to be assigned a group number by use of a group full flag GF before outputting a reservation trigger signal. Therefore, the reservation reception circuit 17b1 to which the reservation trigger signal has been input can assign a group number to the tone generation channels without fail.

The group full flag GF is a flag indicative of whether there is a vacant group or not (i.e., whether a group number can be assigned to the tone generation channels). The group full flag GF is set at either "vacant group" or "no vacant group" by a group full flag setting circuit 17b2. More specifically, the group full flag setting circuit 17b2 sets the group full flag at "vacant group" when at least one of the group occupation status registers GU1 to GU30 is set at "available". When all of the group occupation status registers GU1 to GU30 are set at "occupied", the group full flag setting circuit 17b2 sets the group full flag GF at "no vacant group". The group full flag GF is assigned to an address represented by "group full" in the memory address space of the CPU 19a so that the CPU 19a will use "group full" to read the value of the group full flag GF.

The reservation reception circuit 17b1 writes the obtained group number into a key-on map. The key-on map is formed of key-on map registers KM0 to KM127 corresponding to the tone generation channels CH0 to CH127, respectively. Each of the key-on map registers KM0 to KM127 represents any of the group numbers "1" to "30" or "no group assignment". The key-on map is updated at each generation of a note-on event. When a note-on event is generated, more specifically, one or more tone generation channel is/are selected by the CPU 19a. Then, the reservation reception circuit 17b1 writes a common group number into the key-on map register(s) corresponding to the selected tone generation channel(s). The reservation reception circuit 17b1 then sets the channel designation registers set at "reserved" at "no designation".

A level detection circuit 17b3 detects respective tone volume levels of element signals output from the respective tone volume control circuits AMP of the tone generation channels CH0, CH1, . . . , CH127, and records the detected tone volume levels in tone volume level registers AL0, AL1, . . . , AL127. The respective tone volume levels recorded in the tone volume level registers AL0, AL1, . . . , AL127 are supplied to a damp level attainment detection circuit 17b4. The tone volume level registers AL0, AL1, . . . , AL127 are assigned to addresses represented by "tone volume level 0" to "tone volume level 127" in the memory address space of the CPU 19a so that the CPU 19a will use "tone volume level 0" to "tone volume level 127" to read respective values of the tone volume level registers AL0, AL1, . . . , AL127.

The detection of respective tone volume levels of the element signals of the tone generation channels CH0 to CH127 and the supply of the detected results to the damp level attainment detection circuit 17b4 by the level detection circuit 17b3 are done by time-sharing in a sampling cycle. Immediately before the start of the sequence of level detection of musical tone data of the tone generation channels CH0 to CH127 by the level detection circuit 17b3, the contents of the key-on map are copied by a key-on map latch circuit 17b5 as a key-on map latch to key-on map latch registers KML0, KML1, . . . , KML127 which are similar to the key-on map registers KM0 to KM127 to be latched. In accordance with the key-on map latch, the damp level attainment detection circuit 17b4 determines whether the tone volume levels of the element signals generated in all the tone generation channels belonging to each group are equal to or below a damp level.

The damp level attainment detection circuit 17b4 sequentially writes the determination results into damp level attainment detection registers DL1, DL2, . . . , DL30. The damp level attainment detection registers DL1, DL2, . . . , DL30, which correspond to the respective groups, store data indicative of either "damp level attained" or "damp level not attained". Before the start of the sequence of detection of the respective tone volume levels of the element signals of the tone generation channels CH0 to CH127 by the level detection circuit 17b3, the damp level attainment detection circuit 17b4 sets the damp level attainment detection registers DL1, DL2, . . . , DL30 at "damp level attained". The damp level attainment detection circuit 17b4 then compares the damp level with the respective tone volume levels of the element signals supplied from the level detection circuit 17b3.

For example, in a case where the tone volume level of an element signal of the tone generation channel CHn (n=0, 1, . . . , 127) is higher than the damp level, the damp level attainment detection circuit 17b4 obtains a group number m (m=1, 2, . . . , 30) stored in the key-on map latch register KMLn corresponding to the tone generation channel CHn, also setting the damp level attainment detection register DLm corresponding to the group number m at "damp level not attained". If the damp level attainment detection register DLm has been already set at "damp level not attained", the damp level attainment detection circuit 17b4 performs a determination on the next tone generation channel, without manipulating the damp level attainment detection register DLm. If the tone volume level of the tone generation channel CHn is equal to or lower than the damp level, the damp level attainment detection circuit 17b4 will not manipulate the damp level attainment detection register DLm. In both cases where the tone volume level of the element signal of the tone generation channel CHn (n=0, 1, . . . , 127) is higher than the damp level and where the tone volume level of the tone generation channel CHn is equal to or lower than the damp level, if the value of the obtained key-on map register is set at "no group assignment", the damp level attainment detection circuit 17b4 performs a determination on the next tone generation channel, without manipulating the damp level attainment detection register DLm.

When the damp level attainment detection register DLm is set at "damp level not attained" after the above-described determination has been done for all the tone generation channels, it is considered that the tone volume level of the element signal of one or more of the tone generation channels belonging to the group m is higher than the damp level. When the damp level attainment detection register DLm is set at "damp level attained", on the other hand, it is considered that the tone volume levels of the respective element signals of all the tone generation channels belonging to the group m are equal to or lower than the damp level.

Next, the reason why the determination on the damp level attainment is done on the basis not of the key-on map but of the key-on map latch will be provided. As described above, even during the determinations of the respective tone volume levels of the element signals of the tone generation channels CH0, CH1, . . . , CH127 by the damp level attainment detection circuit 17b4, the key-on map registers KM0 to KM127 keep being updated.

For example, assume that the tone generation channel CH0 is being currently generating a musical tone which has not attained the damp level yet with no group number being stored in the key-on map register KM0 (i.e., the tone generation channel CH0 is not reserved). Furthermore, assume that the tone generation channel CH5 is not currently used for tone-generation (i.e., the tone generation channel CH5 is a vacant channel). In addition, assume that after the respective determinations on the tone generation channel CH0 by the level detection circuit 17b3 and the damp level attainment detection circuit 17b4 and before the respective determinations on the tone generation channel CH5, a new note-on event is generated, whereas the tone generation channel CH0 and the tone generation channel CH5 are designated as the tone generation channels which are to be used for the new tone-generation, with the group number "3" being stored in the key-on map registers KM0 and KM5. By the following determinations on the tone generation channel CH5 by the level detection circuit 17*b*3 and the damp level attainment detection circuit 17*b*4, the tone generation channel CH5 which is a vacant channel is determined that the tone volume level of the tone generation channel CH5 has attained the damp level. As a result, the later-described tone-generation start instruction circuit 17*b*6 instructs the tone generation channel CH0 and the tone generation channel CH5 to start tone-generation, even though the musical tone signal which is currently being generated in the tone generation channel CH0 belonging to the group number "3" has not attained the damp level. Therefore, the musical tone which is being currently generated in the tone generation channel CH0 sounds unnaturally as if the musical tone were suddenly discontinued. In order to avoid generation of such unnatural musical tones, it is necessary to fix the respective groups to which the tone generation channels belong during the sequence of determinations on the tone generation channels CH0 to CH127 by the level detection circuit 17*b*3 and the damp level attainment detection circuit 17*b*4. In this embodiment, therefore, the contents of the key-on map are copied to the key-on map latch so that the determinations on the attainment of the damp level can be made on the basis of the key-on map latch.

If the damp level attainment detection register DLm (m=1, 2, . . . , 30) is set at "damp level attained", the tone-generation start instruction circuit 17*b*6 instructs all the tone generation channels belonging to the group m to start tone-generation. The tone-generation start instruction circuit 17*b*6 then sets the key-on map registers and the key-on map latch registers corresponding to all the tone generation channels belonging to the group m at "no group assignment". Furthermore, the tone-generation start instruction circuit 17*b*6 sets the group occupation status register GUm at "available". Immediately before instructing to start tone-generation, in addition, the tone-generation start instruction circuit 17*b*6 instructs an initial parameter output circuit 17*c*2, a normal parameter transfer circuit 17*c*3 and a normal parameter output circuit 17*c*4 which will be described later to output and transfer parameters.

There are cases in which a new musical tone which is to be newly generated (such as a musical tone for melody) has to be generated before generation of a musical tone which is to be generated in a reserved tone generation channel (such as a musical tone for accompaniment). In such cases, this embodiment is designed such that the reservation of the tone generation channel can be forcefully canceled so that the tone generation channel will be reserved for the new musical tone. More specifically, the tone generation reservation circuit 17*b* has a reservation cancel circuit 17*b*7 for canceling a reservation of a tone generation channel. In a case where a reservation of the tone generation channel CHn (n=0, 1, . . . , 127) is desired to cancel, the CPU 19*a* sets the channel designation register CSn corresponding to the tone generation channel CHn at "cancel", and then outputs a cancel trigger signal to the reservation cancel circuit 17*b*7. The channel designation registers CS0 to CS127, which are used for the above-described reservation of the tone generation channels, are set at "no designation" at the completion of the reservation. Therefore, the channel designation registers CS0 to CS127 are also used for cancelling a reservation of a tone generation channel. A cancel trigger register which is not shown but is provided in the reservation cancel circuit 17*b*7 is assigned to an address represented by "cancel trigger" provided in the memory address space of the CPU 19*a* so that the CPU 19*a* can use "cancel trigger" to output a cancel trigger signal to the reservation cancel circuit 17*b*7. Even in a case where a plurality of tone generation channels are reserved, the respective reservations of the tone generation channels will not be concurrently canceled but will be canceled one by one.

The reservation cancel circuit 17*b*7 to which the cancel trigger signal has been input sets the key-on map register KMn corresponding to the tone generation channel CHn (n=0, 1, . . . , 127) designated by the channel designation register CSn at "no group assignment". As a result, the reservation of the tone generation channel CHn is canceled. However, there can be a case in which the reservation has been executed to start generation of an element signal in the tone generation channel CHn before the reservation cancel circuit 17*b*7 sets the key-on map register KMn at "no group assignment" by the output of the cancel trigger signal by the CPU 19*a* to the reservation cancel circuit 17*b*7. In other words, there can be a case where before the reservation cancel circuit 17*b*7 sets the key-on map register KMn at "no group assignment", the key-on map register KMn has been already set at "no group assignment" by the tone-generation start instruction circuit 17*b*6. Therefore, this embodiment is provided with reservation cancel flag registers CF0, CF1, . . . , CF127 each storing a reservation cancel flag indicative of whether the reservation of a corresponding tone generation channel has been canceled. When the reservation of the tone generation channel CHn is canceled, the reservation cancel circuit 17*b*7 sets the reservation cancel flag register CFn at "cancel". When the reservation has been carried out to generate a musical tone, the reservation cancel circuit 17*b*7 sets the reservation cancel flag register CFn at "tone-generated". By reading the flag of the reservation cancel flag register CFn after the output of the cancel trigger signal, the CPU 19*a* determines whether the reservation of the tone generation channel CHn has been canceled or not.

The reservation cancel flag registers CF0, CF1, . . . , CF127 are assigned to addresses represented by "cancel bit 0" to "cancel bit 127" in the memory address space of the CPU 19*a* so that the CPU 19*a* can use "cancel bit 0" to "cancel bit 127" to read respective values of the flags of the reservation cancel flag registers CF0, CF1, . . . , CF127.

The tone generation reservation circuit 17*b* also has reservation availability flag registers AF0, AF1, . . . , AF127 each storing a reservation availability flag indicative of whether a corresponding tone generation channel is allowed to be reserved or not. Similarly to the channel designation registers CS0, CS1, . . . , CS127, the reservation availability flag registers AF0, AF1, . . . , AF127 are a bitmap formed of 128 bits corresponding to the tone generation channels CH0, CH1, . . . , CH127. The respective reservation availability flag registers AF0, AF1, . . . , AF127 are designed such that each bit is set at either "reservation available" or "reservation unavailable" by a reservation availability flag setting circuit 17*b*8. In a case where any of the group numbers "1" to "30" has been written into the key-on map register KMn corresponding to the tone generation channel CHn (n=0, 1, . . . , 127), the reservation availability flag setting circuit 17*b*8 sets the reservation availability flag register AFn corresponding to the tone generation channel CHn at "reservation unavailable". Before switching the reservation availability flag register AFn to "reservation available", the reservation availability flag setting circuit 17*b*8 keeps the reservation availability flag register AFn at "reservation unavailable" for a certain period (e.g., five sampling cycles) after the setting of the key-on map register KMn at "no group assignment". The certain period is necessary because the tone generator 17 is currently processing for starting tone-generation so that any new reservation of a tone generation channel cannot be accepted during the certain period.

The respective reservation availability flag registers AF0, AF1, . . . , AF127 are assigned to the addresses represented by "channel bit 0" to "channel bit 127", respectively, of the memory address space of the CPU 19*a*. By designating any of "channel bit 0" to "channel bit 127" to read the designated channel bit, the CPU 19*a* can read the value stored in the corresponding register of the reservation availability flag registers AF0, AF1, . . . , AF127. Although the channel designation registers CS0, CS1, . . . , CS127 and the reservation availability flag registers AF0, AF1, . . . , AF127 are assigned to the same addresses, respectively, as described above, this embodiment is designed such that the channel designation registers CS0, CS1, . . . , CS127 are used at the time of writing by the CPU 19*a* whereas the reservation availability flag registers AF0, AF1, . . . , AF127 are used at the time of reading by the CPU 19*a*.

b5. Musical Tone Parameter Input/Output Circuit 17*c*

Figure 6:
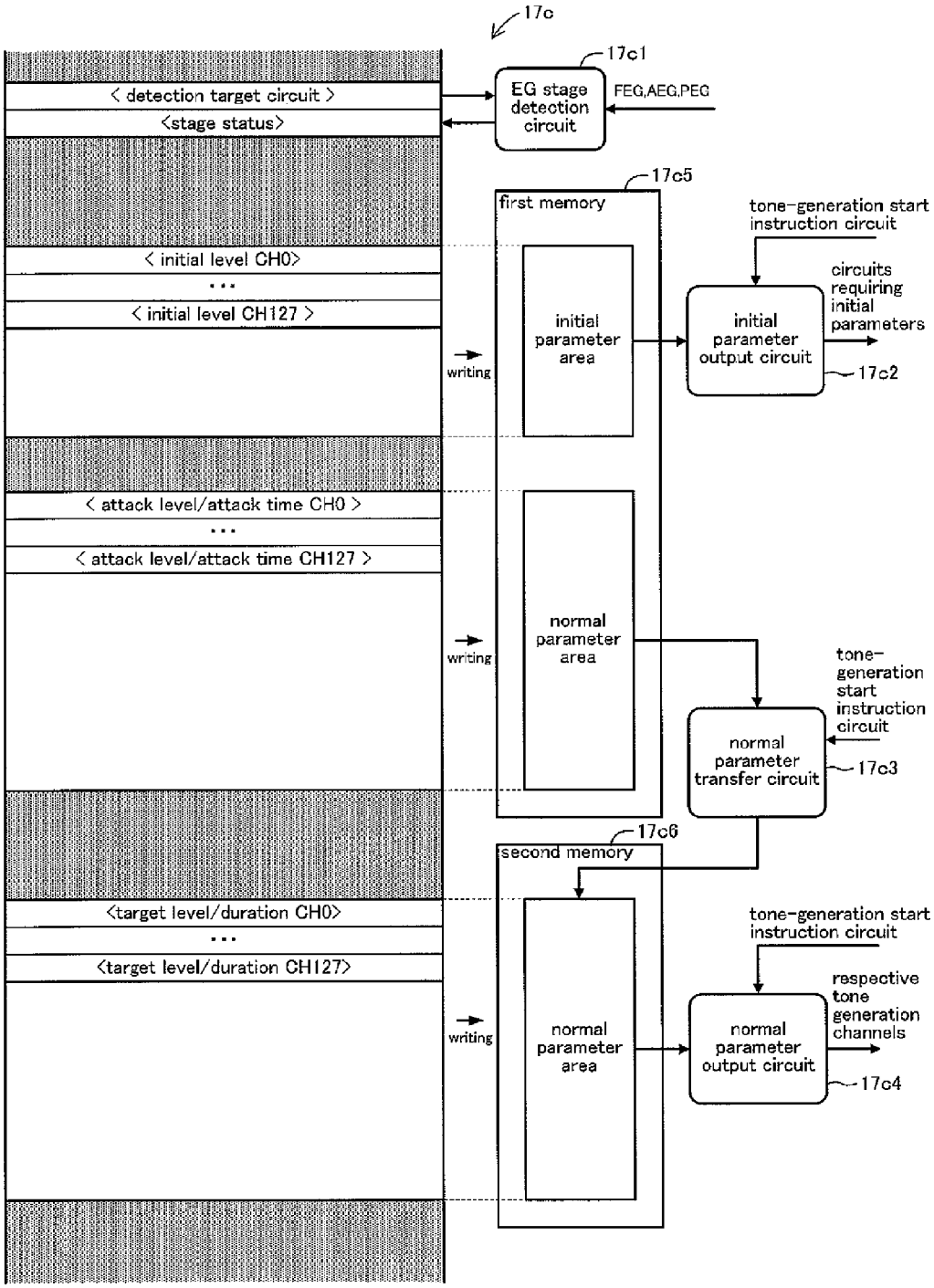
FIG. 6 is a block diagram indicative of a concrete configuration of a musical tone parameter input/output circuit indicated in FIG. 2.

Next, the musical tone parameter input/output circuit 17*c* will be explained. The musical tone parameter input/output circuit 17*c* inputs musical tone parameters supplied from the CPU 19*a* through the bus 16, and outputs the musical tone parameters to respective circuits of the tone generation channels CH0, CH1, . . . , CH127. The musical tone parameter input/output circuit 17*c* also inputs parameters indicative of respective states of the circuits (the pitch change circuit PEG, the cutoff frequency change circuit FEG and the tone volume change circuit AEG, etc.) of the tone generator 17, and outputs the parameters to the CPU 19*a*. As indicated in FIG. 6, the musical tone parameter input/output circuit 17*c* has an EG stage detection circuit 17*c*1, an initial parameter output circuit 17*c*2, a normal parameter transfer circuit 17*c*3, a normal parameter output circuit 17*c*4, a first memory 17*c*5 and a second memory 17*c*6.

The EG stage detection circuit 17*c*1 detects whether the respective levels of control signals generated in the pitch change circuit PEG, the cutoff frequency change circuit FEG and the tone volume change circuit AEG have attained respective target levels of the current stage or not. The EG stage detection circuit 17*c*1 is provided with a detection target designation register DD which is not shown and is provided in order to designate, at a time, one of the circuits, namely the pitch change circuit PEG, the cutoff frequency change circuit FEG and the tone volume change circuit AEG. The EG stage detection circuit 17*c*1 is also provided with a stage completion flag register SF which stores the detected result. When the CPU 19*a* writes data which designates a target circuit into the detection target designation register DD, the EG stage detection circuit 17*c*1 compares the current level of a control signal of the designated circuit with the target level of the current stage, and then sets the stage completion flag register SF at "stage completed" or "stage under processing" in accordance with the comparison result. More specifically, if the current level of the control signal has attained the target level, the stage completion flag register SF is to be set at "stage completed". If the current level of the control signal has not attained the target level, the stage completion flag register SF is to be set at "stage under processing".

The detection target designation register DD is assigned to an address represented by "detection target circuit" in the memory address space of the CPU 19*a* so that the CPU 19*a* can use "detection target circuit" to designate an envelope circuit which is to be detected. The stage completion flag register SF is assigned to an address represented by "stage status" in the memory address space of the CPU 19*a* so that the CPU 19*a* can use "stage status" to read the value of the stage completion flag register SF.

The first memory 17*c*5 is a memory for storing parameters which are to be supplied to the tone generation channels at the time of reservation of the tone generation channels until the start of tone-generation in the tone generation channels. The first memory 17*c*5 is divided into two areas: an initial parameter area for storing initial parameters for use in initial settings of the tone generation channels at the time of the start of tone-generation, and a normal parameter area for storing normal parameters used for varying element signals generated in the tone generation channels after the start of the tone-generation. For example, the initial level of a cutoff envelope generated by the cutoff frequency change circuit FEG is included in the initial parameters. Furthermore, the initial parameter area of the first memory 17*c*5 is divided into areas corresponding to the respective tone generation channels, each area corresponding to a tone generation channel further being divided into areas corresponding to respective initial parameters, namely a pitch envelope parameter, cutoff envelope parameter and a tone volume envelope parameter. More specifically, the respective storage areas of the initial parameters are assigned to certain addresses of the memory address space of the CPU 19*a*. For example, the respective storage areas of the initial levels which are to be supplied to the respective cutoff frequency change circuits FEG of the tone generation channels are assigned to addresses represented by "initial level CH0" to "initial level CH127" in the memory address space of the CPU 19*a* so that the CPU 19*a* can use "initial level CH0" to "initial level CH127" to store, in the first memory 17*c*5, the initial levels of the cutoff frequency which are to be supplied to the tone generation channels that are to be reserved.

As for the cutoff envelope generated by the cutoff frequency change circuit FEG, for example, the normal parameters include the attack level, the attack time, the first decay level, the first decay time and the like which are to be supplied to the tone generation channel at the time of the start of tone-generation or after the start of tone-generation. Among the normal parameters, those which are to be written into the first memory 17*c*5 are the attack level and the attack time which are the values of the first stage. Similarly to the initial parameter area, the normal parameter area of the first memory 17*c*5 is also divided into areas corresponding to the respective tone generation channels, each area corresponding to a tone generation channel further being divided into areas corresponding to respective normal parameters, namely a pitch envelope parameter, a cutoff envelope parameter and a tone volume envelope parameter. More specifically, the respective storage areas of the normal parameters are assigned to certain addresses of the memory address space of the CPU 19*a*. For example, the storage areas for storing the attack levels and attack times which are the target levels and durations of the first stage of the cutoff frequency envelopes, and are to be supplied to the respective cutoff frequency change circuits FEG are assigned to addresses represented by "attack level/attack time CH0" to "attack level/attack time CH127" in the memory address space of the CPU 19*a* so that the CPU 19*a* can use "attack level/attack time CH0" to "attack level/attack time CH127" to store, in the first memory 17*c*5, the attack levels and attack times of the cutoff frequency envelopes which are to be supplied to the tone generation channels that are to be reserved.

In response to the instruction to start tone-generation made by the tone-generation start instruction circuit 17*b*6, the initial parameter output circuit 17c2 reads out the respective initial parameters stored in the first memory 17c5, and then outputs the read initial parameters to the pitch change circuits PEG, the cutoff frequency change circuits FEG, the tone volume change circuits AEG or the like of the tone generation channels which are to start tone-generation.

In response to the instruction to start tone-generation made by the tone-generation start instruction circuit 17b6, in addition, the normal parameter transfer circuit 17c3 transfers the normal parameters written into the normal parameter area of the first memory 17c5 to the second memory 17c6. The second memory 17c6 is the memory for storing parameters on element signals which are currently being generated in the tone generation channels. The second memory 17c6 is formed only of a normal parameter area in which normal parameters are stored. The normal parameter area of the second memory 17c6 is configured similarly to that of the first memory 17c5. More specifically, the normal parameter area of the second memory 17c6 is also divided into areas corresponding to the respective normal parameters as in the case of the normal parameter area of the first memory 17c5. The storage areas of the respective normal parameters are assigned to certain addresses of the memory address space of the CPU 19a.

For example, the storage areas for storing the target levels and durations of the respective stages of the cutoff frequency envelopes which are to be supplied to the cutoff frequency change circuits FEG of the respective tone generation channels are assigned to addresses represented by "target level/duration CH0" to "target level/duration CH127" in the memory address space of the CPU 19a. In a case where the reserved tone generation channel CHn (n=0, 1, . . . , 127) starts tone-generation, the parameter transfer circuit uses "attack level/attack time CHn" to read out the attack time and attack time from the first memory 17c5, and also uses "target level/duration CHn" to write the read attack level and attack time into the normal parameter area of the second memory 17c6. As a result, the attack level and attack time are transferred from the first memory 17c5 to the second memory 17c6. Similarly to the above-described parameters of the cutoff frequency change circuit FEG, the normal parameters written into the first memory 17c5 for generation of envelopes by the pitch change circuit PEG and the tone volume change circuit AEG are also transferred to the second memory 17c6.

Furthermore, the CPU 19a is able to write the normal parameters directly to the second memory 17c6. For example, by carrying out a periodic process program for updating parameters which will be described in detail later, the CPU 19a writes target levels and durations of the second stage and later stages of the cutoff frequency envelope into the second memory 17c6. In this case, the CPU 19a uses a target tone generation channel's address included in the addresses represented by "target level/duration CH0" to "target level/duration CH127" to write target levels and durations of the envelope into the appropriate area of the second memory 17c6. In addition, the CPU 19a is also able to write target levels and durations of the second stage and later stages for generation of respective envelopes by the pitch change circuit PEG and the tone volume change circuit AEG into the second memory 17c6 as in the above-described case of the parameters of the cutoff frequency change circuit FEG.

In response to the instruction to start tone-generation made by the tone-generation start instruction circuit 17b6, the normal parameter output circuit 17c4 outputs the normal parameters written into the second memory 17c6 to the respective appropriate portions of the tone generation channels. The normal parameters written into the second memory 17c6 are output in a time-division manner in which a sampling cycle is divided into 128 divisions. That is, respective time periods obtained by dividing a sampling period into 128 divisions correspond to the tone generation channels CH0 to CH127, so that the normal parameters are sequentially output to the respective tone generation channels.

The first memory 17c5 and the second memory 17c6 may be configured by one memory. More specifically, the storage area of a memory having a large-capacity may be divided so that the memory will have an area corresponding to the first memory 17c5 and the other area corresponding to the second memory 17c6. Alternatively, the storage area for the initial parameter area and the storage area for the normal parameter area provided in the first memory 17c5 may be provided in different memories, respectively.

c. Configuration of the Computer Portion 19

Figure 7:
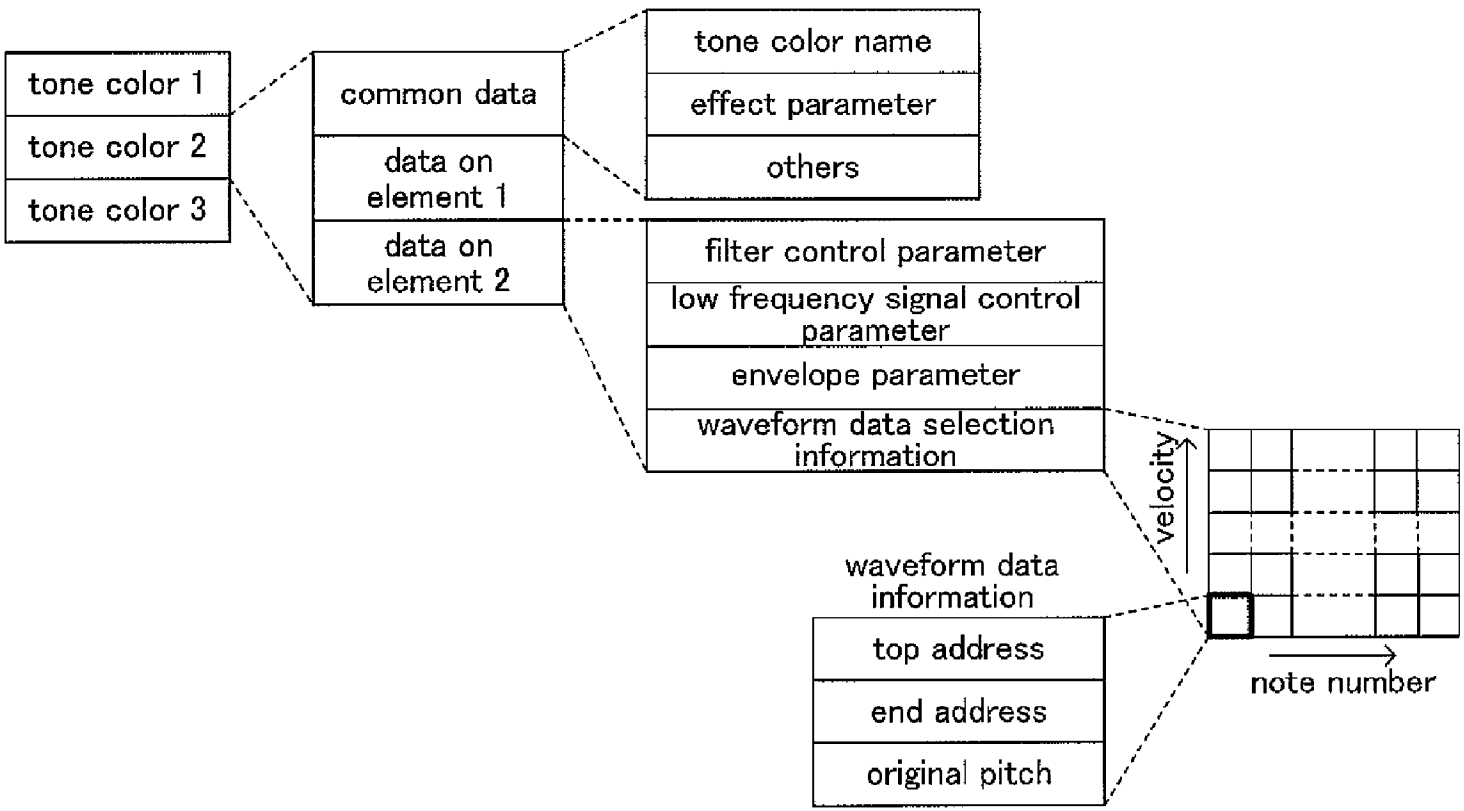
FIG. 7 is a memory map indicative of a configuration of voice data.

Next, the configuration of the computer portion 19 will be described in detail. Particularly, programs and various kinds of data stored in the ROM 19c and the RAM 19d will be described in detail. In the ROM 19c, a voice data list is stored. As indicated in FIG. 7, the voice data list is formed of voice data sets defined for respective tone colors. Each voice data set is formed of element data sets provided for respective element waveforms which form a musical tone waveform of a corresponding tone color, and common data used commonly for generation of respective element signals.

The respective element data sets are configured similarly. Each element data set is formed of a filter control parameter for controlling the filter circuit FLT, a low frequency signal control parameter for controlling the low frequency signal generation circuit LFO, envelope parameters for generating various envelopes, and waveform data selection information on selection of waveform data. The waveform data selection information is a table which stores correspondence between note numbers and velocities, and waveform data information indicative of information on waveform data which is to be selected. Each piece of the waveform data information is formed of a top address, an end address and an original pitch of waveform data.

The common data includes tone color name information indicative of the name of a corresponding tone color, and an effect parameter for adding a common effect to all the element signals output from the tone generation channels in the channel accumulation circuit 17a.

Figure 16:
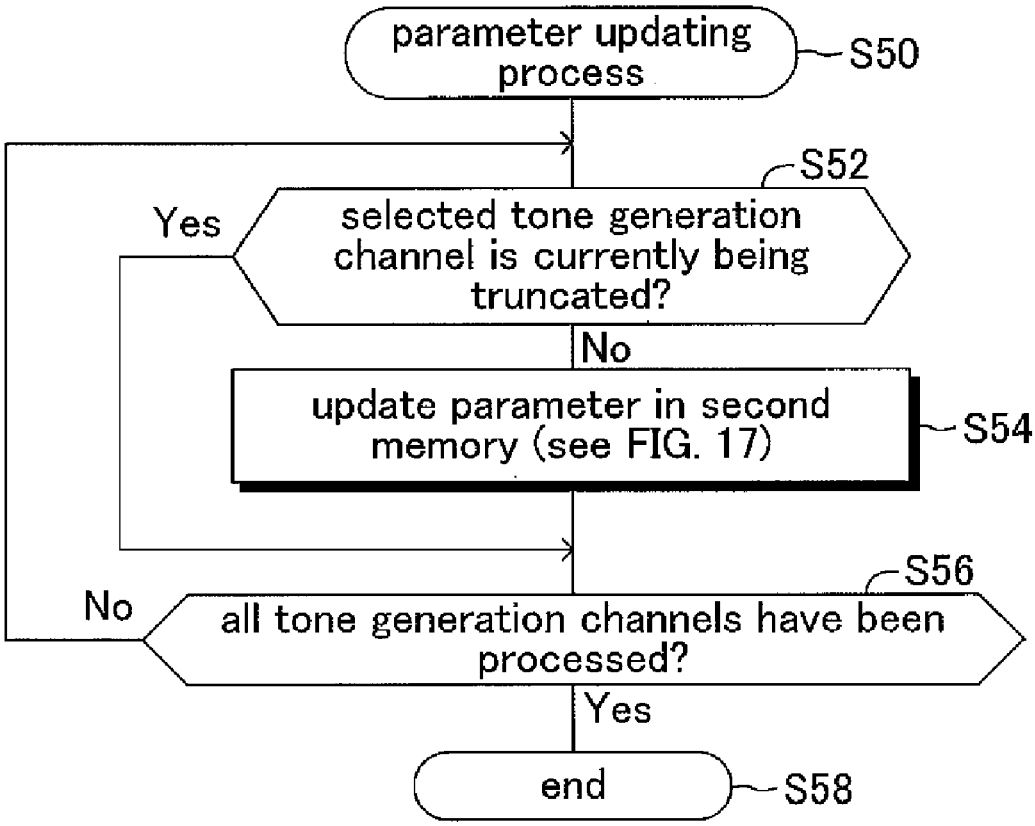
FIG. 16 is a flowchart of a parameter updating process program.

In the ROM 19c, a tone generation reservation program (FIG. 11), a tone generation channel securing program (FIG. 12), the periodic process program for updating parameters (FIG. 16) and a periodic process program for obtaining tone volume levels (FIG. 18) are stored. The tone generation reservation program, which is carried out at each generation of a note-on event, is a program for reserving tone generation channels which are to be used for tone-generation corresponding to the note-on event, and writing parameters on a musical tone which is to be generated. The tone generation channel securing program, which is a sub-routine of the tone generation reservation program, is a program for securing tone generation channels necessary for the tone-generation. On execution of the tone generation reservation program, the CPU 19a writes initial parameters and normal parameters relating to the musical tone corresponding to the generated note-on event into the first memory 17c5 of the tone generator 17 regardless of whether the secured tone generation channels are in use for generation of another musical tone. By the execution of the tone generation reservation program, the reservation of the tone generation channels is completed.

That is, the CPU 19*a* completes the tone generation reservation program without waiting for the start of the tone-generation in the tone generation channels reserved by the execution of the tone generation reservation program. When the reserved tone generation channels become available for generation of the musical tone corresponding to the generated note-on event, the tone generator 17 starts the processing for generating the musical tone by use of the parameters written into the first memory 17*c*5 by the execution of the tone generation reservation program.

The periodic process program for updating parameters and the periodic process program for obtaining tone volume levels are triggered by an interrupt signal supplied from the timer 19*b*. The periodic process program for updating parameters, which updates at certain intervals normal parameters included in the musical tone parameters supplied to the tone generator 17 in order to vary in real time the element signals generated in the respective tone generation channels which are currently generating a musical tone, is a program for writing parameters for generation of the respective envelopes into the second memory 17*c*6, for example. The periodic process program for obtaining tone volume levels is a program for reading respective register values of the tone generation channels of the tone generator 17 at regular intervals to update tone generation channel information which will be described later.

Figure 8:
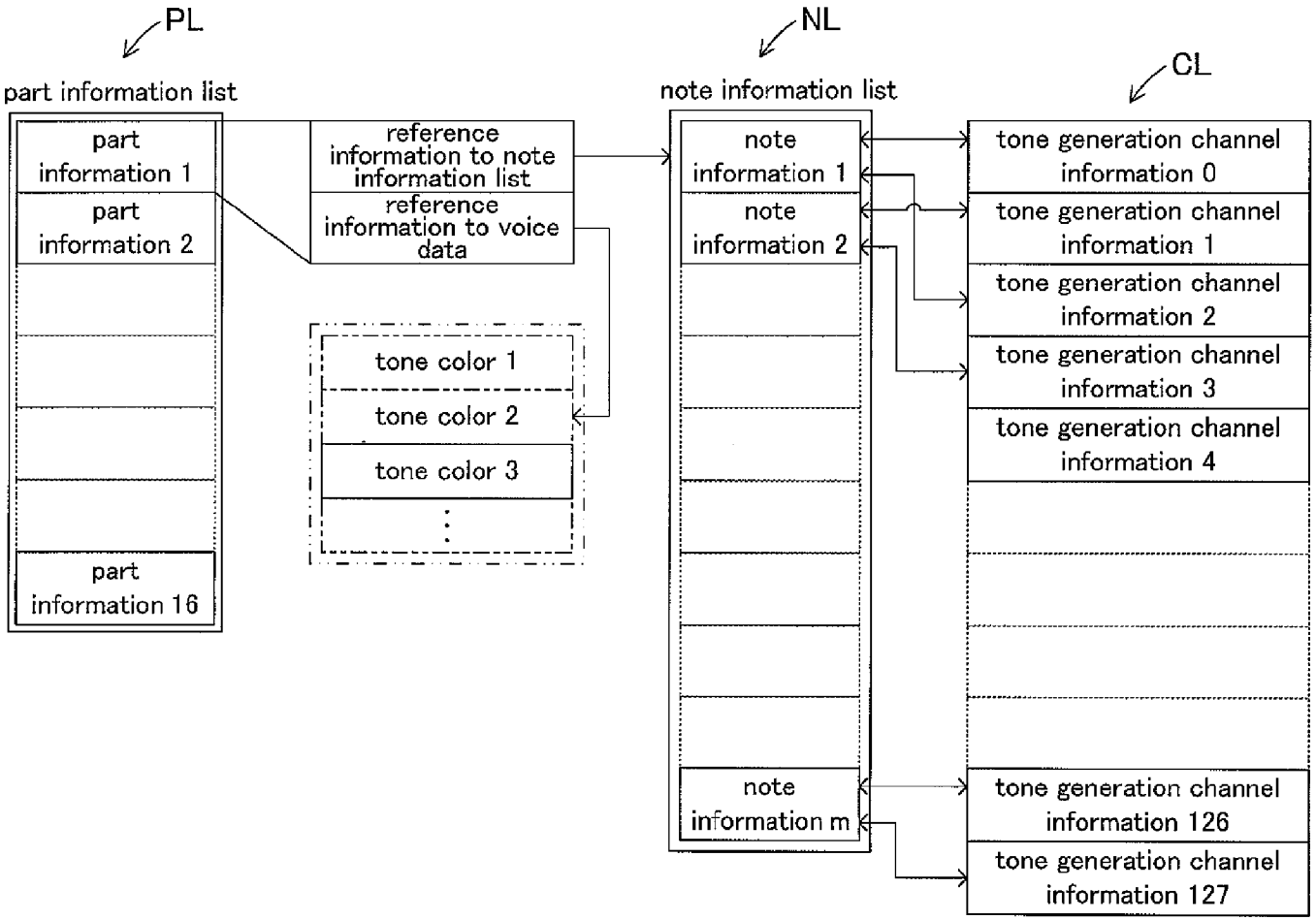
FIG. 8 is a schematic diagram indicative of relationship among part information, note information, tone generation channel information and voice data.

In the RAM 19*d*, data temporarily generated by the executions of the programs is stored. The temporarily generated data includes a part information list PL formed of part information provided for respective performance parts such as melody part and accompaniment part. In this embodiment, 16 performance parts are provided, so that the part information list PL is formed of 16 pieces of part information. As indicated in FIG. 8, each piece of part information is formed of information on reference to voice data and information on reference to a note information list NL.

The reference information to voice data is information on reference to voice data of a tone color assigned to a corresponding part. The note information list NL is provided for each performance part. The note information list NL provided for a performance part is formed of pieces of note information each storing information on a musical tone which is currently being generated or on a reserved tone-generation corresponding to a note-on event belonging to the performance part. As indicated in FIG. 9, each piece of note information includes a note number indicative of a tone pitch, a velocity indicative of the strength of a depressed key touch, and reference information (channel numbers, etc.) to tone generation channel information indicative of information on tone generation channels to be used. Each piece of note information has pieces of reference information to tone generation channels of the same number as the number of element waveforms which form a musical tone waveform. In an example indicated in FIG. 7 to FIG. 9, the tone color assigned to part 1 is configured by a musical tone waveform having two element waveforms. Therefore, each piece of note information of part 1 has two pieces of reference information to tone generation channel. A piece of note information is to be added to the note information list NL at each generation of a note-on event. When the generation of a tone is completed by a generation of a note-off event, a piece of note information is to be deleted from the note information list NL. However, the piece of note information which is to be deleted is not necessarily the oldest piece of note information. Therefore, each piece of note information has a forward link indicative of an address of the preceding piece of note information and a rear link indicative of an address of the following piece of note information. As the forward link of the oldest piece of note information and the rear link of the newest piece of note information, a value (e.g., "0") indicative of the absence of linked note information is recorded. In this embodiment, by updating the forward link and the rear link at each addition and deletion of the note information, the pieces of note information can be retraced in the order in which the note-on events have been generated.

A tone generation channel information list CL is formed of tone generation channel information 1 to tone generation channel information 127 provided for the respective tone generation channels. As indicated in FIG. 10, each piece of tone generation information is formed of a vacant channel flag indicative of whether or not a corresponding channel is currently generating a musical tone, envelope information on various envelopes, a tone volume level of an element signal, and reference information to a piece of note information which stores reference information to the piece of tone generation channel information. The envelope information on various envelopes indicates the current stage of the respective envelope circuits, and a target level and duration of the current stage. Tone generation channels corresponding to those pieces of tone generation channel information (e.g., tone generation channel CH4 in FIG. 8) which are not referenced by any piece of note information are vacant channels.

Figure 11:
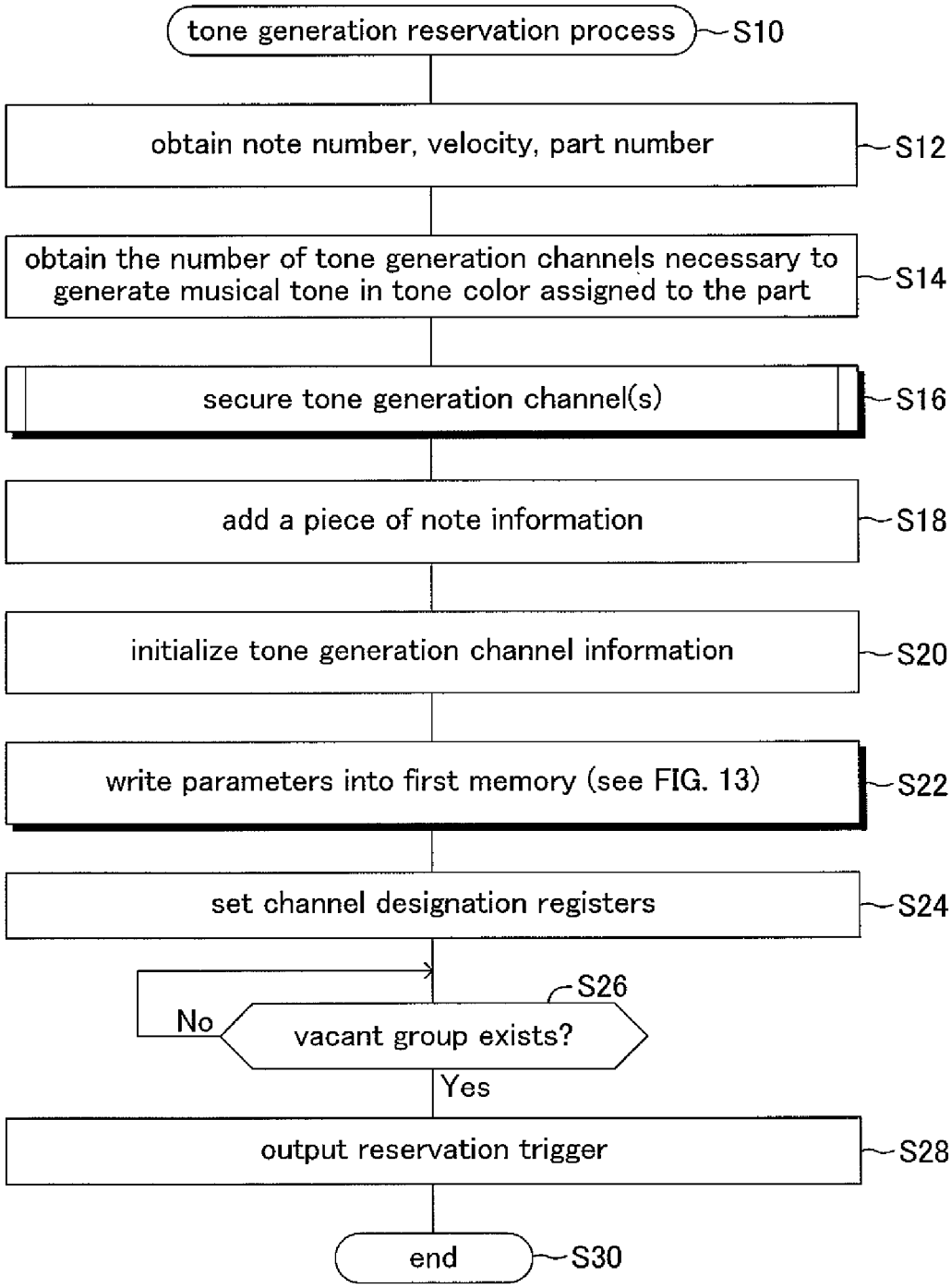
FIG. 11 is a flowchart of a tone generation reservation program.

Next, the operation of the musical tone signal generating apparatus configured as described above will be explained. When a note-on event is generated by a player's depression of any key of the keyboard 11, the CPU 19*a* starts the tone generation reservation program in step S10 as indicated in FIG. 11. In step S12, the CPU 19*a* retrieves a note number NN indicative of the depressed key and a velocity VEL indicative of the strength of the key-depression from performance information supplied from the operating element interface circuit 14, and identifies a part number PN. More specifically, each key of the keyboard 11 is previously assigned any of the parts, so that a depression of a key results in a musical tone of a corresponding part. Alternatively, the musical tone signal generating apparatus may be designed such that each key range is assigned a different part. On the basis of the generation of the note-on event by the player's manipulation of the keyboard 11 and the retrieved note number NN and the like, the CPU 19*a* identifies the part number PN indicative of a part to which the depressed key belong. In step S14, the CPU 19*a* identifies corresponding voice data on the basis of the identified part number PN, and obtains the number of element data sets which configure the identified voice data. In step S16, the CPU 19*a* carries out the tone generation channel securing program of FIG. 12 to secure the same number of tone generation channels as the number of the element data sets obtained in step S14.

Figure 12:
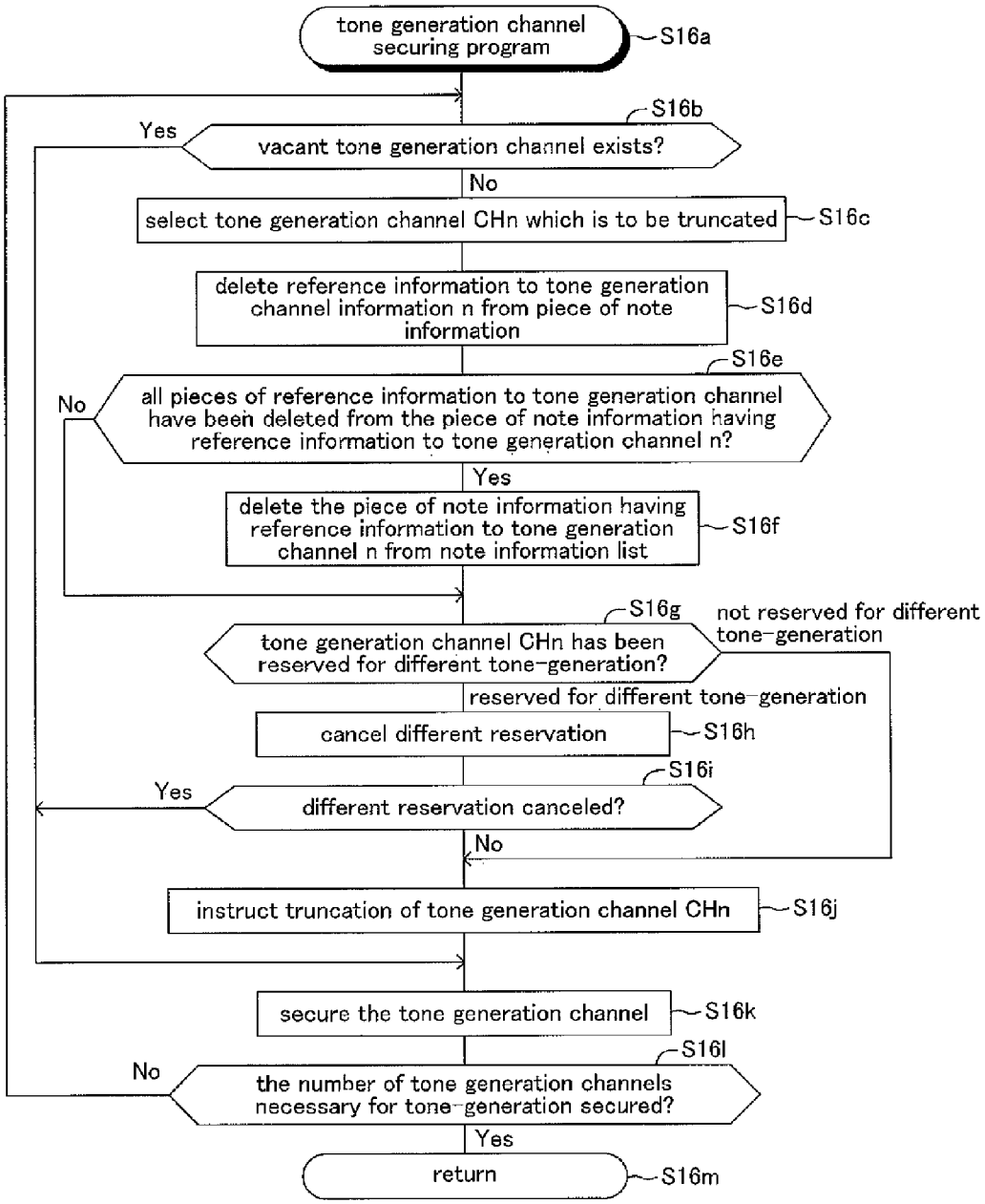
FIG. 12 is a flowchart of a tone generation channel securing routine indicated in FIG. 11.

As indicated in FIG. 12, the CPU 19*a* starts the tone generation channel securing program in step S16*a*. In step S16*b*, the CPU 19*a* refers to the vacant channel flag of the tone generation channel information list to search for vacant channels. When the search of step S16*b* reveals the existence of a vacant channel, the CPU 19*a* proceeds to step S16*k* which will be described later. When the search of step S16*b* reveals the absence of vacant channel, the CPU 19*a* proceeds to step S16*c* to select, from among the tone generation channels CH0, CH1, . . . , CH127, a tone generation channel CHn (n=0, 1, . . . , 127) which is to be truncated. The selection of a tone generation channel which will be truncated is done according to a predetermined rule. By referring to the tone generation channel information list CL, for example, a tone generation channel having an element signal of the smallest tone volume level will be selected as a channel to be truncated. Alternatively, by retracing the forward links of the pieces of note information to identify the oldest piece of note information, a tone generation channel having an element signal of the smallest tone volume level recorded in the tone generation channel information to which the oldest piece of note information refers will be selected as a channel to be truncated.

In step S16*d*, by use of the reference information to note information included in the tone generation channel information n corresponding to the tone generation channel CHn selected in step S16*c* to be truncated, the CPU 19*a* identifies a piece of note information which references to the tone generation channel information n (a piece of note information having reference information to the tone generation channel information n), and then deletes the reference information to the tone generation channel information n from the piece of note information. In step S16*e*, the CPU 19*a* determines whether all the pieces of reference information to tone generation channel information have been deleted from the piece of note information having the reference information to the tone generation channel information n. In a case where it is determined in step S16*e* that all the pieces of reference information to tone generation information included in the piece of note information have been deleted, the CPU 19*a* deletes the piece of note information which have had the reference information to tone generation channel n from the note information list NL in step S16*f*. In a case where it is determined in step S16*e* that there remains a piece of reference information to different tone generation channel information in the piece of note information, the CPU 19*a* proceeds to step S16*g* without deleting the piece of note information which have had the reference information to tone generation channel information n from the note information list NL.

In step S16*g*, the CPU 19*a* references to the reservation availability flag AFn to determine whether the tone generation channel CHn which has been selected in step S16*c* to be truncated has been already reserved for a different tone-generation or not. In a case where the reservation availability flag AFn indicates "reservation available", it is considered that the tone generation channel CHn has not been reserved for any other tone-generations. In this case, the CPU 19*a* proceeds to step S16*j* which will be described later. In a case where the reservation availability flag AFn indicates "reservation unavailable", it is considered that the tone generation channel CHn has been already reserved for a different tone-generation. More specifically, because an element signal which was being processed for tone-generation at the time of reservation of the different tone-generation is being decayed by truncation, the tone-generation for which the different reservation was made has not started. In this case, the CPU 19*a* cancels the reservation for the different tone-generation in step S16*h*. More specifically, the CPU 19*a* sets the channel designation register CSn corresponding to the tone-generation channel CHn at "cancel", and then supplies a cancel trigger signal to the reservation cancel circuit 17*b*7.

In the case where the different reservation is canceled, the reservation cancel circuit 17*b*7 sets the key-on map register KMn corresponding to the tone-generation channel CHn at "no group assignment", also setting the reservation cancel flag CFn at "cancel". In step S16*i*, the CPU 19*a* references to the reservation cancel flag CFn to determine whether the different reservation has been canceled or not. In a case where the reservation cancel flag CFn indicates "tone-generated", the CPU 19*a* instructs truncation of the element signal for which the different reservation was made and which has already been processed to generate a musical tone due to the failed cancellation of step S16*h*. In a case where it is determined in step S16*g* that the tone generation channel CHn has not been reserved for any other tone-generation (i.e., the reservation availability flag AFn is set at "reservation unavailable"), the target tone generation channel CHn is considered as being currently generating a musical tone, so that the CPU 19*a* instructs truncation of the tone generation channel CHn in step S16*j*. More specifically, a target value which is equal to or below a damp level and a short duration are written into the second memory 17*c*6 as parameters for the tone volume change circuit AEG.

In step S16*k*, the CPU 19*a* secures the tone generation channel CHn which the CPU 19*a* has instructed to truncate in step S16*j* as a tone generation channel which is to be used for a new tone-generation. In a case where the search for a vacant channel in step S16*b* has revealed the existence of a vacant channel, the CPU 19*a* secures the vacant channel as a tone generation channel for use in the new tone-generation. In a case as well where the determination of the execution of the cancellation of the reservation in step S16*i* has revealed that the reservation has been canceled, the CPU 19*a* secures the tone generation channel of which reservation has been canceled as a tone generation channel for use in the new tone-generation in step S16*k*.

In step S16*l*, the CPU 19*a* determines whether the number of tone generation channels necessary for the tone-generation has been secured. In a case where the same number of tone generation channels as the number of element data obtained in step S14 of FIG. 11 has been secured, the CPU 19*a* proceeds to step S16*m* to terminate the tone generation channel securing program to return to the tone generation reservation program. In a case where the number of secured tone generation channels is less than that of the element data obtained in step S14, the process formed of the steps S16*b* to S16*k* is repeated to secure the same number of tone generation channels as the number of the element data.

After the same number of tone generation channels as the number of the element data has been secured by the execution of the tone generation channel securing program, the CPU 19*a* proceeds to step S18 to add a new piece of note information to the note information list NL (see FIG. 8 and FIG. 9). In step S18, furthermore, the CPU 19*a* writes the note number and the velocity obtained in step S12 into the added note information. The CPU 19*a* also writes reference information to tone generation channel information corresponding to the secured tone generation channels. In addition, the CPU 19*a* also writes a forward link which is the reference information to a piece of note information corresponding to the immediately preceding note-on event. In step S20, the CPU 19*a* initializes pieces of tone generation channel information corresponding to the secured tone generation channels (see FIG. 8 and FIG. 10). More specifically, the CPU 19*a* sets the vacant channel flag at "in use", also designating reference information to the added new piece of note information as the reference information to note information. As the various kinds of envelope values, the CPU 19*a* designates an initial level and a target value of the first stage.

Figure 13:
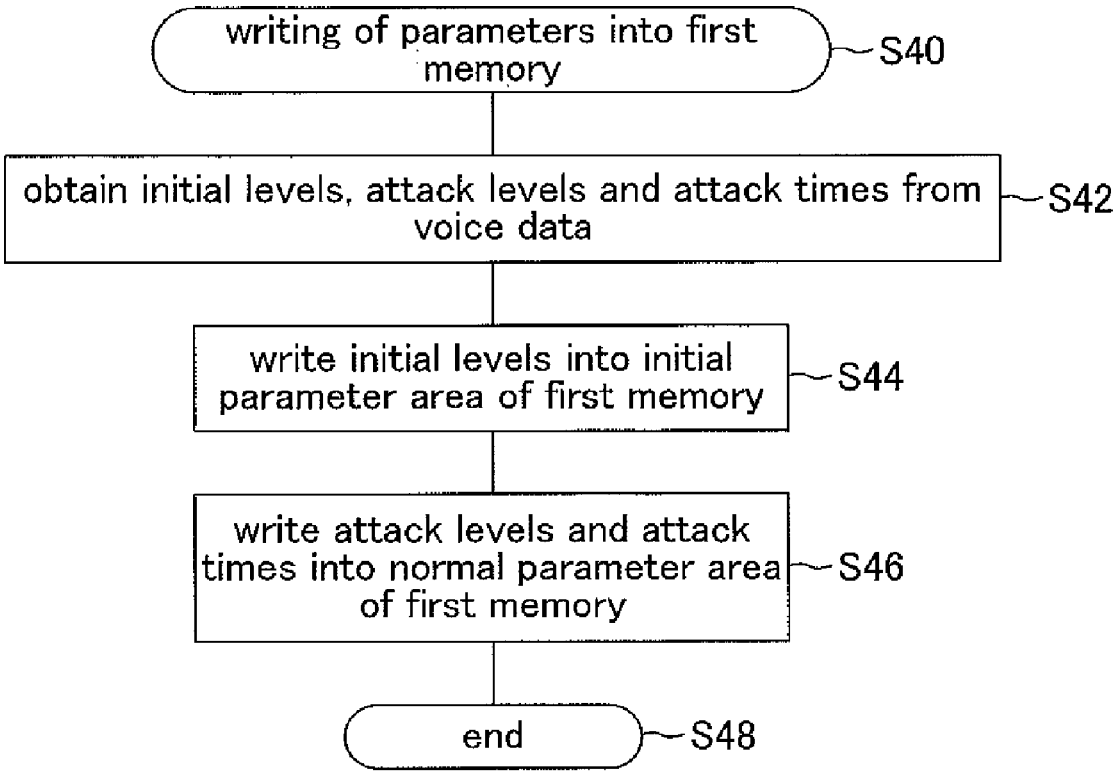
FIG. 13 a flowchart of a concrete example of writing of parameters indicated in FIG. 11.

In step S22, the CPU 19*a* writes respective various parameters of the secured tone generation channels into the first memory 17*c*5. From the voice data identified in step S14, more specifically, the CPU 19*a* obtains an effect parameter, envelope parameters, top and end addresses of waveform data, original pitches and the like, and writes them into corresponding areas of the first memory 17*c*5, respectively. As indicated in FIG. 13, for example, for the writing of filter envelope parameters which are to be supplied to the cutoff frequency change circuits FEG, the CPU 19*a* starts a parameter writing process for the cutoff frequency change circuit FEG in step S40. In step S42, the CPU 19*a* obtains the initial levels, the attack levels and the attack times included in the respective filter envelope parameters recorded in the voice data. In step S44, the CPU 19*a* writes the initial levels into the initial parameter area of the first memory 17*c*5. In step S46, the CPU 19*a* writes the attack levels and the attack times into the normal parameter area of the first memory 17*c*5. In step S48, the CPU 19*a* terminates the parameter writing process for the cutoff frequency change circuit FEG.

Now, FIG. 11 will be explained again. In step S24, the CPU 19*a* sets registers which are included in the channel designation registers CS0, CS1, . . . , CS127 and corresponds to the tone generation channels (i.e., the tone generation channels to reserve) secured in step S16 at "reserved". In step S26, the CPU 19*a* waits until the group full flag GF indicates "vacant group". Because 30 groups are available in this embodiment as described above, the group full flag GF is seldom set at "no vacant group" at the start of step S26. Even if step S26 starts with the group full flag GF indicative of "no vacant group", the group full flag GF is to turn to "vacant group" in a short period of time (e.g., in a few milliseconds) because of the start of reserved generation of a musical tone by truncation of a tone generation channel by the tone generator 17. Therefore, there cannot be a problem that the CPU 19*a* has to wait so long in step S26 that the CPU 19*a* cannot execute other processes in right timing.

After it is determined in step S26 that there is a vacant group, the CPU 19*a* proceeds to step S28 to output a reservation trigger signal to the reservation reception circuit 17*b*1. In step S30, the CPU 19*a* terminates the tone generation reservation program. Accordingly, the reservation of the tone generation channels for the note-on event is completed.

Referring FIG. 14, the operation of the tone generator 17 in a case where a new note-on event is generated during tone-generation in the tone generation channel CHn (n=0, 1, . . . , 127), so that the tone generation channel CHn is reserved by the CPU 19*a* for generation of a musical tone corresponding to the new note-on event will be described. In this example, the tone generation channel CHn which the CPU 19*a* desires to reserve is currently generating a musical tone for which a note-off event has been already generated.

The reservation reception circuit 17*b*1 to which the reservation trigger signal has been input obtains a vacant group number m from the group occupation status registers GU1 to GU30, and then sets the group occupation status register GUm at "occupied". Then, the obtained vacant group number m is written into the key-on map register KMn corresponding to the tone generation channel CHn. The reservation reception circuit 17*b*1 then sets the channel designation register CSn corresponding to the tone generation channel CHn at "no designation". After the writing of the group number m into the key-on map register KMn, the reservation availability flag setting circuit 17*b*8 sets the reservation availability flag AFn corresponding to the tone generation channel CHn at "reservation unavailable". At the start of the sampling cycle following the sampling cycle at which the group number m has been written into the key-on map register KMn, the key-on map latch circuit 17*b*5 copies the contents of the key-on map KM to the key-on map latch KML. At the following sampling cycle, in other words, the group number m is written into the key-on map latch register KMLn.

Figure 14:
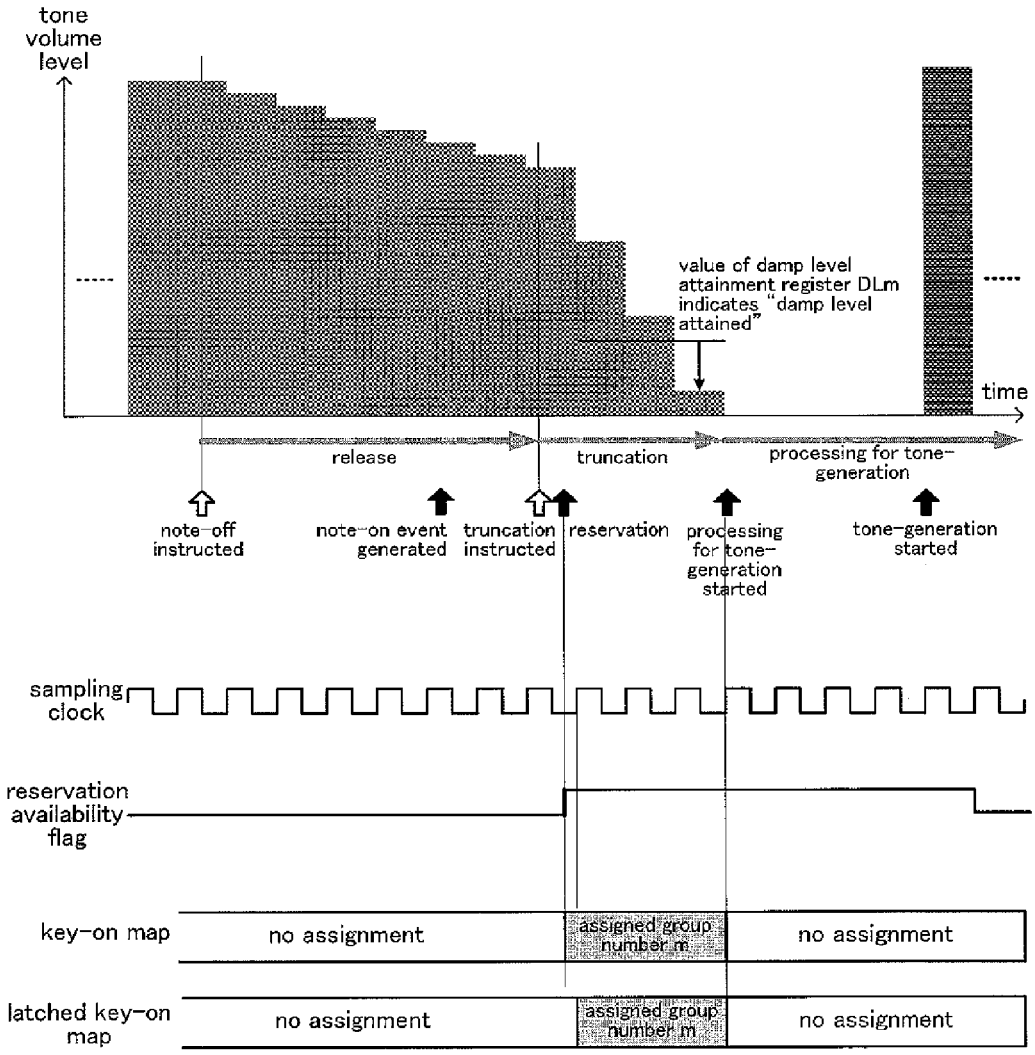
FIG. 14 is a time chart indicative of operation of the tone generation reservation circuit.

In FIG. 14, at the time of the reservation of the tone generation channel CHn, the tone volume change circuit AEG of the tone generation channel CHn is at the fifth stage (during release), so that the tone generator 17 gradually decreases the tone volume level of the element signal generated in the tone generation channel CHn at each sampling cycle. By the instruction made by the CPU 19*a* to truncate the element signal which is currently being generated by step S16*j* of the tone generation channel securing program, the tone volume change circuit AEG generates an envelope which increases the rate of decrease in the tone volume level of the element signal, and supplies the generated envelope to the tone volume control circuit AMP. As a result, the tone volume level quickly decreases. At each sampling cycle, the damp level attainment detection circuit 17*b*4 determines, on the basis of the tone volume levels of the element signals generated in the respective tone generation channels and supplied to the damp level attainment detection circuit 17*b*4 from the level detection circuit 17*b*3 through the tone volume level registers AL0 to AL127, and the key-on map latch, whether the tone volume levels of all the tone generation channels belonging to the group m have attained the damp level. The determination results of whether the tone volume levels have attained the damp level are written into the damp level attainment detection registers DL1 to DL30.

Figure 15:
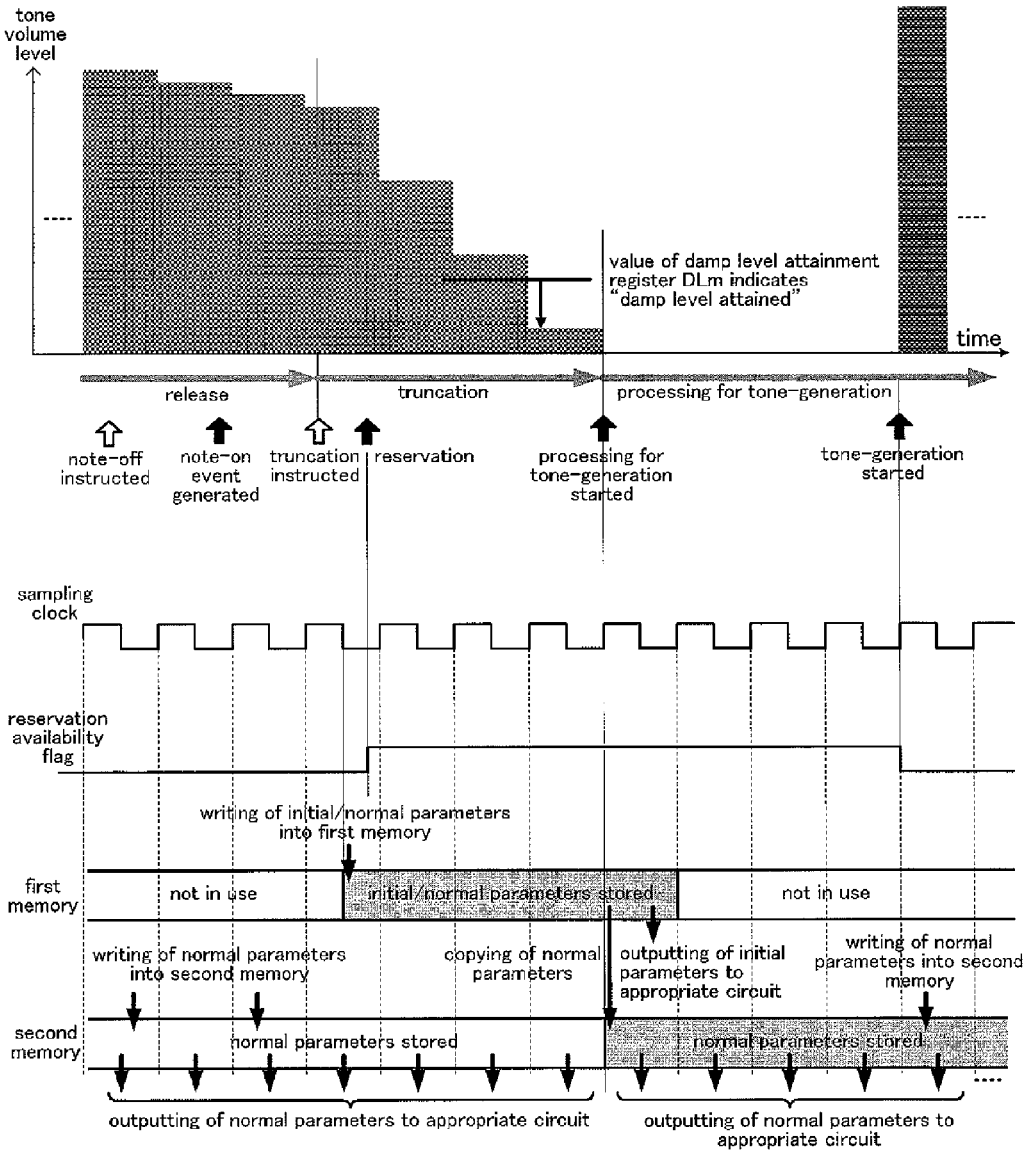
FIG. 15 is a time chart indicative of operation of the musical tone parameter input/output circuit.

As indicated in FIG. 15, by step S22 of the tone generation reservation program carried out by the CPU 19*a*, the initial parameters and the normal parameters are written into the first memory 17*c*5. These initial parameters and normal parameters are kept in the first memory 17*c*5 until the value of the damp level attainment detection register DLm turns to "damp level attained". When the value of the damp level attainment detection register DLm turns to "damp level attained", the normal parameter transfer circuit 17*c*3 copies the parameters written into the normal parameter area of the first memory 17*c*5 to the second memory 17*c*6, whereas the initial parameter output circuit 17*c*2 outputs the initial parameters to the respective portions (the pitch change circuit PEG, the cutoff frequency change circuit FEG, the tone volume change circuit AEG, etc.) of the tone generator 17 at the following sampling cycle. After the output of the initial parameters kept in the first memory 17*c*5 to the respective portions of the tone generator 17 and the copy of the normal parameters kept in the first memory 17*c*5 to the second memory 17*c*6, although these initial parameters and normal parameters remain in the respective storage areas of the first memory 17*c*5 until initial parameters and normal parameters for the following reservation are written into the first memory 17*c*5 for the reservation of the tone generation channel CHn, these storage areas will not be referenced to, without being used.

The tone-generation start instruction circuit 17*b*6 then instructs all the tone generation channels belonging to the group number "m" to start tone-generation, and also sets the key-on map registers and the key-on map latch registers corresponding to these tone generation channels at "no group assignment". In addition, the tone-generation start instruction circuit 17*b*6 sets the group occupation status register GUm at "available". The reservation availability flag setting circuit 17*b*8 keeps the reservation availability flag at "reservation unavailable" for a certain period of time (e.g., for five sampling cycles) in spite of the key-on map register KMn being set at "no group assignment", and turns the reservation availability flag to "reservation available" after the certain period of time.

The normal parameters written into the second memory 17*c*6 by the normal parameter transfer circuit 17*c*3 are output to the respective circuits of the tone generation channels at each sampling cycle by the normal parameter output circuit 17*c*4.

The normal parameters written into the second memory 17*c*6 are updated at certain time intervals (e.g., 10 milliseconds) by the execution of a parameter updating periodic process program by the CPU 19*a*. To the CPU 19*a*, interrupt signals are supplied at evenly spaced time intervals (e.g., 1 millisecond) by the timer 19*c*, so that the CPU 19*a* repeatedly executes the parameter updating periodic process program and a tone volume level check periodic process program at the certain time intervals (e.g., 10 milliseconds) on the basis of the supplied interrupt signals.

The parameter updating periodic process program will be explained. The parameter updating periodic process program is a program for writing parameters and the like for generating envelopes which vary the tone pitch, the tone color and the tone volume of a musical tone which is currently being generated. The CPU 19*a* starts the parameter updating periodic process at step S50 indicated in FIG. 16. In step S52, the CPU 19*a* selects a tone generation channel CHn (n=0, 1, . . . , 127), and refers to the reservation availability flag AFn corresponding to the tone generation channel CHn to determine whether the musical tone signal of the tone generation channel CHn is currently being truncated or not. In other words, in a case where the reservation availability flag AFn indicates "reservation unavailable", it is considered that the musical tone signal which is currently being generated in the tone generation channel CHn is currently being truncated. In this case, the CPU 19*a* proceeds to step S56 which will be described later. In a case where the reservation availability flag AFn indicates "reservation available", it is considered that the musical tone which is currently being generated in the tone generation channel CHn is not currently being truncated. In this case, the CPU 19*a* proceeds to step S54 to update the normal parameters stored in the second memory 17*c*6.

Figure 17:
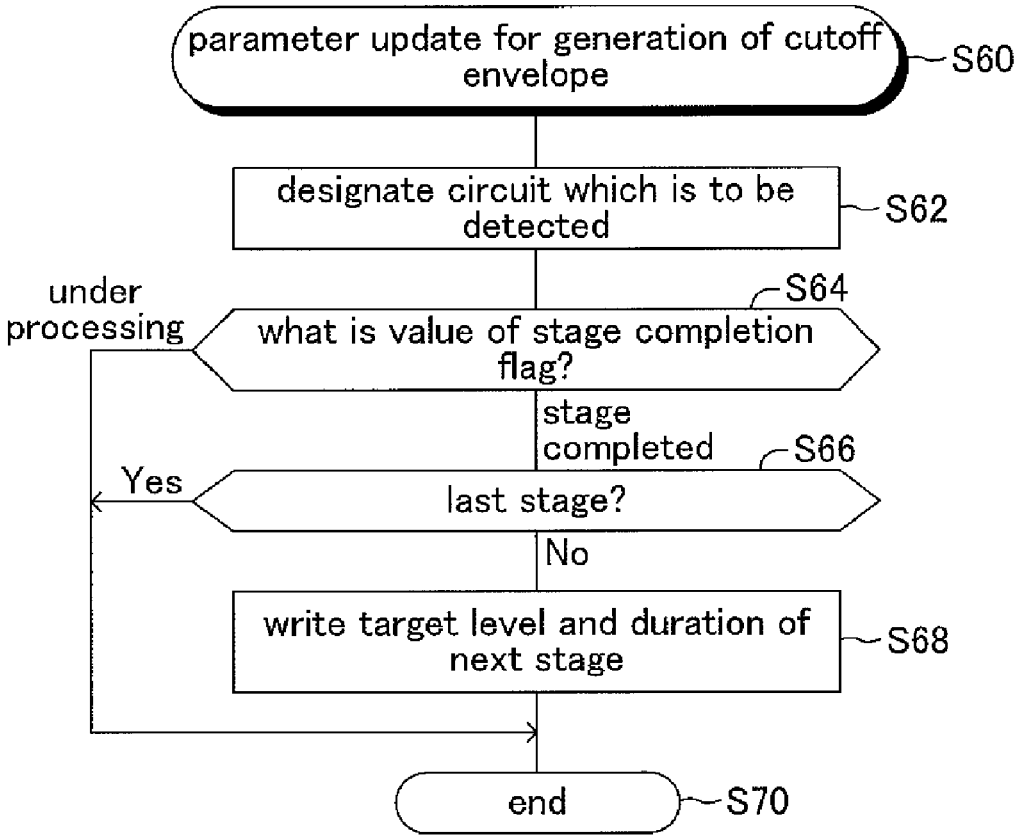
FIG. 17 is a flowchart of a concrete example of a parameter updating process in the second memory indicated in FIG. 16.

As an example writing of parameters in the above-described step S54, the update of parameters for allowing the cutoff frequency change circuit FEG to generate a cutoff envelope will be explained with reference to FIG. 17. In step S60, the CPU 19*a* starts the parameter updating process for the cutoff frequency change circuit FEG. In step S62, the CPU 19*a* writes values indicative of the tone generation channel number which is to be detected and of the type of envelope circuit (in this example, a value indicative of the cutoff frequency change circuit FEG) into the detection target designation register DD of the EG stage detection circuit 17*c*1 (see FIG. 6). In step S64, the CPU 19*a* reads out the value of the stage completion flag. In a case where the value of the stage completion flag is "stage completed", the CPU 19*a* proceeds to step S66 to determine whether the current stage of the cutoff frequency envelope is the last stage or not. In a case where it is determined in step S66 that the current stage is not the last stage, the CPU 19*a* proceeds to step S68 to write a target level of the cutoff frequency of the next stage and duration of the next stage into the second memory 17*c*6. In addition, the CPU 19*a* updates an envelope value of corresponding tone generation channel information. More specifically, the CPU 19*a* writes the next stage number and the target value of the next stage. In a case where the value of the stage completion flag read out in step S64 is "stage under processing", the CPU 19*a* proceeds to step S70 to terminate the parameter updating process for the cutoff frequency change circuit FEG. In a case as well where it is determined in step S66 that the current stage of the envelope is the last stage, the CPU 19*a* proceeds to step S70 to terminate the parameter updating process for the cutoff frequency change circuit FEG.

Other examples of writing of parameters in the above-described step S54 include cases where the tone pitch, the tone color, the tone volume and the like of a musical tone will be changed in accordance with performance information generated by a player's manipulation of the panel operating element 12, the pedal operating element 13 or the like, or performance information transmitted from a MIDI capable external apparatus through the external interface circuit 22. In these cases, the CPU 19*a* writes normal parameters of corresponding tone generation channels into the second memory 17*c*6 in accordance with the performance information to update the parameters. The updated normal parameters are output along with the other normal parameters which have not been updated to the respective circuits of the tone generation channels by the normal parameter output circuit 17*c*4.

The periodic process for updating parameters indicated in FIG. 16 will be explained again. After updating the normal parameters of the second memory 17*c*6 as described above, the CPU 19*a* proceeds to step S56 to determine whether all the tone generation channels have completed the processing or not. In a case where there still remain unprocessed tone generation channels, the CPU 19*a* iterates steps S52 to S54 to update parameters for all the tone generation channels. On completion of the updating of the parameters of all the tone generation channels, the CPU 19*a* proceeds to step S58 to terminate the periodic process program for updating parameters.

Figure 18:
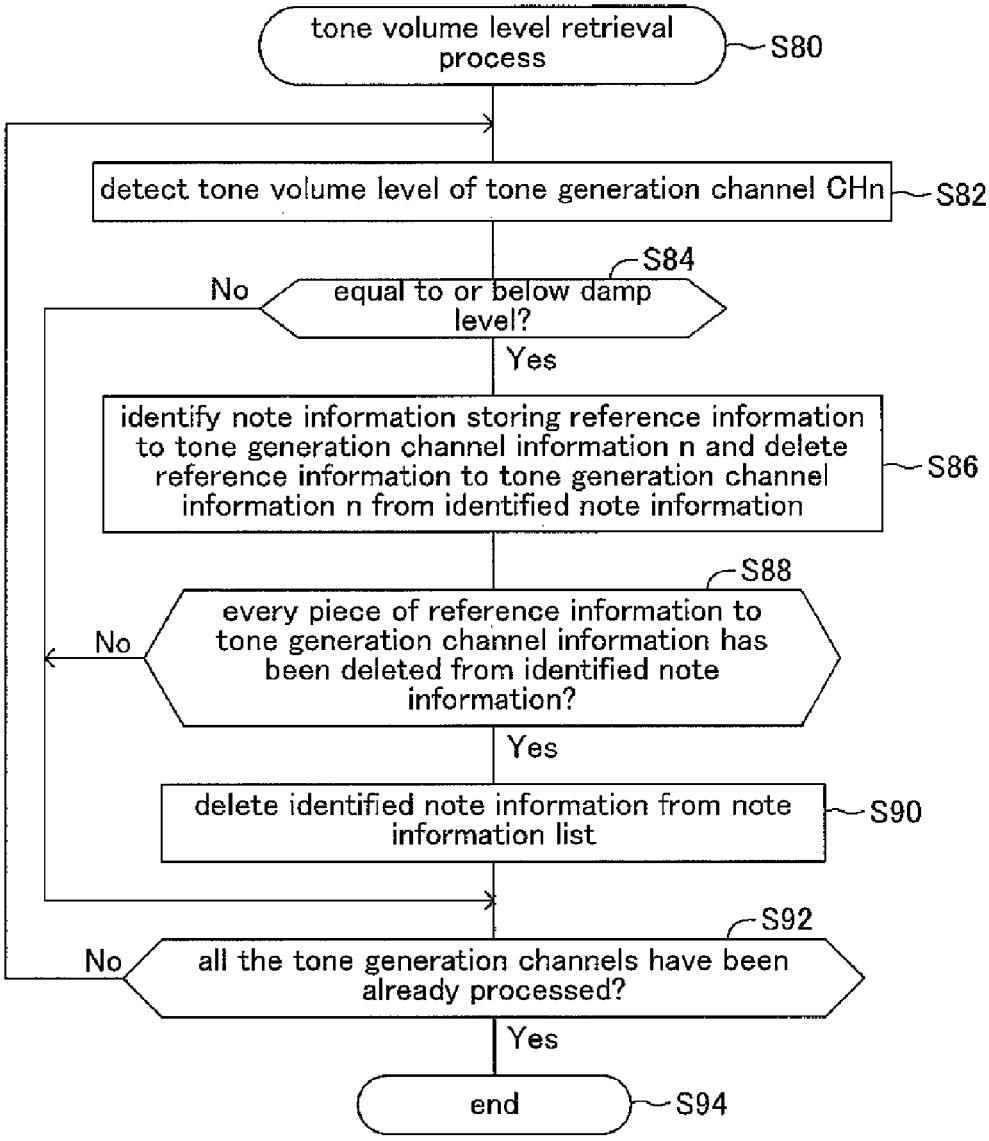
FIG. 18 is a flowchart of a tone volume level retrieval process program.

Next, the tone volume level retrieval periodic process program will be described. As indicated in FIG. 18, the CPU 19*a* starts the tone volume level retrieval periodic process program in step S80. In step S82, the CPU 19*a* selects a tone generation channel CHn (n=0, 1, . . . , 127), and inputs the tone volume level of an element signal generated in the tone generation channel CHn from the level detection circuit 17*b*3 through the tone volume level registers AL0 to AL127. In step S84, the CPU 19*a* determines whether the input tone volume level of the element signal is equal to or below the damp level. In a case where it is determined that the tone volume level of the element signal is not equal to or below the damp level, the CPU 19*a* proceeds to step S92 which will be described later.

In a case where it is determined that the tone volume level is equal to or below the damp level, the CPU 19*a* sets the vacant channel flag of the tone generation channel information n corresponding to the tone generation channel CHn at "vacant". Using the reference information to note information recorded in the tone generation channel information n, the CPU 19*a* then identifies, in step S86, a piece of note information which stores the reference information to tone generation channel information n. In step S86, furthermore, the CPU 19*a* deletes the reference information to tone generation channel information n included in the identified note information. Then, the CPU 19*a* proceeds to step S88 to determine whether every piece of reference information to tone generation channel information stored in the identified note information has been deleted. In a case where the identified note information still has a piece of reference information to tone generation channel information, the CPU 19*a* proceeds to step S92.

In a case where every piece of reference information to tone generation channel information has been deleted from the identified note information, the CPU 19*a* proceeds to step S90 to delete the note information. In addition, the CPU 19*a* updates the forward link or rear link of the pieces of note information which precede or follow the deleted note information. Then, the CPU 19*a* proceeds to step S92 to determine whether all the tone generation channels have been already processed. When there remains an unprocessed tone generation channel, the CPU 19*a* iterates steps S82 to S90 so that respective tone volume levels of all the tone generation channels can be retrieved. After the retrieval of the respective tone volume levels of all the tone generation channels, the CPU 19*a* proceeds to step S94 to terminate the tone volume level retrieval periodic process program.

Although the above-described example indicates the operation of the tone generator 17 which makes a reservation of the tone generation channel which is currently generating a musical tone (under release), the tone generator 17 will operate similarly in a case in which a tone generation channel CHn which is to be reserved is a vacant channel. In this case, more specifically, except that the damp level attainment detection circuit 17*b*4 detects, at a sampling cycle which follows the sampling cycle at which the reservation is made, that the tone volume level of the musical tone signal of the tone generation channel CHn has attained the damp level, the tone generator 17 operates similarly to the case where the tone generation channel which is currently generating a musical tone is to be reserved. In the above-described example, furthermore, the note-on event and the note-off event are generated by a player's manipulation of the keyboard 11. However, a note-on event and note-off event can be also generated on the basis of performance information supplied from an automatic performance program or an external apparatus. In this case as well, the CPU 19*a* and the tone generator 17 operate similarly to the above-described example except that a part number PN corresponding to the performance information is to be assigned in step S12.

In the musical tone signal generating apparatus configured as described above, the CPU 19*a* terminates the tone generation reservation program without waiting for the start of tone-generation in the reserved tone generation channel. In other words, the CPU 19*a* is required not to control the timing for starting tone-generation but simply to reserve the tone generation channel. More specifically, the timing for starting tone-generation is controlled by the tone generator 17. After the termination of the tone generation reservation program, therefore, the CPU 19*a* is able to immediately execute another program. After the termination of the tone generation reservation program, for example, the CPU 19*a* is able to immediately start the tone generation reservation program again for a reservation of a tone generation channel for another note-on event. Immediately after the termination of the tone generation reservation program, alternatively, the CPU 19*a* is able to carry out the parameter updating periodic process program or the tone volume level retrieval periodic process program. Compared to the above-described conventional musical tone signal generating apparatus, therefore, the musical tone generating apparatus according to the present invention offers enhanced processing speed.

In the musical tone signal generating apparatus configured as described above, furthermore, when the CPU 19*a* reserves the tone generation channels CH0 to CH127 in response to a key-on event, the reservation reception circuit 17*b*1 updates the key-on map registers KM0 to KM127. Before the level detection circuit 17*b*3 starts a sequence of detections of respective tone volume levels of the tone generation channels CH0 to CH127, furthermore, the contents of the key-on map are copied to the key-on map latch. Using the results detected by the level detection circuit 17*b*3 and the key-on map latch, the damp level attainment detection circuit 17*b*4 detects whether the respective tone volume levels of musical tone signals generated by all the tone generation channels belonging to a group are equal to or below a damp level. As described above, the musical tone signal generating apparatus of the present invention uses the key-on map latch in which the group configuration will not vary during detection of damp level, preventing unnatural musical performance.

In the musical tone signal generating apparatus configured as described above, furthermore, tone generation channels designated by use of the channel designation registers CS0, CS1, . . . , CS127 are provided with a common group number, with the group number being stored in the key-on map KM0, KM1, . . . , KM127. In a case where the tone generation channels start generating element signals concurrently, therefore, the damp level attainment detection circuit 17*b*4 determines whether the respective tone volume levels of all the tone generation channels having the same group number are equal to or below the damp level. Even if a multiplicity of note-on events are generated in a short period of time in a concentrated manner, therefore, the CPU 19*a* is able to reserve tone generation channels as long as there is a vacant group number. After making the reservation, in addition, the CPU 19*a* can carry out other processing. Therefore, the musical tone signal generating apparatus of the present invention offers enhanced processing speed.

In the musical tone signal generating apparatus configured as described above, furthermore, in a case where a tone generation channel which is to be reserved has already had a different reservation, the different reservation can be canceled. Even if there is no vacant channel left with reservations having been already made to all the tone generation channels, respectively, therefore, the reservation of the tone generation channel can be canceled so that the CPU 19*a* can make a new reservation. Even if a tone generation channel which the CPU 19*a* desires to reserve has been already reserved, more specifically, the CPU 19*a* is able to make the desired reservation to the tone generation channel for a note-on event generated after the already-existing reservation, without waiting until the reserved tone generation channel turns vacant because of the execution of the reservation of the tone generation channel. In addition, because the CPU 19*a* is not required to control the timing to start generation of a musical tone signal in the reserved tone generation channel, the CPU 19*a* is able to start another processing immediately after the reservation. Therefore, the musical tone signal generating apparatus of the present invention enhances processing speed.

Furthermore, the above-described musical tone signal generating apparatus is provided with the reservation cancel flags CF0 to CF127 to determine whether the different reservations have been canceled, respectively. In a case where the different reservation of a tone generation channel has not been canceled (that is, in a case where the different reservation has executed to start generation of a musical tone) in spite of the instruction to cancel the different reservation, the CPU 19*a* instructs to truncate the tone generation channel that has just started generating the musical tone so that a new reservation can be made to the tone generation channel.

In the above-described musical tone signal generating apparatus, the musical tone parameter input/output circuit 17*c* is provided with the first memory 17*c*5 and the second memory 17*c*6 for storing various kinds of parameters. Such a configuration allows the CPU 19*a* to write musical tone parameters into the first memory 17*c*5 at the time of reservation of tone generation channels so that the written musical tone parameters can be kept in the first memory 17*c*5 until the start of tone-generation. Furthermore, initial parameters included in the musical tone parameters written into the first memory 17*c*5 are supplied directly to the respective tone generation channels by the initial parameter output circuit 17*c*2 when tone-generation starts. Normal parameters included in the musical tone parameters are transferred to the second memory 17*c*6 before being supplied to the respective tone generation channels by the normal parameter output circuit 17*c*4 at certain timings (e.g., at every 10 milliseconds) during tone-generation. After the completion of the reservation of the tone generation channels, in other words, the CPU 19*a* is not involved in the supply of the parameters to the tone generation channels until the start of tone-generation, so that the CPU 19*a* is able to carry out another processing during the supply of the parameters. Therefore, the musical tone signal generating apparatus of the present invention enhances processing speed.

As described above, furthermore, because initial parameters will not be transferred to the second memory 17*c*6, the musical tone signal generating apparatus of the present invention can reduce the storage capacity of the second memory 17*c*6. In addition, because the CPU 19*a* updates normal parameters (e.g., parameters for various kinds of envelopes) stored in the second memory 17*c*6 after the start of generation of element signals, the CPU 19*a* can vary the tone color, the tone volume and the like of element signals with the passage of time. As compared with a case in which parameters necessary for varying musical tone signals with the passage of time are supplied at the time of the reservation of tone generation channels at one time, the musical tone signal generating apparatus of the present invention can reduce the respective storage capacities of the first memory 17*c*5 and the second memory 17*c*6.

The present invention is not limited to the above-described embodiment, but can be variously modified without departing from the spirit and scope of the invention.

g. Modified Examples

In the above-described embodiment, the tone generator 17 is a waveform memory tone generator which reads waveform data from the waveform memory WM to generate musical tone signals. However, the present invention is not limited to the musical tone signal generating apparatus having the waveform memory tone generator but can be applied to musical tone signal generating apparatuses having any type of tone generator as long as the tone generator is provided with tone generation channels for generating musical tone signals to produce the same effects as those produced by the above-described embodiment.

In the above-described embodiment, the level detection circuit 17*b*3 detects respective tone volume levels of element signals output from the respective tone volume control circuits AMP of the tone generation channels, whereas using the detected tone volume levels, the damp level attainment detection circuit 17*b*4 detects whether the element signals of the respective tone generation channels belonging to the respective groups have attained the damp level. By using the detected tone volume levels, furthermore, the musical tone signal generating apparatus of the above-described embodiment determines a tone generation channel which is to be truncated (step S16*c* of FIG. 12). By using the detected tone volume levels, in addition, the musical tone signal generating apparatus of the above-described embodiment searches for a vacant channel (step S82 of FIG. 18). However, the musical tone signal generating apparatus may be modified such that additional level detection circuits for detecting tone volume levels of element signals output from the tone volume control circuits AMP of the respective tone generation channels are provided for the respective processes, namely the detection of attainment of damp level, the determination of a tone generation channel to be truncated and the search for a vacant channel. Alternatively, the musical tone signal generating apparatus may be modified such that two level detection circuits are provided so that one of the level detection circuits will be used for any one of the above-described processes, with the other being used for the rest of the processes. In a case where the musical tone signal generating apparatus is provided with the level detecting means provided specifically for the detection of attainment of damp level, the level detecting means provided specifically for the detection of attainment of damp level may be designed to detect respective tone volume levels of musical tone signals generated in all the tone generation channels of the electronic musical instrument as in the case of the above-described embodiment, or to detect only the tone volume levels of musical tone signals generated in reserved tone generation channels. In the above-described processes, furthermore, the musical tone signal generating apparatus may use not the tone volume levels of element signals output from the tone volume control circuits AMP of the tone generation channels but the tone volume control signals supplied to the tone volume control circuits AMP by the tone volume change circuits AEG. More specifically, the level detection circuit 17*b*3 may detect not the tone volume levels of element signals output from the tone volume control circuits AMP but tone volume control signals supplied to the tone volume control circuits AMP by the tone volume change circuits AEG. By using the detected tone volume control signals, furthermore, the musical tone signal generating apparatus may detect attainment of damp level, determine a tone generation which is to be truncated, and search for a vacant channel.

In addition to the level detection circuit 17*b*3 for detecting respective tone volume levels of element signals output from the tone volume control circuits AMP, the musical tone signal generating apparatus may have a tone volume control signal detection circuit for detecting tone volume control signals supplied to the tone volume control circuits AMP by the tone volume change circuits AEG. In this modification, the musical tone signal generating apparatus may use the tone volume levels and the tone volume control signals detected by the level detection circuits 17*b*3 and the tone volume control signal detection circuit, respectively, in combination for the respective processes of the detection of attainment of damp level, the determination of a tone generation channel to be truncated and the search for a vacant channel, or may use either the tone volume levels detected by the level detection circuit 17*b*3 or the tone volume control signals detected by the tone volume control signal detection circuit depending on the process.

Figure 19:
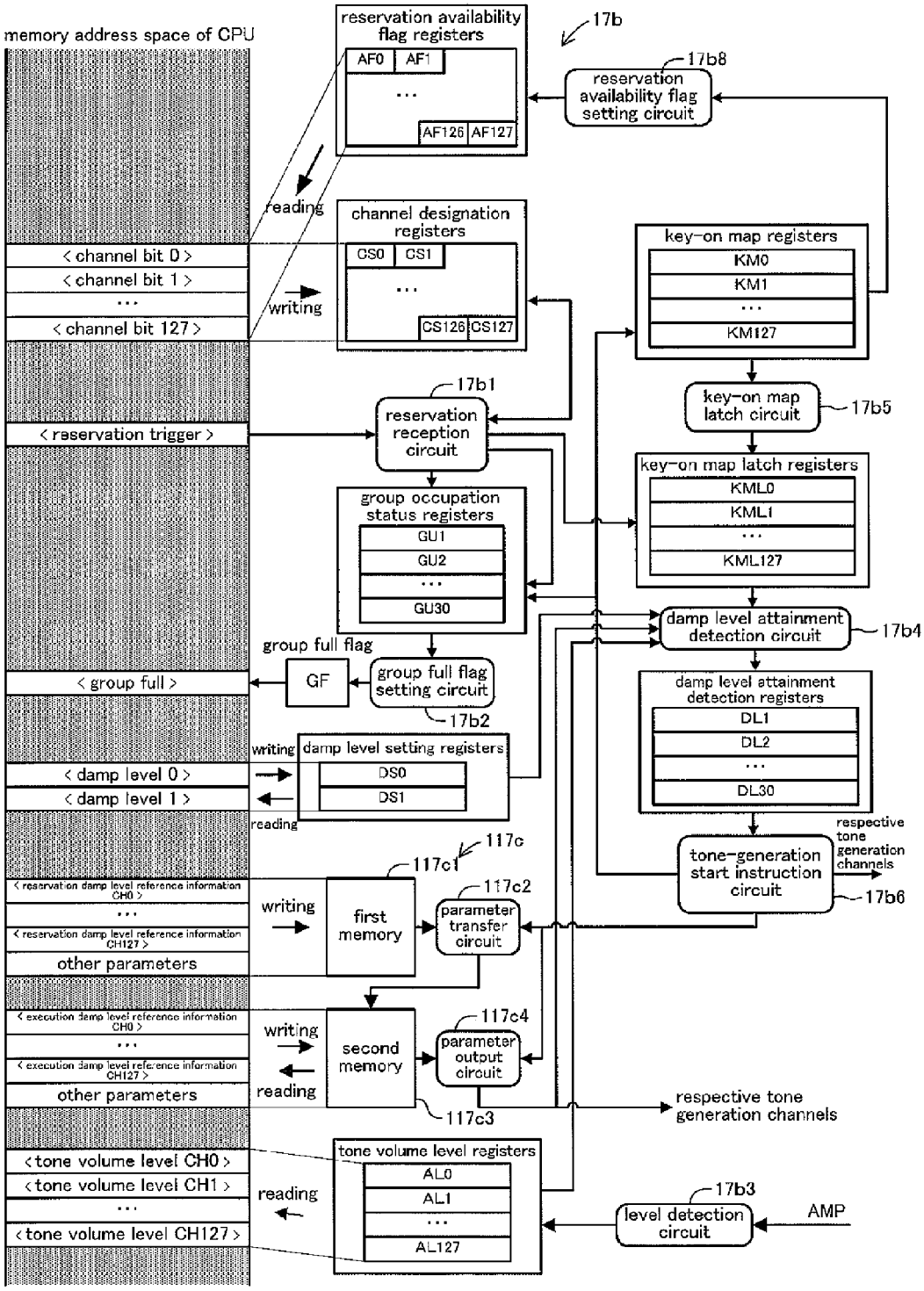
FIG. 19 is a block diagram indicative of a concrete configuration of the tone generation reservation circuit indicated in FIG. 2 according to a modification of the present invention.

Furthermore, the musical tone signal generating apparatus may be modified such that the damp level is set for each tone generation channel individually. As indicated in FIG. 19, in this modified case, the tone generation reservation circuit 17*b* is provided with a damp level setting register DS0 and a damp level setting register DS1 for storing respective damp levels. In this modification, the tone generator 17 is provided with a musical tone parameter input/output circuit 117*c* instead of the musical tone parameter input/output circuit 17*c*. The musical tone parameter input/output circuit 117*c* has a first memory 117*c*1, a parameter transfer circuit 117*c*2, a second memory 117*c*3 and a parameter output circuit 117*c*4. The first memory 117*c*1 and the second memory 117*c*3 are configured similarly to the first memory 17*c*5 and the second memory 17*c*6, respectively. The parameter transfer circuit 117*c*2 and the parameter output circuit 117*c*4 are configured similarly to the normal parameter transfer circuit 17*c*3 and the normal parameter output circuit 17*c*4, respectively. In this modification, in order to simplify the explanation of this modification, it is regarded that not only the normal parameters but also the initial parameters are supplied to the respective circuits through the second memory 117*c*3, while both the parameters are simply referred to as parameters without distinction between the initial parameters and the normal parameters. In the musical tone parameter input/output circuit 117*c*, therefore, a circuit corresponding to the initial parameter output circuit 17*c*2 is omitted. In addition, the reservation cancel circuit 17*b*7 and the reservation cancel flag registers CF0 to CF127 of the tone generation reservation circuit 17*b* are omitted. Except the above-described omitted components, this modification is configured similarly to the above-described embodiment. Hereafter, therefore, circuits and programs relating to the damp levels will be described in detail, with descriptions about the other circuits and programs being omitted.

In order to determine whether respective tone volume levels of element signals currently generated in all the tone generation channels belonging to the respective groups are at the respective damp levels or less, the damp level attainment detection circuit 17*b*4 compares the respective tone volume levels of the element signals with the damp levels stored in the damp level setting register DS0 and the damp level setting register DS1 provided for the tone generation reservation circuit 17*b*. The damp level setting register DS0 stores the damp level of element signals generated on the basis of the manual musical performance played by the player's depression and release of the keyboard 11. The damp level setting register DS1 stores the damp level of element signals generated on the basis of automatic musical performance played by an automatic performance apparatus by reading out performance information stored in the storage device 21. By initialization at power-up of this electronic musical instrument, damp levels which are different from each other are written into the respective damp level setting registers DS0, DS1 by the CPU 19*a*. The damp levels written into the damp level setting registers DS0, DS1 are represented by relative values with respect to the largest level which can be attained by element signals. Furthermore, the damp level which is to be written into the damp level setting register DS0 is smaller than that which is to be written into the damp level setting register DS1. Into the damp level setting register DS0, for instance, "−96 dB" is to be written, while "−84 dB" is to be written into the damp level setting register DS1. The damp level setting register DS0 and the damp level setting register DS1 are assigned to addresses represented by "damp level 0" and "damp level 1", respectively, of the memory address space of the CPU 19*a*, so that the CPU 19*a* can use "damp level 0" and "damp level 1" to write damp levels into the damp level setting register DS0 and the damp level setting register DS1, respectively. By use of "damp level 0" and "damp level 1", in addition, damp levels can be read from the damp level setting registers DS0, DS1.

To the damp level attainment detection circuit 17*b*4, damp level reference information DPn (n=0, 1, . . . 127) indicative of which damp level stored in either the damp level setting register DS0 or the damp level setting register DS1 is to be used for the corresponding tone generation channel is also supplied from the parameter output circuit 117*c*4. In a case where an element signal of the corresponding tone generation channel CHn is generated on the basis of manual musical performance, the damp level reference information DPn indicates the address of the damp level setting register DS0. In a case where an element signal of the corresponding tone generation channel CHn is generated on the basis of automatic performance, the damp level reference information DPn indicates the address of the damp level setting register DS1. By use of the damp level reference information DPn, the damp level attainment detection circuit 17*b*4 obtains the damp level stored in the damp level setting register DS0 or the damp level setting register DS1. The damp level attainment detection circuit 17*b*4 then carries out the above-described determination by use of the key-on map latch, the tone volume level of the tone generation channel CHn and the obtained damp level to write the determination results into the damp level attainment detection registers DL1, DL2, . . . , DL30 one after another.

For instance, in a case where the tone volume level of an element signal of the tone generation channel CHn (n=0, 1, . . . , 127) is higher than the damp level referred on the basis of the damp level reference information DPn, the damp level attainment detection circuit 17*b*4 obtains a group number m (m=1, 2, . . . , 30) stored in the key-on map latch register KMLn corresponding to the tone generation channel CHn, also setting the damp level attainment detection register DLm corresponding to the group number m at "damp level not attained". If the damp level attainment detection register DLm has been already set at "damp level not attained", the damp level attainment detection circuit 17*b*4 performs a determination on the next tone generation channel, without manipulating the damp level attainment detection register DLm. If the tone volume level of the tone generation channel CHn is equal to or lower than the damp level referred on the basis of the damp level reference information DPn, the damp level attainment detection circuit 17*b*4 will not manipulate the damp level attainment detection register DLm. In both cases where the tone volume level of the element signal of the tone generation channel CHn (n=0, 1, . . . , 127) is higher than the damp level referred on the basis of the damp level reference information DPn and where the tone volume level of the tone generation channel CHn is equal to or lower than the damp level referred on the basis of the damp level reference information DPn, if the value of the obtained key-on map register is set at "no group assignment", the damp level attainment detection circuit 17*b*4 performs a determination on the next tone generation channel, without manipulating the damp level attainment detection register DLm.

Storage areas of the damp level reference information DP0 to DP127 of the first memory 117*c*1 are assigned to addresses represented by "reservation damp level reference information CH0" to "reservation damp level reference information CH127", respectively, in the memory address space of the CPU 19*a* so that the CPU 19*a* can use "reservation damp level reference information CH0" to "reservation damp level reference information CH127" to write the address of either the damp level setting register DS0 or the damp level setting register DS1 which stores the damp level of the tone generation channel which is to be reserved as the damp level reference information DP0 to DP127 into the first memory 117*c*1.

Storage areas of the damp level reference information DP0 to DP127 of the second memory 117*c*3 are assigned to addresses represented by "execution damp level reference information CH0" to "execution damp level reference information CH127", respectively, in the memory address space of the CPU 19*a*. In a case where the generation of a musical tone is to start in the reserved tone generation channel CHn (n=0, 1, . . . , 127), the parameter transfer circuit 117*c*2 uses the address represented by "reservation damp level reference information CHn" to read out the damp level reference information DPn from the first memory 117*c*1, while using the address represented by "execution damp level reference information CHn" to write the read damp level reference information DPn into the second memory 117*c*3. As a result, the damp level reference information DPn is transferred from the first memory 117*c*1 to the second memory 117*c*3. As described in detail later, furthermore, for the determination of whether or not the tone volume level of the element signal of the tone generation channel CHn is equal to or lower than the damp level, the CPU 19*a* can use the address represented by "execution damp level reference information CHn" to read out the damp level reference information DPn from the second memory 117c3. By use of the read damp level reference information DPn, the CPU 19a can read out the damp level which will be used for the above-described determination from the damp level setting register DS0 or the damp level setting register DS1.

Next, the operation of the electronic musical instrument configured as described above will be explained. When a note-on event is generated by a player's depression of any key of the keyboard 11, the CPU 19a executes the tone generation reservation program indicated in FIG. 11 to reserve tone generation channels. In other words, the reservation of the tone generation channels in this modification is done similarly to the above-described embodiment.

In this modification, however, the reservation cancel circuit 17b7 is omitted. In the processing for securing tone generation channels in step S16, therefore, the CPU 19a instructs truncation of the tone generation channel CHn without determining whether or not the tone generation channel CHn which is to be truncated has been already reserved for a different tone-generation. After step S16f, or in a case where "No" is given in step S16e, more specifically, the CPU 19a proceeds to step S16j. At the writing of various kinds of parameters into the first memory 117c1 in step S22, the CPU 19a writes the damp level reference information as well into the first memory 117c1. More specifically, the CPU 19a writes the address of either the damp level setting register DS0 or the damp level setting register DS1 into the first memory 117c1 in accordance with the part number PN obtained in step S12. Because the note-on event has been generated by manual musical performance in this example, the CPU 19a writes the address of the damp level setting register DS0. In a case where a note-on event is generated by automatic musical performance, the CPU 19a writes the address of the damp level setting register DS1.

Figure 20:
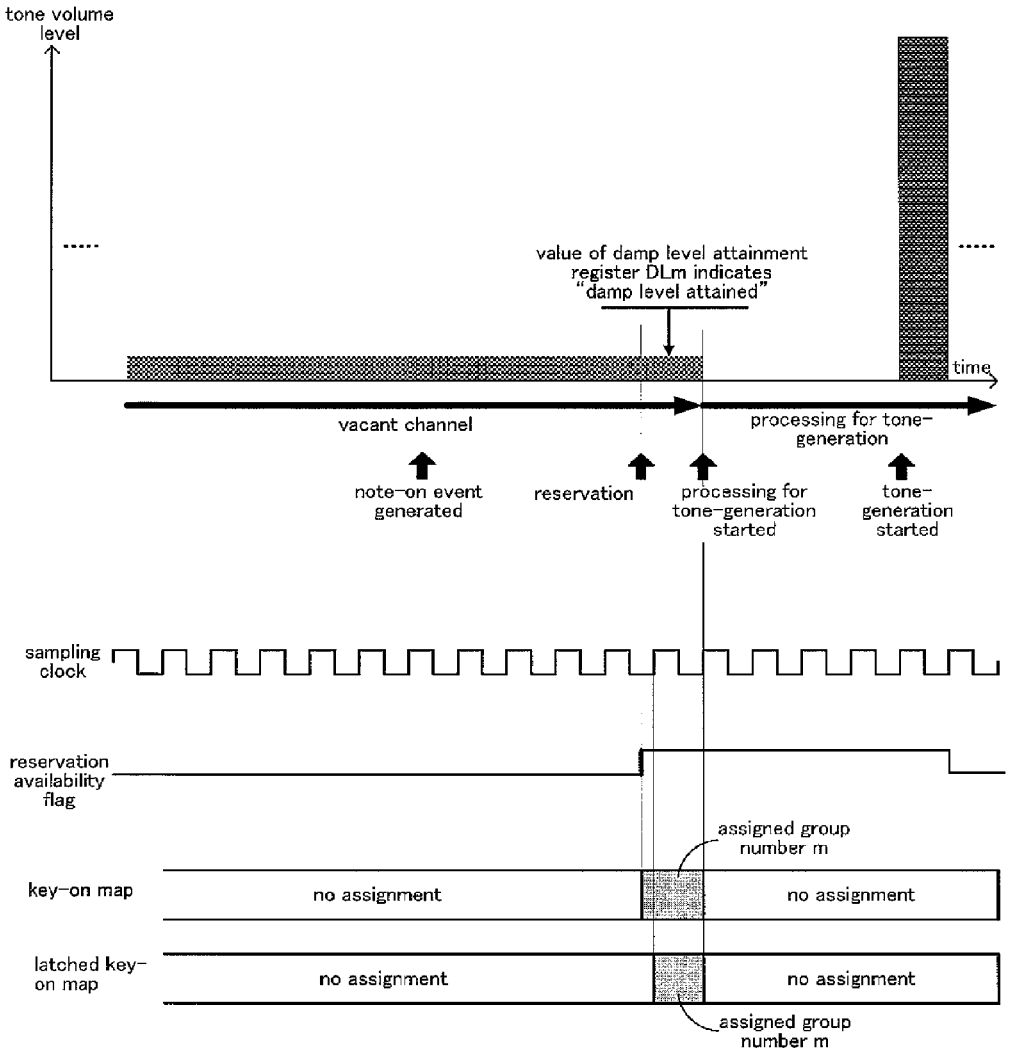
FIG. 20 is a time chart indicative of operation of the tone generation reservation circuit in a case where a tone generation channel which is to be reserved is vacant according to the modification of the present invention.

Next, the operation of the tone generator 17 of a case where the tone generation channel CHn (n=0, 1, . . . , 127), which has been secured in step S16 of the tone generation reservation program and is a vacant channel, has been reserved in steps S18 to S28 will be explained with reference to FIG. 20.

The reservation reception circuit 17b1 operates as in the case of the above-described embodiment. More specifically, the reservation reception circuit 17b1 to which the reservation trigger signal has been input obtains a vacant group number m from the group occupation status registers GU1 to GU30, and then sets the group occupation status register GUm at "occupied". Then, the obtained vacant group number m is written into the key-on map register KMn corresponding to the tone generation channel CHn. The reservation reception circuit 17b1 then sets the channel designation register CSn corresponding to the tone generation channel CHn at "no designation". After the writing of the group number m into the key-on map register KMn, the reservation availability flag setting circuit 17b8 sets the reservation availability flag AFn corresponding to the tone generation channel CHn at "reservation unavailable". At the start of the sampling cycle following the sampling cycle at which the group number m has been written into the key-on map register KMn, the key-on map latch circuit 17b5 copies the contents of the key-on map KM to the key-on map latch KML. At the following sampling cycle, in other words, the group number m is written into the key-on map latch register KMLn.

Then, the damp level attainment detection circuit 17b4 determines, on the basis of the tone volume levels of the element signals generated in the respective tone generation channels and supplied from the level detection circuit 17b3 through the tone volume level registers AL0 to AL127, and the key-on map latch, whether the tone volume levels of the element signals currently generated in the respective tone generation channels belonging to the group m have attained the respective damp levels set for the tone generation channels. For the determination on the tone generation channel CHn, the damp level reference information DPn is supplied from the parameter output circuit 117c4 to the damp level attainment detection circuit 17b4. By use of the damp level reference information DPn, the damp level attainment detection circuit 17b4 refers to either the damp level setting register DS0 or the damp level setting register DS1 to obtain the damp level for use in the above-described determination on the tone generation channel CHn. Because the note-on event has been generated by manual musical performance in the case of this example, the address of the damp level setting register DS0 is written into the damp level reference information DPn. Therefore, the damp level attainment detection circuit 17b4 obtains the damp level stored in the damp level setting register DS0. The damp level attainment detection circuit 17b4 then writes the determination result into the damp level attainment detection register DLm. At the time of reservation of the tone generation channel CHn, as described above, the tone generation channel CHn is a vacant channel. In other words, the tone volume level of the element signal of the tone generation channel CHn is lower than the damp level referred to on the basis of the damp level reference information DPn. At the sampling cycle which follows the sampling cycle at which the CPU 19a has reserved the tone generation channel CHn, the damp level attainment detection circuit 17b4 determines that the tone volume level of the tone generation channel CHn has attained the damp level.

Figure 21:
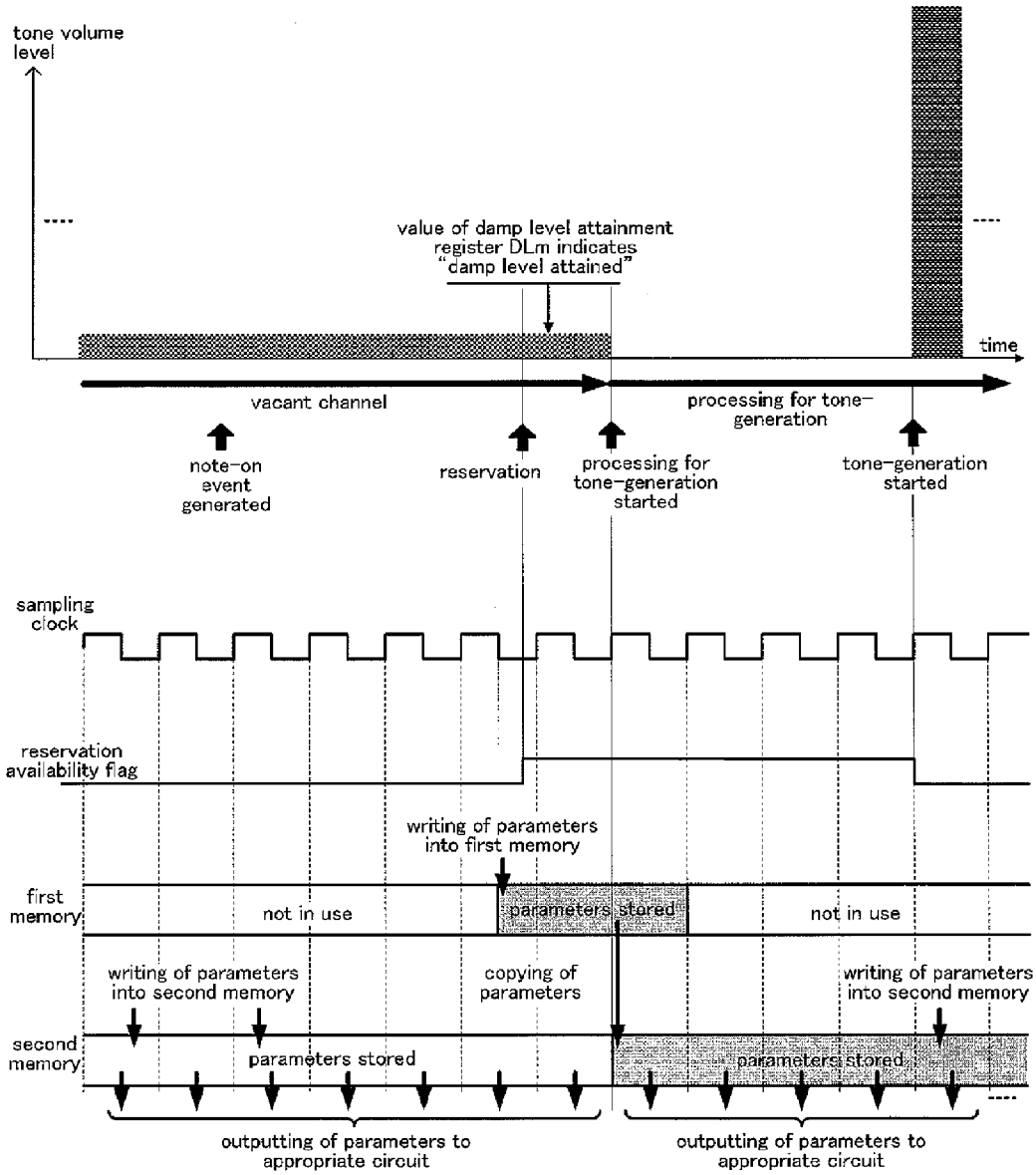
FIG. 21 is a time chart indicative of writing of parameters in a case where the tone generation channel which is to be reserved is vacant according to the modification of the present invention.

By step S22 of the tone generation reservation program by the CPU 19a, the parameters are written into the first memory 117c1 as indicated in FIG. 21. These parameters are kept in the first memory 117c1 until the value of the damp level attainment detection register DLm turns "damp level attained". After the value of the damp level attainment detection register DLm turns "damp level attained", the parameter transfer circuit 117c2 copies the parameters written into the first memory 117c1 to the second memory 117c3 at the following sampling cycle. Until the tone generation channel CHn is reserved again by a note-on event generated after the copy of the parameters kept in the first memory 117c1 to the second memory 117c3 to write parameters relating to the newly made reservation into the first memory 117c1, the parameters kept in the first memory 117c1 remain in the first memory 117c1, but the storage area of the parameters will not be referenced to, without being used.

The tone-generation start instruction circuit 17b6 operates as in the case of the above-described embodiment.

However, the parameters written into the second memory 117c3 by the parameter transfer circuit 117c2 are output by the parameter output circuit 117c4 to the damp level attainment detection circuit 17b4 and certain circuits of the respective tone generation channels at each sampling cycle.

The operation of the tone generator 17 of the case where a new note-on event is generated during tone-generation in the tone generation channel CHn (n=0, 1, . . . , 127) (i.e., while the tone generation channel CHn is not vacant), so that the tone generation channel CHn is reserved by the CPU 19a for generation of a musical tone corresponding to the new note-on event is similar to that of the above-described embodiment. However, the damp level attainment detection circuit 17b4 determines at each sampling cycle, on the basis of the tone volume levels of the element signals generated in the respective tone generation channels and supplied from the level detection circuit 17b3 through the tone volume level registers AL0 to AL127, and the key-on map latch, whether the tone volume levels currently generated in the respective tone generation channels belonging to the group m have attained the respective damp levels set for the tone generation channels. In this case as well as the case where the tone generation channel CHn is vacant at the time of reservation, the damp level reference information DPn is supplied from the parameter output circuit 117*c*4 to the damp level attainment detection circuit 17*b*4. By use of the damp level reference information DPn, the damp level attainment detection circuit 17*b*4 obtains the damp level stored in either the damp level setting register DS0 or the damp level setting register DS1. Because the note-on event has been generated by manual musical performance in this example as well, the address of the damp level setting register DS0 is written into the damp level reference information DPn. Therefore, the damp level attainment detection circuit 17*b*4 obtains the damp level stored in the damp level setting register DS0. By use of the obtained damp level, the damp level attainment detection circuit 17*b*4 carries out the above-described determination to write the determination result into the damp level attainment detection register DLm.

Figure 22:
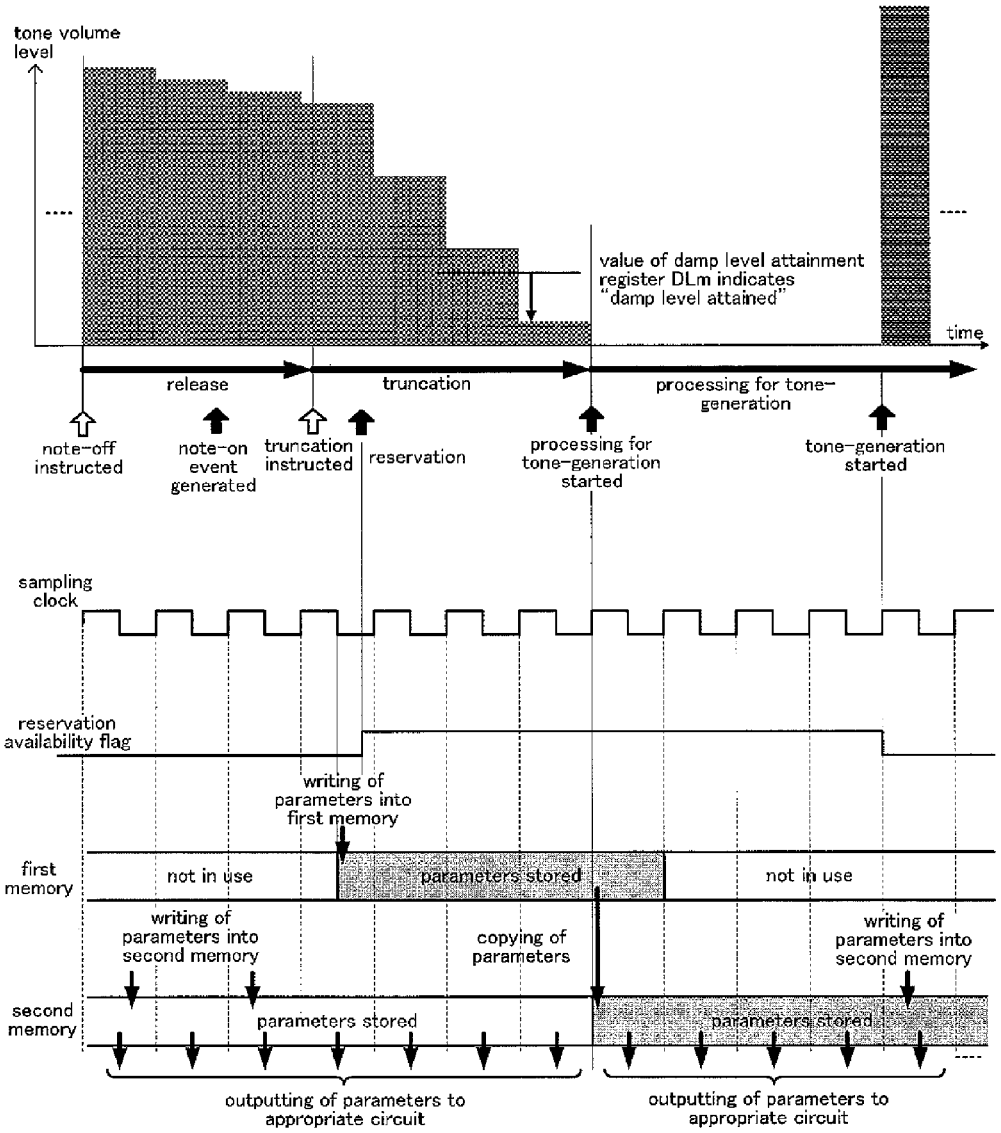
FIG. 22 is a time chart indicative of writing of parameters in a case where the tone generation channel which is to be reserved is currently generating a musical tone according to the modification of the present invention.

In the case where the tone generation channel CHn is reserved while a tone-generation is in process in the tone generation channel CHn, the damp level attainment detection circuit 17*b*4 takes a few more sampling cycles to determine that the tone generation channel CHn has attained the damp level than the case where the tone generation channel CHn is reserved when the tone generation channel CHn is vacant. As indicated in FIG. 22, furthermore, the writing of parameters into the first memory 117*c*1 and the second memory 117*c*3 and the output of the parameters to the respective circuits are done as in the case where the tone generation channel CHn is reserved when the tone generation channel CHn is vacant.

In the above-described example, the note-on event and the note-off event are generated by manual musical performance on the keyboard 11. However, note-on events and note-off events can be also generated by automatic musical performance as well. In these cases, except that a part number PN corresponding to performance information reproduced by the automatic performance apparatus is obtained in step S12 and that the damp level setting register DS1 is referred on the basis of the damp level reference information, the CPU 19*a* and the tone generator 17 operate similarly to the cases where note-on events and note-off events are generated by manual musical performance.

Figure 23:
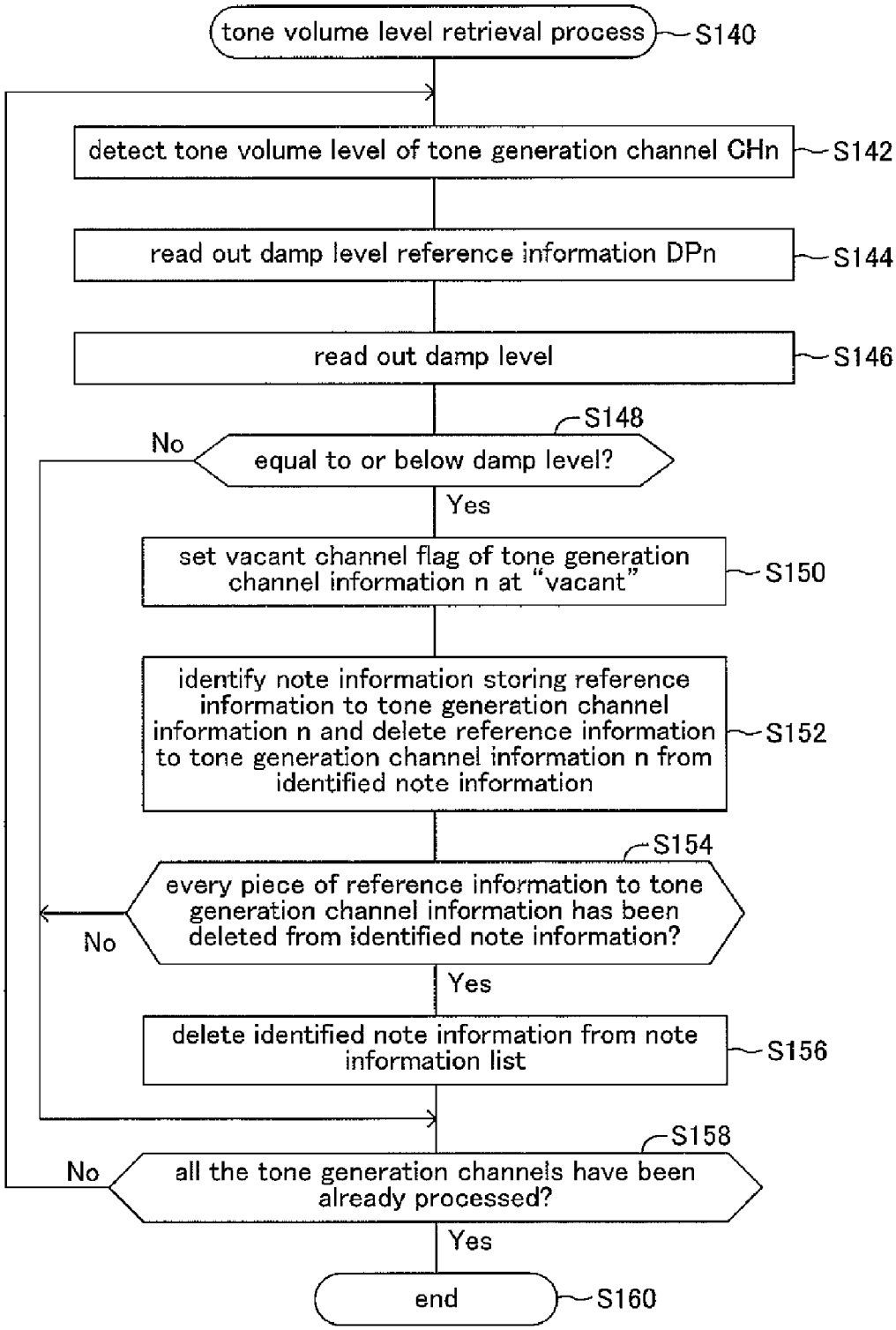
FIG. 23 is a flowchart of a tone volume level retrieval process program according to the modification of the present invention.

The CPU 19*a* carries out a periodic process program for obtaining tone volume levels indicated in FIG. 23 instead of the periodic process program for obtaining tone volume levels indicated in FIG. 18. The CPU 19*a* starts the tone volume level retrieval periodic process program in step S140. In step S142, the CPU 19*a* selects a tone generation channel CHn (n=0, 1, . . . , 127), and reads out the tone volume level of an element signal generated in the tone generation channel CHn from the tone volume level registers ALn by use of the address represented by "tone volume level CHn". In step S144, the CPU 19*a* reads out the damp level reference information DPn stored in the second memory 117*c*3 by use of the address represented by "execution damp level reference information CHn". In step S146, the CPU 19*a* reads out the damp level stored in the damp level setting register DS0 or the damp level setting register DS1 by use of the damp level reference information DPn read in step S144. In step S148, the CPU 19*a* determines whether the tone volume level of the element signal read out in step S144 is equal to or below the damp level read out in step S146. In a case where it is determined in step S148 that the tone volume level of the element signal is not equal to or below the damp level, the CPU 19*a* proceeds to step S158 which will be described later.

In a case where it is determined by the determination of step S148 that the tone volume level of the element signal is equal to or below the damp level, the CPU 19*a* sets, in step S150, the vacant channel flag of the tone generation channel information n corresponding to the tone generation channel CHn at "vacant". Using the reference information to note information recorded in the tone generation channel information n, the CPU 19*a* then identifies, in step S152, a piece of note information which stores the reference information to tone generation channel information n. In step S152, furthermore, the CPU 19*a* deletes the reference information to tone generation channel information n included in the identified note information. Then, the CPU 19*a* proceeds to step S154 to determine whether every piece of reference information to tone generation channel information stored in the identified note information has been deleted. In a case where the identified note information still has a piece of reference information to tone generation channel information, the CPU 19*a* proceeds to step S158.

In a case where every piece of reference information to tone generation channel information has been deleted from the identified note information, the CPU 19*a* proceeds to step S156 to delete the note information. In addition, the CPU 19*a* updates the forward link or rear link of the pieces of note information which precede or follow the deleted note information. Then, the CPU 19*a* proceeds to step S158 to determine whether all the tone generation channels have been already processed. When there remains an unprocessed tone generation channel, the CPU 19*a* iterates steps S142 to S156 so that respective tone volume levels of all the tone generation channels can be retrieved. After the retrieval of the respective tone volume levels of all the tone generation channels, the CPU 19*a* proceeds to step S160 to terminate the tone volume level retrieval periodic process program. In this modification, the periodic process program for updating parameters is similar to that of the above-described embodiment.

The above-described electronic musical instrument is designed such that the damp level of musical tones of the manually played parts is smaller than that of musical tones of the automatically played parts. In step S148 of the tone volume level retrieval periodic process program, therefore, the tone generation channel which is generating an element signal of an automatically played part is to be determined that the tone volume of the element signal is equal to or below the damp level at a stage in which the tone volumes of the manually played parts have not yet determined that the tone volumes are equal to or below the damp level. In a case where an element signal of an automatically played part and an element signal of a manually played part have the same velocity at which the respective tone volume levels decay, therefore, the tone generation channel which is generating the element signal of the automatically played part is to be released at an earlier point in time from the start of generation of the element signal than a point at which the tone generation channel which is generating the element signal of the manually played part is released. Because automatically played parts are assigned a larger number of musical tones and a larger variety of tone colors than the manually played parts in many cases, musical tones of the automatically played parts will seldom sound as if they are discontinued unnaturally even though the tone generation channels for automatic performance are controlled to stop generation of musical tones at the stage of the relatively great tone volume level to generate musical tones corresponding to different note-on events. On the other hand, because the tone generation channels generating element signals for manual musical performance take longer time to decay the tone volume level of musical tones, take longer time from the start of tone-generation and will not be released until the tone volume levels of the tone generation channels decrease to the sufficiently small level, musical tones of the manually played parts will seldom sound as if they are discontinued unnaturally even if the manually played parts are assigned a tone color which takes long to decay. Therefore, even if a large number of tone generation channels are used for automatic performance, the electronic musical instrument is able to secure vacant channels mainly from among the tone generation channels which have used for automatic performance, reducing the necessity to truncate a musical tone which is currently being generated. Particularly, the electronic musical instrument of this modification is able to reduce the necessity to truncate musical tones of manually played parts which are more important than automatic performance, preventing musical tones from sounding as if they are discontinued unnaturally.

In the tone generation channel securing program (FIG. 12), furthermore, in a case where there is no tone generation channel having a tone volume level which is equal to or below the damp level, the selection of a tone generation channel which will be assigned generation of a new musical tone signal is done according to a predetermined rule. For example, the tone generation channel generating a musical tone signal which has been generated for the longest time to be less important for musical performance is to be selected as a tone generation channel to be assigned generation of the new musical tone signal. As another example, from among tone generation channels generating musical tone signals of tone volume levels greater than a threshold value, the tone generation channel generating a musical tone signal having the smallest tone volume level to be less important for musical performance is to be selected. The electronic musical instrument then truncates the musical tone signal which is currently being generated in the selected tone generation channel to start generation of the new musical tone signal. Therefore, the electronic musical instrument prevents musical tones which are currently being played from sounding as if they were discontinued unnaturally, shortening the time taken from the assignment of generation of a new musical tone signal to a tone generation channel to the start of generation of the new musical tone signal.

Furthermore, the above-described modification is designed such that even in a case where there are a sufficient number of vacant channels for generation of a musical tone signal corresponding to a note-on event, reservation of tone generation channels is done similarly to the case in which a musical tone which is currently being generated is to be truncated due to a shortage of vacant channels. This aims to simplify the configuration of the tone generator 17 by standardizing the processing procedures of the tone generator 17. In a case where there are a sufficient number of vacant channels for generation of a musical tone signal corresponding to a note-on event, however, it is not necessary to reserve the tone generation channels. More specifically, the electronic musical instrument of this modification may be designed such that without using the first memory 117*c*1 and the second memory 117*c*3, the CPU 19*a* is able to write the parameters directly into the registers of the respective tone generation channels CHn (n=0, 1, . . . , 127), so that the CPU 19*a* writes, in step S22 (FIG. 9), the parameters not into the first memory 117*c*1 but directly into the respective registers of the tone generation channels. In this case, however, the damp level reference information is written into the second memory 117*c*3. Instead of steps S24 to S28 (FIG. 11), in this case, the CPU 19*a* instructs the start of generation of a musical tone. The electronic musical instrument of this modification omits the processing for reserving tone generation channels in the case where there are a sufficient number of vacant channels for generation of a musical tone signal corresponding to a note-on event, increasing the processing speed.

In this case, the damp level attainment detection circuit 17*b*4 determines whether the tone volume level of a reserved tone generation channel has attained the damp level only in a case where there are not enough vacant channels. The damp level used for the determination may be used commonly by all the tone generation channels (e.g., the damp level stored in the damp level setting register DS0). In this case, in the reserved tone generation channel, the tone volume level is sharply reduced by truncation. Whatever value may be set as a damp level, therefore, the difference in time taken to determine that the tone volume level has attained the damp level is only a few sampling cycles. In this case, therefore, the damp level attainment detection circuit 17*b*4 eliminates the necessity to obtain the damp levels which are to be used for the determination of whether the respective tone generation channels have attained their respective damp levels, increasing the processing speed further.

Furthermore, the above-described modification is designed such that the two different damp levels are provided for the manually played parts and the automatically played parts, respectively. However, the electronic musical instrument may be provided with even more damp levels. As for the manually played parts, for example, a damp level for a melody part which is played with the player's right hand and another damp level for an accompaniment part which is played with the player's left hand may be provided, respectively. The damp level for the melody part may be set at "−96 dB", while the damp level for the accompaniment part may be set at "−90 dB", for instance. By such settings, the necessity to truncate a musical tone of the manually played melody part which is the most important for musical performance can be reduced. In the above-described modification and the further modification, furthermore, the damp levels are set on the basis of the parts. Instead of the parts, however, the damp levels may be set on the basis of the types of effects, MIDI channels, the types of apparatuses from which performance information is transmitted (an external apparatus or an internal automatic performance apparatus), or the like.

In the above-described modification, furthermore, the damp levels are written into the damp level setting register DS0 and the damp level setting register DS1, respectively, so that either the address of the damp level setting register DS0 or the address of the damp level setting register DS1 can be written into the damp level reference information DPn. By use of the address written into the damp level reference information DPn, either the damp level setting register DS0 or the damp level setting register DS1 is identified. Instead of this modification, however, the electronic musical instrument may be configured such that the identification is done on the basis of index numbers ("0" and "1") corresponding to the damp level setting register DS0 and the damp level setting register DS1, respectively, so that the index number can be stored as the damp level reference information DPn. By use of the index number written into the damp level reference information DPn, in this case, either the damp level setting register DS0 or the damp level setting register DS1 is identified. By this configuration, the number of digits of the damp level reference information DPn can be reduced, resulting in reduction of the storage space of the first memory 117*c*1 and the second memory 117*c*3. Even in a case where the number of digits of the damp level setting register DS0 and the damp level setting register DS1 increases, this configuration eliminates the need for increasing the number of digits of the damp level reference information DPn. In other words, this configuration is able to increase the number of digits of the damp level setting register DS0 and the damp level setting register DS1 to increase the dynamic range of the damp level, while keeping the small number of digits of the damp level reference information DPn.

In the above-described modification, furthermore, the damp levels are written into the damp level setting registers DS0, DS1, respectively, whereas the damp level reference information which refers to either the damp level setting register DS0 or the damp level setting register DS1 is written into the first memory 117*c*1 at each reservation of tone generation channels by generation of a key-on event in order to define the damp level of a musical tone signal which is to be generated in the reserved tone generation channels. Instead of the configuration of this modification, however, the damp level itself may be written into the first memory 117*c*1. In this case, the damp level written into the first memory 117*c*1 is transferred to the second memory 117*c*3 by the parameter transfer circuit 117*c*2 to output the damp level transferred to the second memory 117*c*3 to the damp level attainment detection circuit 17*b*4 by the parameter output circuit 117*c*4. This configuration eliminates the need for the damp level setting registers DS0, DS1, resulting in even more simplified circuit configuration of the tone generator 17.

What is claimed is:

1. A musical tone signal generating apparatus comprising:

a tone generator having a plurality of tone generation channels each of which generates a musical tone signal; and a controller which assigns, in response to an instruction to generate a musical tone signal, generation of the musical tone signal to one or more of the tone generation channels, the controller including a reserving portion for supplying, to the tone generator, musical tone information which defines the musical tone signal which is to be generated and channel designation information which designates the one or more tone generation channels to which the generation of the musical tone signal is to be assigned, to reserve the one or more tone generation channels which are to be used for the generation of the musical tone signal; and the tone generator including a reservation information memory for storing reservation information indicative of the reservation of the one or more tone generation channels designated by the channel designation information, and a musical tone signal generation starting portion for making, when a tone volume level of a musical tone signal currently generated in each tone generation channel whose reservation information stored in the reservation information memory indicates that the tone generation channel is reserved is equal to or below a certain tone volume level, the each tone generation channel indicating that the tone generation channel is reserved start generating the musical tone signal defined by the musical tone information.

2. The musical tone signal generating apparatus according to claim 1, wherein the musical tone signal generation starting portion includes a tone volume level detector for detecting the tone volume level of the musical tone signal currently generated in the each tone generation channel whose reservation information indicates that the tone generation channel is reserved, a damp level attainment detector for detecting, by use of a result detected by the tone volume level detector and the reservation information stored in the reservation information memory, whether the tone volume level of the musical tone signal currently generated in the each tone generation channel whose reservation information indicates that the tone generation channel is reserved is equal to or below the certain tone volume level, and a musical tone signal generation start instructing portion for instructing, when a result detected by the damp level attainment detector indicates that the tone volume level of the musical tone signal currently generated in the each tone generation channel whose reservation information indicates that the tone generation channel is reserved is equal to or below the certain tone volume level, the each tone generation channel whose reservation information indicates that the tone generation channel is reserved to start generating the musical tone signal defined by the musical tone information.

3. The musical tone signal generating apparatus according to claim 2, wherein the reservation information memory includes a first memory for storing the reservation information such that the reservation information is updated at each instruction to generate a musical tone signal, and a second memory for storing, before the tone volume level detector starts detecting the tone volume level of the musical tone signal currently generated in the each tone generation channel whose reservation information indicates that the tone generation channel is reserved, the reservation information stored in the first memory to keep the reservation information until completion of the detection of tone volume level by the tone volume level detector, and the musical tone signal generation starting portion detects, by use of the result detected by the tone volume level detector and the reservation information stored in the second memory, whether the tone volume level of the musical tone signal currently generated in the each tone generation channel whose reservation information indicates that the tone generation channel is reserved is equal to or below the certain tone volume level.

4. The musical tone signal generating apparatus according to claim 1, wherein the tone generator further includes an identification information assigner for assigning common identification information to the one or more tone generation channels designated by the channel designation information at each instruction to generate a musical tone signal, and an identification information memory for storing an identification information flag which is set in response to the assignment of the common identification information to the designated one or more tone generation channels by the identification information assigner, and is cleared in response to the start of the generation of the musical tone signal in the each tone generation channel whose reservation information indicates that the tone generation channel is reserved by the musical tone signal generation starting portion such that each piece of the common identification information has the identification information flag in a one-to-one relationship, and the reservation information memory stores the assigned common identification information as the reservation information.

5. The musical tone signal generating apparatus according to claim 4, wherein options of the common identification information are previously provided, the identification information assigner selects, by use of the identification information flag, one of the options which has not been assigned to any tone generation channel, to assign the selected option of the identification information to the designated one or more tone generation channels, the tone generator further includes an assignment availability detector for detecting, by use of the identification information flag stored in the identification information memory, whether the designated one or more tone generation channels are able to be assigned the option of the identification information, and the reserving portion includes a waiting portion for waiting, by use of a result detected by the assignment availability detector, until the assignment of the option of the common identification information to the designated one or more tone generation channels becomes available.

6. The musical tone signal generating apparatus according to claim 2, wherein the tone volume level detector detects a tone volume level of a musical tone signal currently generated in each tone generation channel of the tone generator, and the controller further includes a level determining portion for determining, by use of a result detected by the tone volume level detector, whether the tone volume level of the musical tone signal currently generated in the each tone generation channel is equal to or below the certain tone volume level, and an assigned channel determining portion for determining, by use of a result determined by the level determining portion, the one or more tone generation channels to which the generation of the musical tone signal is to be assigned.

7. The musical tone signal generating apparatus according to claim 2, wherein the controller includes a generation instruction information memory for storing generation instruction information indicative of the instruction to generate the musical tone signal in an order in which the instruction was made, and an assigned channel determining portion for determining, by use of the generation instruction information stored in the generation instruction information memory, the one or more tone generation channels to which the generation of the musical tone signal is to be assigned.

8. A musical tone signal generating apparatus comprising:

a tone generator having a tone generation channel for generating a musical tone signal; and a controller which instructs, in response to an instruction to generate a musical tone signal, the tone generation channel to generate the musical tone signal, the controller including a reserving portion for supplying to the tone generator in response to the instruction to generate the musical tone signal, musical tone information which defines the musical tone signal which is to be generated, to reserve the tone generation channel which is to generate the musical tone signal and a cancelling portion for cancelling, in a case where the tone generation channel which the reserving portion desires to reserve has been already reserved in order to generate a different musical tone signal, the different reservation, and the tone generator including a reservation information memory for storing, in response to a reservation made by the reserving portion or a cancellation of a reservation made by the cancelling portion, reservation information indicative of whether the tone generation channel is reserved or not, and a musical tone signal generation starting portion for making, when a tone volume level of a musical tone signal currently generated in the reserved tone generation channel is equal to or below a certain tone volume level, the tone generation channel whose reservation information indicates that the tone generation channel is reserved start generating the musical tone signal defined by the musical tone information.

9. The musical tone signal generating apparatus according to claim 8, wherein the tone generator further includes an updating portion for updating, in response to the reservation made by the reserving portion or the cancellation of a reservation made by the cancelling portion, the reservation information, a cancel flag memory for storing a cancel flag which is set in response to the update of the reservation information by the updating portion in response to the cancellation of the different reservation, and is cleared in response to start of generation of the different musical tone signal by the musical tone signal generation starting portion in response to an instruction to generate the different musical tone signal, and a tone volume level controlling portion for controlling the tone volume level of the musical tone signal in accordance with the musical tone information supplied from the controller, and the controller further includes a decay instructing portion for instructing, in a case where the cancel flag has been cleared, the tone volume level controlling portion to forcefully decay the tone volume level of the different musical tone signal currently generated in the tone generation channel reserved for the generation of the different musical tone signal.

10. The musical tone signal generating apparatus according to claim 8, wherein the tone generator has a plurality of tone generation channels each of which generates a musical tone signal, and the controller assigns, in response to the instruction to generate the musical tone signal, the generation of the musical tone signal to one or more of the tone generation channels.

11. A musical tone signal generating apparatus comprising:

a tone generator having a tone generation channel for generating a musical tone signal; and a controller which instructs, in response to an instruction to generate a musical tone signal, the tone generation channel to generate the musical tone signal, the controller including a reserving portion for supplying to the tone generator, in response to the instruction to generate the musical tone signal, musical tone information which defines the musical tone signal which is to be generated, to reserve the tone generation channel which is to generate the musical tone signal, and the tone generator including a reservation information memory for storing, in response to a reservation made by the reserving portion, reservation information indicative of whether the tone generation channel is reserved or not, a musical tone information memory for storing the musical tone information supplied from the controller, and a musical tone signal generation starting portion for supplying, when a tone volume level of a musical tone signal currently generated in the tone generation channel whose reservation information stored in the reservation information memory indicates that the tone generation channel is reserved is equal to or below a certain tone volume level after the reservation of the tone generation channel made by the controller, the stored musical tone information to the tone generation channel whose reservation information indicates that the tone generation channel is reserved, to make the tone generation channel start generating the musical tone signal defined by the musical tone information.

12. The musical tone signal generating apparatus according to claim 11, wherein the musical tone information supplied from the controller to the tone generator includes initial information used for initial setting of the tone generation channel, and normal information used for varying the musical tone signal currently being generated in the tone generation channel, the musical tone information memory includes a first memory for storing the initial information and the normal information and a second memory for storing the normal information, and the musical tone signal generation starting portion includes a damp level attainment detector for detecting whether the tone volume level of the musical tone signal currently generated in the tone generation channel whose reservation information indicates that the tone generation channel is reserved is equal to or below the certain tone volume level, an initial information supplying portion for supplying, when a result detected by the damp level attainment detector indicates that the tone volume level of the musical tone signal currently being generated in the tone generation channel whose reservation information indicates that the tone generation channel is reserved is equal to or below the certain tone volume level, the initial information stored in the first memory to the tone generation channel whose reservation information indicates that the tone generation channel is reserved, a transferring portion for transferring, when the result detected by the damp level attainment detector indicates that the tone volume level of the musical tone signal currently being generated in the tone generation channel whose reservation information indicates that the tone generation channel is reserved is equal to or below the certain tone volume level, the normal information stored in the first memory to the second memory such that the second memory stores the transferred normal information, a normal information supplying portion for supplying the normal information stored in the second memory to the tone generation channel whose reservation information indicates that the tone generation channel is reserved, and a musical tone signal generation start instructing portion for instructing, when the result detected by the damp level attainment detector indicates that the tone volume level of the musical tone signal currently being generated in the tone generation channel whose reservation information indicates that the tone generation channel is reserved is equal to or below the certain tone volume level, the tone generation channel whose reservation information indicates that the tone generation channel is reserved to start generating the musical tone signal defined by the musical tone information.

13. The musical tone signal generating apparatus according to claim 12, wherein the tone generator further includes an operating status detector for detecting an operating status of the tone generation channel currently generating the musical tone signal, and the controller further includes an updating portion for updating, by use of a result detected by the operating status detector, the normal information stored in the second memory.

14. The musical tone signal generating apparatus according to claim 11, wherein the tone generator has a plurality of tone generation channels each of which generates a musical tone signal, and the controller assigns, in response to an instruction to generate a musical tone signal, generation of the musical tone signal to one or more of the tone generation channels.

15. The musical tone signal generating apparatus according to claim 13, wherein the normal information which the updating portion updates is information on tone pitch of the musical tone signal.

16. The musical tone signal generating apparatus according to claim 13, wherein the normal information which the updating portion updates is information on tone volume level of the musical tone signal.

17. The musical tone signal generating apparatus according to claim 13, wherein the normal information which the updating portion updates is information on tone color of the musical tone signal.

18. A musical tone signal generating apparatus comprising:

a plurality of tone generation channels each of which generates a musical tone signal; and an assigner which assigns, in response to each of instructions to generate different types of musical tone signals, each of the musical tone signals to any of the tone generation channels so that the respective tone generation channels will generate the assigned musical tone signals wherein the assigner is provided with a first selection portion which selects, in response to an instruction to generate a new musical tone signal, from among the plurality of tone generation channels as a tone generation channel which is to generate the new musical tone signal, the tone generation channel generating the musical tone signal whose volume level is equal to or below a threshold value which is included in different threshold values provided to correspond to the types of the musical tone signals and corresponds to the type of the assigned musical tone signal.

19. The musical tone signal generating apparatus according to claim 18, wherein the first selection portion has:

a vacant channel setting portion which compares, at certain time intervals, a tone volume level of each of the musical tone signals assigned to the respective tone generation channels with the threshold value which is included in the different threshold values provided to correspond to the types of the musical tone signals and corresponds to the musical tone signal, and sets, when the tone volume level of the musical tone signal is equal to or below the threshold value corresponding to the musical tone signal, the tone generation channel to which the musical tone signal is assigned as a vacant channel; and a channel determination portion which determines, in response to an instruction to generate a new musical tone signal, the set vacant channel as a tone generation channel which is to generate the new musical tone signal.

20. The musical tone signal generating apparatus according to claim 18, wherein the different types of musical tone signals include musical tone signals generated by player's manual musical performance and musical tone signals generated by automatic musical performance; and the threshold value corresponding to the musical tone signals generated by the manual musical performance is smaller than the threshold value corresponding to the musical tone signals generated by the automatic musical performance.

21. The musical tone signal generating apparatus according to claim 18, wherein the assigner is provided with a second selection portion which selects, when there is no tone generation channel whose tone volume level is equal to or below the corresponding threshold value, a tone generation channel generating a musical tone signal which has been generated for the longest time from among the plurality of tone generation channels as a tone generation channel which is to generate the new musical tone signal.

22. The musical tone signal generating apparatus according to claim 18, wherein the assigner is provided with a second selection portion which selects, when there is no tone generation channel whose tone volume level is equal to or below the corresponding threshold value, a tone generation channel generating a musical tone signal having the smallest tone volume level from among the plurality of tone generation channels as a tone generation channel which is to generate the new musical tone signal.

23. The musical tone signal generating apparatus according to claim 21, further comprising:

a truncation portion which quickly decays the tone volume level of the musical tone signal currently generated by the tone generation channel selected by the second selection portion.

* * * * *